US012426747B2

(12) United States Patent
Prescott et al.

(10) Patent No.: US 12,426,747 B2
(45) Date of Patent: Sep. 30, 2025

(54) AUTONOMOUS WASTE COLLECTION

(71) Applicant: Battelle Memorial Institute, Columbus, OH (US)

(72) Inventors: James Prescott, Columbus, OH (US); Thomas D. Haubert, Columbus, OH (US); Krista I. A. Smith, Dublin, OH (US); Andrew V. Sweeney, Columbus, OH (US); Lindy Espina Dejarme, Columbus, OH (US)

(73) Assignee: Battelle Memorial Institute, Columbus, OH (US)

( * ) Notice: Subject to any disclaimer, the term of this patent is extended or adjusted under 35 U.S.C. 154(b) by 567 days.

(21) Appl. No.: 17/679,987

(22) Filed: Feb. 24, 2022

(65) Prior Publication Data

US 2022/0369872 A1 Nov. 24, 2022

Related U.S. Application Data

(60) Provisional application No. 63/276,224, filed on Nov. 5, 2021, provisional application No. 63/154,345, filed on Feb. 26, 2021.

(51) Int. Cl.
*A47K 11/02* (2006.01)
*E03D 7/00* (2006.01)

(52) U.S. Cl.
CPC ..... *A47K 11/026* (2013.01); *E03D 7/00* (2013.01)

(58) Field of Classification Search
CPC ... E03D 7/00; A47K 11/00–08; A47K 11/105; A47K 13/10
See application file for complete search history.

(56) References Cited

U.S. PATENT DOCUMENTS 2,772,420 A * 12/1956 Carter ..... E03D 7/00 4/458
5,513,404 A 5/1996 Kanai
6,081,935 A * 7/2000 Kishi ..... E03D 7/00 4/300
8,359,122 B2 * 1/2013 Koselka ..... G08B 21/043 700/250

(Continued)

FOREIGN PATENT DOCUMENTS

CN 201391001 Y 1/2010
CN 102619269 A 8/2012

(Continued)

OTHER PUBLICATIONS

International Search Report and Written Opinion from corresponding PCT Appln. No. PCT/US22/17729, dated Jun. 2, 2022, 11 pages.

*Primary Examiner* — David P Angwin
*Assistant Examiner* — Nicholas A Ros
(74) *Attorney, Agent, or Firm* — Grossman, Tucker, Perreault & Pfleger, PLLC; Zachary A. Cody

(57) ABSTRACT

An autonomous toilet may include a waste receptacle having a receptacle opening, a seat extending at least partially around the receptacle opening, the seat being configured to support a user of the autonomous toilet, a plurality of driven wheels configured to urge the autonomous toilet across a surface, one or more sensors configured to sense one or more conditions of a surrounding environment, and a controller communicatively coupled to the one or more sensors and the plurality of driven wheels.

23 Claims, 40 Drawing Sheets

(56) References Cited

U.S. PATENT DOCUMENTS

| | | | | |
|---|---|---|---|---|
| 9,038,215 | B2 | 5/2015 | Al-Jafar | |
| 9,422,705 | B2 * | 8/2016 | Akar | E03D 7/00 |
| 9,560,942 | B2 * | 2/2017 | Lederer | E03D 7/00 |
| 10,244,904 | B2 * | 4/2019 | Zhao | G01S 13/88 |
| 10,709,308 | B2 | 7/2020 | Buehler et al. | |
| 10,791,888 | B1 * | 10/2020 | Doctor | A47K 13/10 |
| 2009/0158514 | A1 * | 6/2009 | Doctors | A47K 11/105 4/300.3 |
| 2010/0229293 | A1 * | 9/2010 | Rodgers | A61G 7/1019 4/246.1 |
| 2020/0040561 | A1 * | 2/2020 | Sugawara | A47K 17/026 |
| 2020/0139536 | A1 | 5/2020 | Frisby et al. | |
| 2021/0261163 | A1 * | 8/2021 | Ohno | B60R 15/04 |

FOREIGN PATENT DOCUMENTS

| | | | | | |
|---|---|---|---|---|---|
| CN | 104526697 | A | | 4/2015 | |
| CN | 104571114 | A | | 4/2015 | |
| CN | 204370541 | U | | 6/2015 | |
| CN | 105729481 | A | | 7/2016 | |
| CN | 105796266 | A | | 7/2016 | |
| CN | 106094768 | A | | 11/2016 | |
| EP | 1782723 | | * | 5/2007 | A47K 11/04 |
| JP | H06299588 | A | | 10/1994 | |
| JP | H09256442 | A | | 9/1997 | |
| JP | 3141726 | U | | 5/2008 | |
| JP | 4257929 | | * | 4/2009 | E03D 11/13 |
| JP | 4257929 | B1 | | 4/2009 | |
| JP | 4436178 | B2 | | 3/2010 | |
| JP | 5234501 | B2 | | 7/2013 | |
| JP | 2018-48486 | A | | 3/2018 | |

* cited by examiner

AUTONOMOUS WASTE COLLECTION

CROSS-REFERENCE TO RELATED APPLICATIONS

The present application claims the benefit of U.S. Provisional Application Ser. No. 63/154,345 filed on Feb. 26, 2021, entitled Autonomous Waste Collection and U.S. Provisional Application Ser. No. 63/276,224 filed on Nov. 5, 2021, entitled Autonomous Waste Collection, each of which are fully incorporated herein by reference.

TECHNICAL FIELD

The present disclosure is generally directed to waste collection and more particularly to autonomous waste collection.

BACKGROUND

Age and/or infirmity may result in daily tasks becoming increasingly challenging to complete. For example, an individual's mobility may be hindered as a result of age, illness, and/or medical procedures. A decrease in mobility may make the performance of daily tasks increasingly difficult and, in the case of some tasks, cause embarrassment to the individual.

For example, traveling to a restroom may be difficult, potentially requiring a third party's (e.g., a family member, friend, or hired assistant) assistance to accomplish. In some instances, the difficulty may be significant enough that the individual may be required to live in an assisted living facility instead of their home. Even in instances where the individual is able to travel to the restroom on their own, the difficulty in traveling to the restroom may, for example, dissuade the individual from using the restroom as frequently as desired and/or may encourage the individual to decrease fluid intake in order to avoid use of the restroom.

While the individual may be provided with a waste receptacle (e.g., a bed pan or chamber pot) to collect urine and/or feces without requiring the individual to travel to the restroom, the devices can be unsightly, embarrassing, and/or odorous. Further, proper cleaning of these waste receptacles may be onerous to the individual and/or a third party assisting the individual. Additionally, or alternatively, the individual may elect to use a diaper for waste collection. However, use of a diaper may be embarrassing to the user, unsanitary, and/or odorous. Further, proper disposal of the diaper and cleanup after use may be onerous to the individual and/or a third party assisting the individual.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
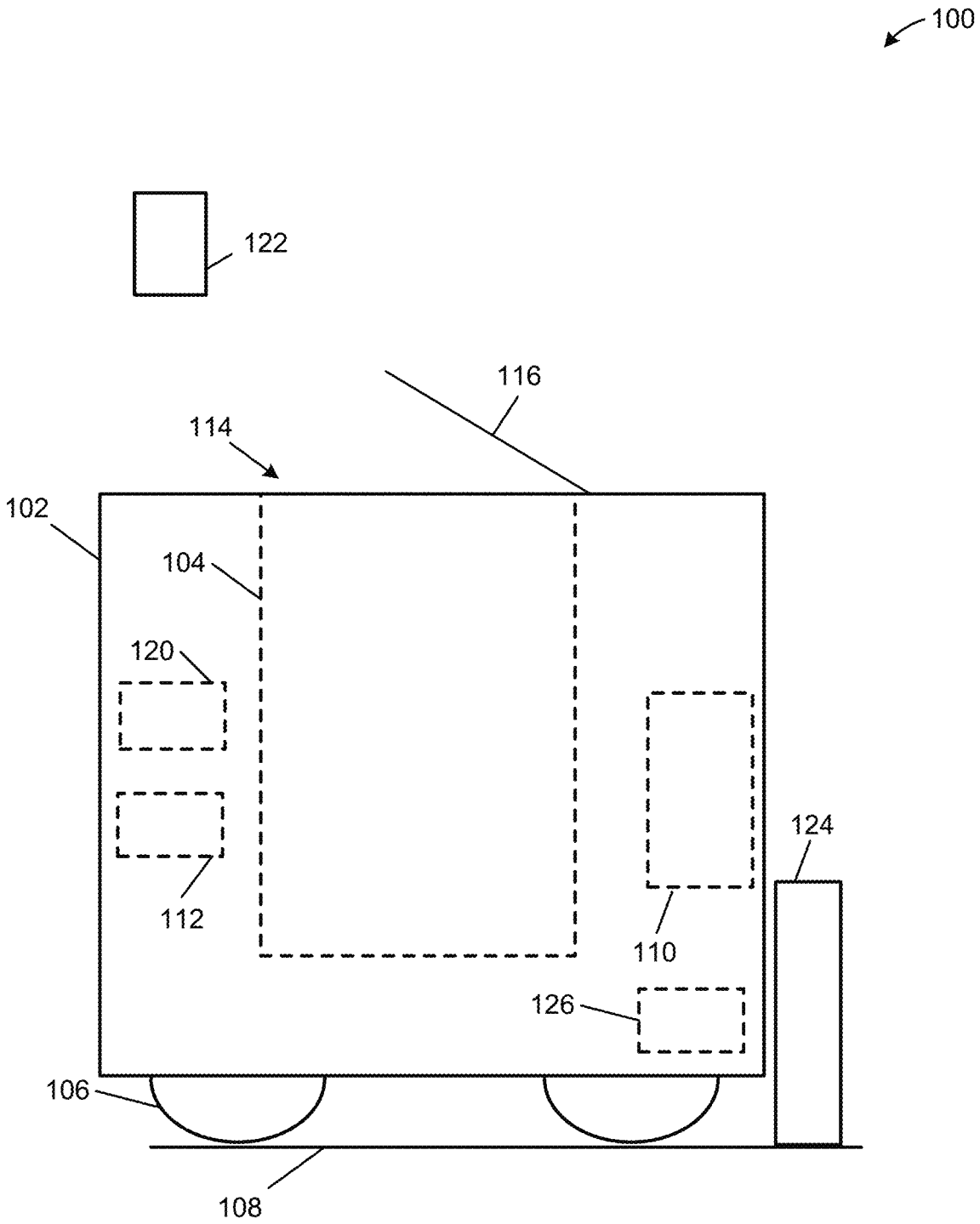
FIG. 1 shows a schematic example of an autonomous waste collector, docking station, and remote device, consistent with embodiments of the present disclosure.

The present disclosure is not limited in its application to the details of construction and the arrangement of components set forth in the following description or illustrated in the drawings. The examples described herein may be capable of other embodiments and of being practiced or being carried out in various ways. Also, it may be appreciated that the phraseology and terminology used herein is for the purpose of description and should not be regarded as limiting as such may be understood by one of skill in the art. Throughout the present description, like reference characters may indicate like structure throughout the several views, and such structure need not be separately discussed. Furthermore, any particular feature(s) of a particular exemplary embodiment may be equally applied to any other exemplary embodiment(s) of this specification as suitable. In other words, features between the various exemplary embodiments described herein are interchangeable, and not exclusive.

The present disclosure is generally directed to an autonomous waste collector. The autonomous waste collector includes a main body, a waste receptacle at least partially disposed within the main body, one or more driven wheels configured to urge the main body across a surface, and a controller communicatively coupled to one or more sensors and the one or more driven wheels. The controller is configured to cause the one or more driven wheels to urge the main body across a surface based, at least in part, on one or more outputs generated by the one or more sensors.

FIG. 1 shows a schematic example of an autonomous waste receptacle 100. As shown, the autonomous waste receptacle 100 includes a main body 102, a waste receptacle 104 at least partially disposed within the main body 102, one or more driven wheels 106 configured to urge the main body across a surface 108, and a controller 110 communicatively coupled to one or more environmental sensors 112 and the one or more driven wheels 106. The waste receptacle 104 is configured to receive waste through a receptacle opening 114. A lid 116 may be configured to selectively enclose the waste receptacle 104. For example, the lid 116 may be configured to selectively extend over the receptacle opening 114. The waste may include, for example, human waste (e.g., urine or feces), medical waste (e.g., relating chemotherapy treatments), and/or any other kind of waste.

The environmental sensors 112 are configured to sense one or more conditions of a surrounding environment. For example, the environmental sensors 112 may be configured to sense one or more obstacles within the surrounding environment. In response to detecting an obstacle in a movement path of the autonomous waste receptacle 100, the controller 110 can be configured to cause the autonomous waste receptacle 100 to engage in an evasive behavior such that the detected obstacle can be avoided. Additionally, or alternatively, the autonomous waste receptacle 100 may be configured to move a detected obstacle. By way of further example, the environmental sensors 112 may be configured to sense one or more landmarks within the surrounding environment for the purposes of generating a map of the surrounding environment. The generated map may be referenced by the controller 110 for purposes of path planning such that the autonomous waste receptacle 100 may be caused to navigate the surrounding environment based, at least in part, on a planned path. Examples of environmental sensors 112 may include one or more of an infrared (IR) proximity sensor, an ultrasonic proximity sensor, a monocular camera, a stereo camera, a light detection and ranging (LIDAR) sensor, a tactile sensor (e.g., that is actuated in response to movement of a displaceable bumper coupled to the autonomous waste receptacle 100), a temperature sensor, a humidity sensor, a radio frequency sensor (e.g., capable of measuring signal strength), and/or any other environmental sensor.

The autonomous waste receptacle 100 may further include one or more communication devices 120 communicatively coupled to the controller 110. The one or more communication devices 120 are configured to communicatively couple to one or more remote devices 122 (e.g., a server, a computer, a tablet, a smartphone, a remote control, and/or any other remote device) and the controller 110. For example, the remote device 122 can be configured such that a user can summon the autonomous waste receptacle 100 to a specific location (e.g., the user's location or another location). In this example, the remote device 122 may generate a summon request that is transmitted to and received by at least one of the one or more communication devices 120. In response to one or more communication devices 120 receiving the summon request, the controller 110 can cause the one or more driven wheels 106 to navigate the autonomous waste receptacle 100 to the specific location.

Additionally, or alternatively, the remote device 122 can be configured to display a status of the autonomous waste receptacle 100 (e.g., a location, battery level, quantity of waste collected, errors, and/or any other status). For example, the remote device 122 may be configured to display data relating to timing of waste receival, quantity of waste received, and/or frequency of waste receival. In some instances, the remote device 122 may include a digital assistant capable of receiving voice commands from a user, the voice commands being used to control the autonomous waste receptacle 100. An example of a digital assistant may include the commercially available AMAZON ALEXA, APPLE SIRI, MICROSOFT CORTANA, and/or any other digital assistant. In some instances, there may be a plurality of remote devices 122, each communicatively coupled to the one or more communication devices 120. In some instances, the remote device 122 may be configured to issue steering and driving commands to the autonomous waste receptacle 100 such that a user may manually control the autonomous waste receptacle 100 remotely.

The one or more communication devices 120 can be configured to communicate with the remote device 122 over a wireless or wired communication link. Examples of communication devices 120 may include one or more of a wireless radio (e.g., WiFi, Bluetooth, near-field-communication, and/or any other wireless radio), optical communication emitters and/or detectors (e.g., IR emitter/receiver pairs and/or any other form of optical communication), a wired connection (e.g., a universal serial bus connection, an ethernet connection, and/or any other form of wired connection) and/or any other communication device.

The autonomous waste receptacle 100 can also be configured to engage (e.g., couple to) a docking station 124. The docking station 124 can be configured to charge one or more batteries 126 of the autonomous waste receptacle 100. The docking station 124 may, in some instances, be configured to remove waste deposited within the waste receptacle 104. For example, the docking station 124 may be configured to store received waste for later disposal. In this example, the docking station 124 may be configured to perform one or more operations on the waste (e.g., compaction, incineration, composting, or any other operation). If waste (e.g., feces or urine) is composted in the docking station 124, one or more enzymes may be introduced to the waste in order to break the waste down into a compost that can be thrown away or flushed down the toilet. In some instances, the enzymes may be mixed with an absorbent material (e.g., a clay material). The absorbent material may be a material that is safely disposable down a fixed toilet. By way of further example, the docking station 124 may be coupled to a central waste depository (e.g., a sewer or septic line) such that received waste may be transferred from the waste receptacle 104 to the central waste depository.

In some instances, the autonomous waste receptacle 100 may be configured to perform one or more operations on the waste. For example, the autonomous waste receptacle 100 may be configured to introduce one or more composting enzymes to the collected waste (e.g., enzymes capable of breaking down human urine or feces) and/or an absorbent material (e.g., a clay material). In some instances, the waste receptacle 104 may include the enzymes and/or the absorbent material prior to receiving waste. The absorbent material may be a material that is safely disposable down a fixed toilet. In some instances, a disposable liner (e.g., a bag) may be disposed within the waste receptacle 104, wherein the enzymes and/or absorbent material are disposed within the disposable liner (e.g., when inserted into the waste receptacle 104). In these instances, waste received within the disposable liner may interact with the enzymes and/or absorbent material such that the disposable liner and waste may be safely and/or easily disposed of.

Figure 2:
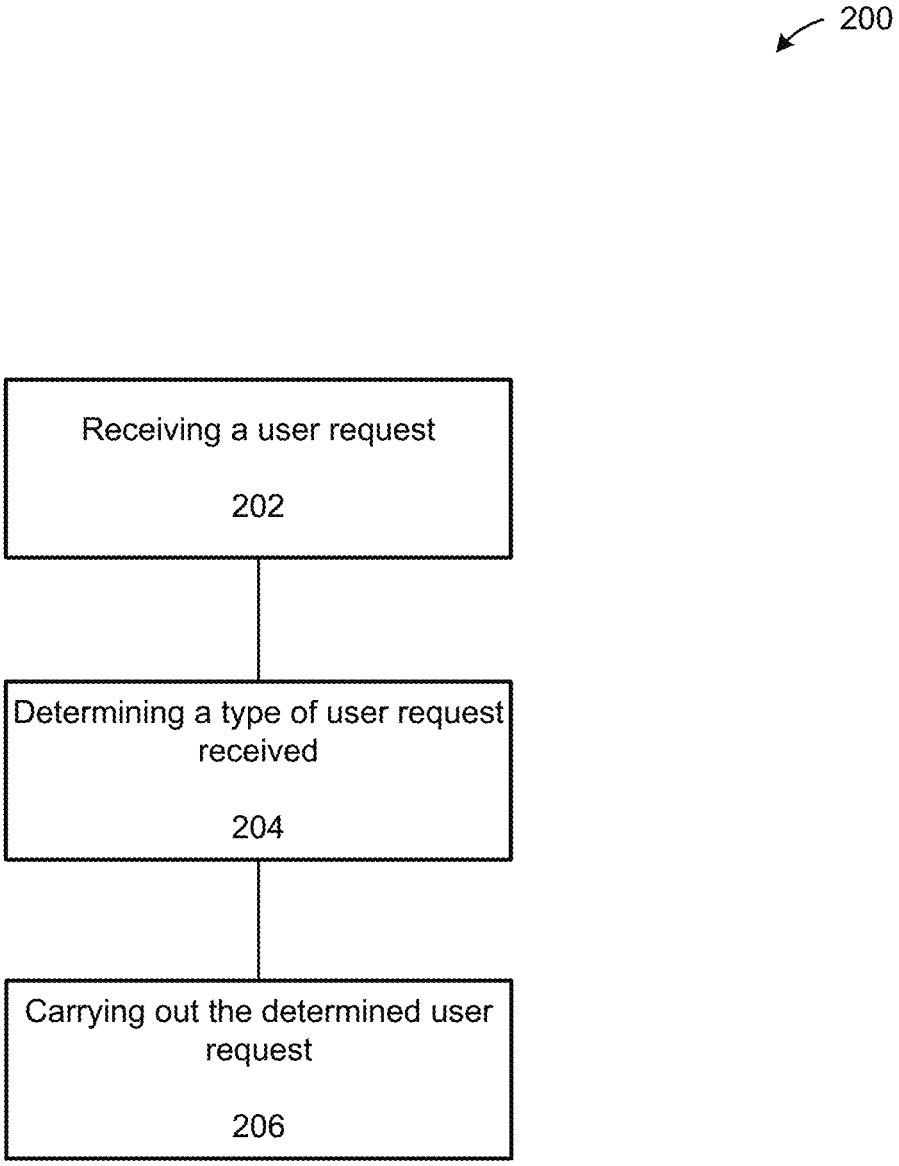
FIG. 2 shows a flow chart of an example of a method of operating the autonomous waste collector of FIG. 1, consistent with embodiments of the present disclosure.

FIG. 2 shows a flow chart of one example of a method 200 for operating the autonomous waste receptacle 100 of FIG. 1. The method 200 may be embodied in one or more non-transitory computer readable mediums (e.g., of the controller 110) as one or more instructions stored thereon that, when executed by one or more processors (e.g., of the controller 110), cause the method 200 to be carried out. Additionally, or alternatively, the method 200 may embodied in circuitry (e.g., application specific integrated circuitry, field programmable gate arrays, and/or the like). In some instances, a portion of the method 200 may be embodied in circuitry and a portion of the method 200 may be embodied in one or more non-transitory mediums.

As shown, the method 200 may include a step 202. The step 202 includes receiving, from the remote device 122 a user request. In some instances, the user request may be associated with a behavior modifier. An example behavior modifier may include an expedite behavior modifier. An expedite behavior modifier might result in the autonomous waste receptacle 100 carrying out the user request at a faster rate at the expense of increased energy usage.

The method may also include a step 204. The step 204 includes determining a type of user request received. For example, the user request may include a summon request, the summon request causing the autonomous waste receptacle 100 to navigate to the user. By way of further example, the user request may include a return to dock request, the return to dock request causing the autonomous waste receptacle 100 to navigate to the docking station 124 when the autonomous waste receptacle 100 is away from the docking station 124. By way of still further example, the user request may include a waste receptacle empty request which causes the autonomous waste receptacle 100 to engage in an evacuation routine (e.g., in cooperation with the docking station 124).

The method 200 may include a step 206. The step 206 includes carrying out the determined user request. For example, when a summon request is received, the autonomous waste receptacle 100 may estimate a user's position within a map of the surrounding environment and generate a path through the surrounding environment to the user. The user's estimated position may be determined using, for example, position data provided by the remote device 122, using a signal strength of a wireless signal generated by the remote device 122, and/or any other data. By way of further example, when a dock request is received and the autonomous waste receptacle 100 is not engaging the docking station 124, the autonomous waste receptacle 100 may estimate a position of the docking station 124 within a map of the surrounding environment and generate a path through the surrounding environment to the docking station 124. By way of still further example, when a waste receptacle empty request is received, the autonomous waste receptacle 100 may determine whether the autonomous waste receptacle 100 is engaging the docking station 124. If it is determined that the autonomous waste receptacle 100 is engaging the docking station 124, the evacuation routine may be commenced. If it is determined that the autonomous waste receptacle 100 is not engaging the docking station 124, the autonomous waste receptacle 100 may be caused to first execute a dock request in order to engage the docking station 124 and then execute the evacuation routine when engaging the docking station 124.

Figure 4:
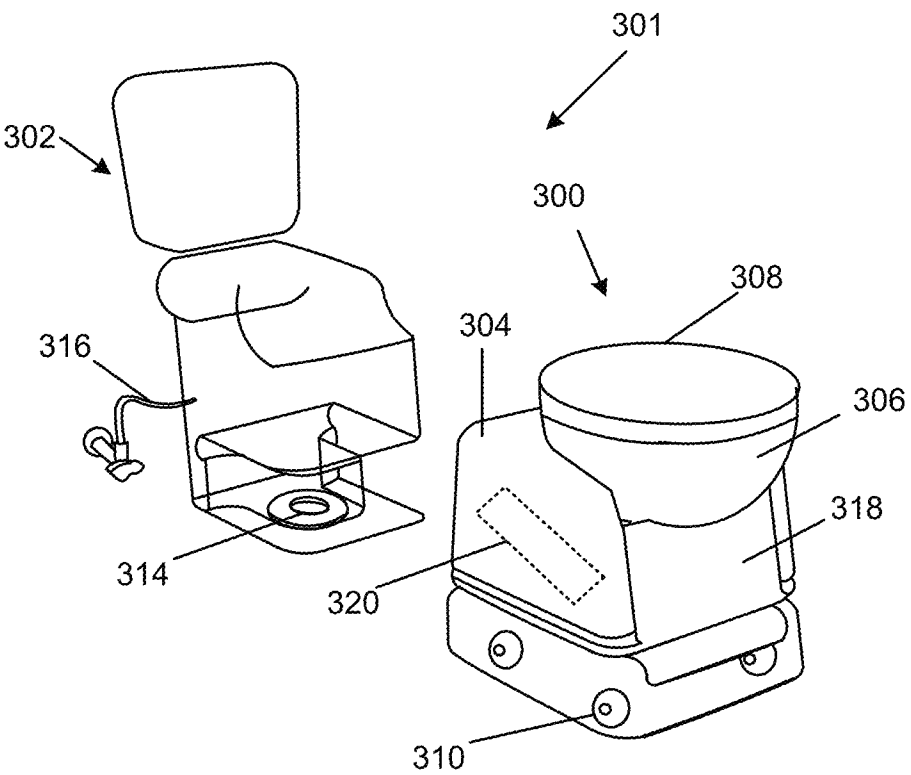
FIG. 4 shows a schematic example of the autonomous toilet of FIG. 3 decoupled from the docking station of FIG. 3, consistent with embodiments of the present disclosure.
Figure 3:
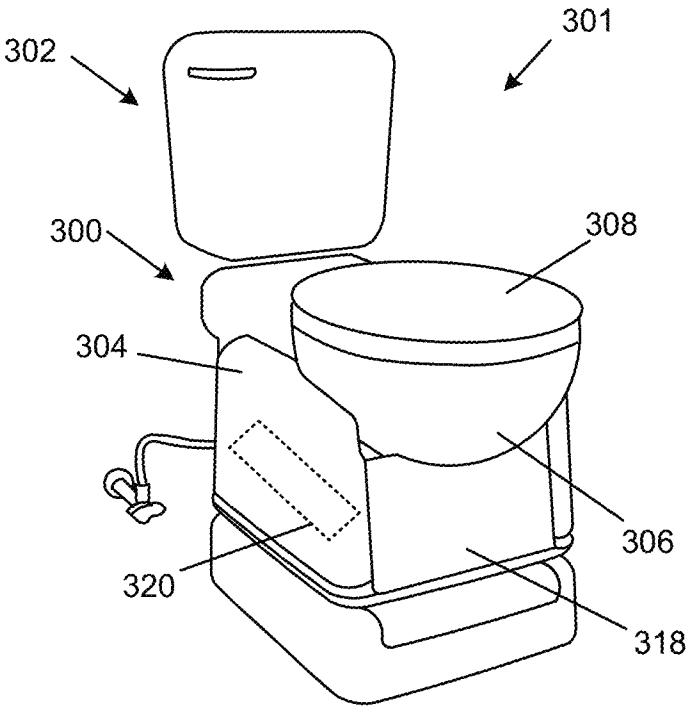
FIG. 3 shows a schematic example of an autonomous toilet coupled to a docking station, consistent with embodiments of the present disclosure.

FIG. 3 shows a schematic example of an autonomous toilet 300 coupled to a docking station 302 and FIG. 4 shows a schematic example of the autonomous toilet 300 disengaged from the docking station 302. The autonomous toilet 300 may be an example of the autonomous waste receptacle 100 of FIG. 1 and the docking station 302 may be an example of the docking station 124 of FIG. 1. The autonomous toilet 300 and the docking station 302 may generally be described as forming at least a portion of an autonomous toilet system 301.

As shown, the autonomous toilet 300 includes a main body 304, a waste receptacle 306 disposed at least partially within the main body 304, and a lid 308 configured to selectively enclose an open end of the waste receptacle 306. A plurality of driven wheels 310 are coupled to the main body 304, the driven wheels 310 being configured to urge the autonomous toilet 300 across a surface (e.g., a floor).

The autonomous toilet 300 is configured to engage (e.g., contact) the docking station 302. When engaging the docking station 302 the autonomous toilet 300 is configured to interface with one or more couplings of the docking station 302. For example, the one or more couplings may include a waste coupling 314 and a fluid coupling 316. The waste coupling 314 may be fluidly coupled with a septic or sewer line such that waste stored within the waste receptacle 306 of the autonomous toilet 300 can be transferred to the septic or sewer line. The fluid coupling 316 may be fluidly coupled to a water supply such that water can be transferred to the waste receptacle 306 (e.g., to clean the waste receptacle 306 and/or to facilitate the transfer of waste from the waste receptacle 306 to the septic or sewer line). The docking station 302 may be further configured to charge one or more batteries of the autonomous toilet 300.

In some instances, the waste received within the waste receptacle 306 is caused to be transferred to a secondary storage receptacle 318 of the autonomous toilet 300. By transferring waste to the secondary storage receptacle 318, the autonomous toilet 300 may be able to be utilized multiple times before returning to the docking station 302 (e.g., according to a schedule and/or a use count). As such, the secondary storage receptacle 318 may generally be described as being selectively fluidly coupled to the waste receptacle 306. Additionally, or alternatively, the autonomous toilet 300 may be configured to return to the docking station 302 after each use for evacuation.

In some instances, the autonomous toilet 300 may include a fluid reservoir 320 configured to store and distribute a fluid (e.g., water). The fluid reservoir 320 may be configured to receive fluid (e.g., water) through the fluid coupling 316 when the autonomous toilet 300 is engaging the docking station 302. In use, the fluid reservoir 320 may provide fluid (e.g., water) to the waste receptacle 306 when the autonomous toilet 300 is disengaged from the docking station 302. For example, the fluid reservoir 320 may be caused to transfer fluid (e.g., water) into the waste receptacle 306 in response to a user sitting on the autonomous toilet 300 and/or in response to the user getting off the autonomous toilet 300. This may facilitate the transfer of waste from the waste receptacle 306 to the secondary storage receptacle 318 (e.g., by providing lubrication to the sidewalls of the waste receptacle 306).

Figure 5:
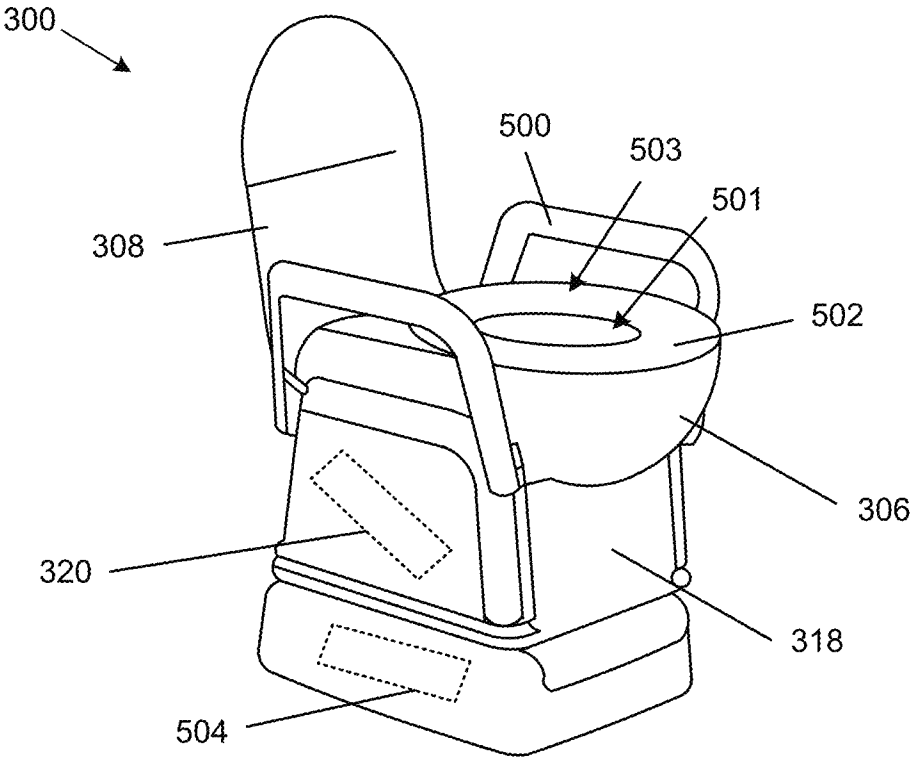
FIG. 5 shows a schematic example of the autonomous toilet of FIG. 3, consistent with embodiments of the present disclosure.

As shown in FIG. 5, the autonomous toilet 300 may include handles 500 (e.g., retractable handles). The handles 500 can be configured to transition between an extended position and a storage position. In some instances, the handles 500 may be configured to automatically extend in response to the autonomous toilet 300 reaching a location proximate a user (e.g., a location within 1 meter, 2 meters, or 3 meters of the user), which may be generally referred to as a user location. The handles 500 may be configured to retract when (or before) returning to the docking station 302. In some instances, the handles 500 may be biased towards the extended position (e.g., using one or more springs). The biasing force exerted on the handles 500 may be configured to offset at least a portion of a weight of the user. Such a configuration may provide assistance to the user in standing up from the autonomous toilet 300 (e.g., by urging the user towards a standing position) and/or in sitting on the autonomous toilet 300 (e.g., by slowing the user's descent onto the autonomous toilet 300).

As also shown, when the lid 308 is in an open position, the lid 308 may form a back rest for a user. As such, in some instances the lid 308 may be configured to automatically transition to the open position in response to the autonomous toilet 300 reaching the user location and may be configured to transition to the closed position before (e.g., when the user completes use of the autonomous toilet 300) and/or when returning to the docking station 302.

As also shown, the autonomous toilet 300 includes a seat 502 on which the user may sit. The seat 502 extends at least partially around a receptacle opening 501 of the waste receptacle 306 and is configured to support a user over the receptacle opening 501. The seat 502 defines an open region 503 through which waste may pass. The open region 503 may have a size that generally corresponds to the size of the receptacle opening 501. In some instances, the seat 502 may include one or more biasing mechanisms (e.g., one or more springs) configured to assist a user when sitting on and/or standing up from the seat 502. For example, the seat 502 may be biased such that the seat 502 assists in urging the user to a standing position when the user attempts to stand up from the seat 502. By way of further example, the seat 502 may be configured to slow a descent of the user into a seated position.

The seat 502 may include one or more sensors configured to detect a presence of the user on the seat 502. In some instances, the one or more sensors may be configured to cause, for example, water to be transferred from the fluid reservoir 320 to the waste receptacle 306. In this example, water may be transferred to the waste receptacle 306 in response to the user sitting on the seat 502 and/or in response to the user getting off the seat 502. Additionally, or alternatively, the weight of the user on the seat 502 may actuate a manual pump (or a sensor, wherein an output of the sensor causes a pump to be actuated) that causes water, a sanitizing solution, deodorizer, and/or any other substance to be transferred into the waste receptacle 306. For example, a substance may be caused to be transferred to the waste receptacle 306 in response to the user sitting on the seat 502 to increase the lubricity of the sidewalls defining the waste receptacle 306. In some instances, when the user gets off the seat 502, waste within the waste receptacle 306 may be caused to be transferred to the secondary storage receptacle 318. For example, a spring loaded actuator may cause a valve selectively fluidly coupling the waste receptacle 306 to the secondary storage receptacle 318 to be actuated for a predetermined period of time, allowing the waste to be transferred from the waste receptacle 306 to the secondary storage receptacle 318.

In some instances, the autonomous toilet 300 may include one or more selectively deployable stabilizers 504 configured to transition between a deployed position and a storage position. For example, the stabilizers 504 may be configured to transition to the deployed position in response to the autonomous toilet 300 reaching the user location. As such, the autonomous toilet 300 may be more stable (e.g., less likely to tip over) as the user positions themselves on the seat 502. Prior to returning to the docking station 302, the stabilizers 504 may transition from the deployed position back to the storage position. By way of further example, the stabilizers 504 may be configured to deploy in response to the user sitting on the seat 502. In this example, the weight of the user on the seat 502 may cause the stabilizers 504 to transition to a deployed position. In response to the user getting off the seat 502 the stabilizers 504 may transition from the deployed position back to a storage position.

In some instances, the autonomous toilet 300 may be configured to indicate when the autonomous toilet 300 is ready for use. For example, when the stabilizers 504 transition to the deployed position in response to the autonomous toilet 300 reaching the user location, an indicator (e.g., a light source such as one or more light emitting diodes) may transition from a first color (e.g., red) to a second color (e.g., green).

Figure 6:
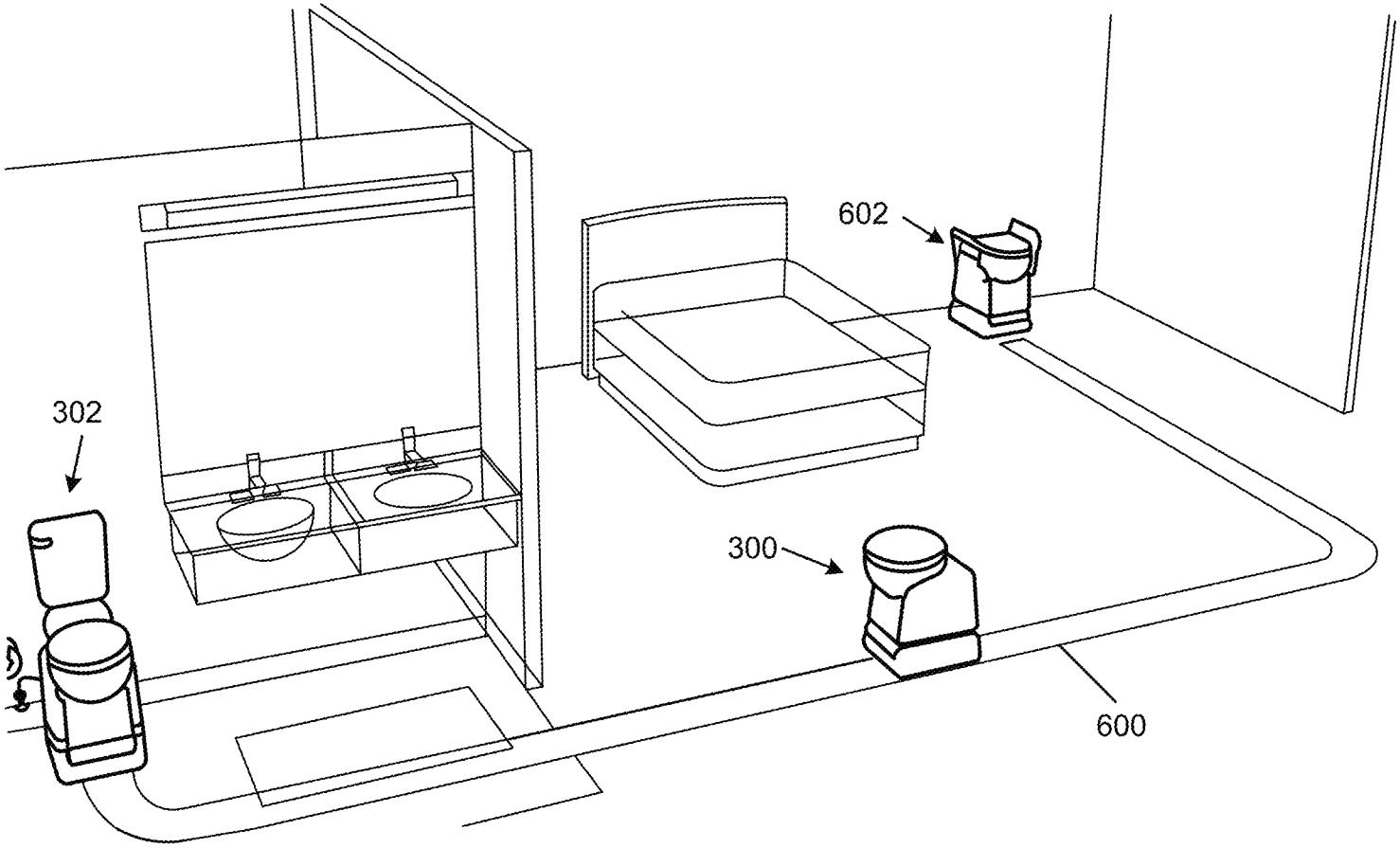
FIG. 6 shows a schematic example of the autonomous toilet of FIG. 3 traversing a surrounding environment, consistent with embodiments of the present disclosure.

FIG. 6 shows an example of the autonomous toilet 300 traversing the surrounding environment. The autonomous toilet 300 is shown in multiple locations for purposes of clarity.

As shown, the autonomous toilet 300 can be caused to travel along a travel path 600 that extends between the docking station 302 and a user location 602. The user location 602 may generally be referred to as a location proximate to the user (e.g., a location within 1 meter, 2 meters, or 3 meters of the user). In some instances, a charging dock may be positioned at the user location 602 that is configured to charge one or more batteries of the autonomous toilet 300. In this instance, the docking station 302 may not be configured to charge one or more batteries of the autonomous toilet (potentially mitigating risks associated with charging adjacent a water source). When the docking station 302 does not charge the autonomous toilet 300, the autonomous toilet 300 may be configured to supply power to the docking station 302 to operate one or more features of the docking station 302.

The travel path 600 can be generated prior to the autonomous toilet 300 disengaging the docking station 302. For example, the travel path 600 may generated based, at least in part, on a map of the surrounding environment. The map of the surrounding environment may include obstacle locations such that, when the travel path 600 is generated, the travel path 600 extends around known obstacles. This may mitigate the risk that the autonomous toilet 300 encounters an obstacle when traveling to the user location 602. In some instances, the map can be updated to reflect new obstacles or changes in obstacle locations each time the autonomous toilet 300 traverses the surrounding environment.

The user location 602 may be a predetermined location or may be determined prior to the autonomous toilet 300 disengaging the docking station 302. For example, when not predetermined, the autonomous toilet 300 may be configured to estimate the user location 602. Estimation of the user location 602 may include, for example, measuring a signal strength of a remote device in the possession of the user. Additionally, or alternatively, when summoning the autonomous toilet 300 the summon request may include the user's location. For example, each room may have a corresponding digital assistant device for receiving voice commands from the user and the user's location may be determined based, at least in part, on which of the digital assistants made the summon request. By way of further example, each room of the user's residence may have a predetermined user location associated therewith and, in order to transmit the summon request, the user may be required indicate which room the autonomous toilet 300 is to travel to. In this example, when the autonomous toilet 300 reaches the identified room, the autonomous toilet 300 may travel to the predetermined user location associated with the room.

If, when the autonomous toilet 300 arrives at the user location 602, the autonomous toilet 300 is too far from the user, the user may manually adjust the location of the autonomous toilet 300 using, for example, a remote device such as a smartphone or remote control. When the user is finished adjusting the location of the autonomous toilet 300, the autonomous toilet may update the user location 602 to the adjusted location.

Some environments may include stairs. In these instances, the travel path 600 may be configured to avoid stairs if the autonomous toilet 300 is not configured to ascend and descend stairs. If the autonomous toilet 300 is configured to ascend and descend stairs the travel path 600 may include traversal of stairs. An autonomous toilet 300 capable of traversing stairs may include features configured to mitigate the risk of waste spillage. For example, one or more of the waste receptacle 306 and/or the secondary storage receptacle 318 may be configured to be self-leveling (e.g., through the use a gyroscope).

In some instances, one or more of the autonomous toilet 300 and/or the docking station 302 may be configured to analyze received waste (e.g., urine and/or feces). For example, output volume may be measured, glomerular filtration rate (GFR) for alpha-ketoglutarate (AKG) may be measured, an analysis for the detection of proteins, white blood cells, and the like may be conducted, and/or any other analysis. The results of any analysis may be automatically uploaded to an electronic health chart system, wherein data analytics may be performed to identify trends and/or predict health outcomes. Additionally, or alternatively, the autonomous toilet 300 may be able to deposit at least a portion of the waste into a sample holder (e.g., a test tube) for collection by a user. The sample holder may then be sent to a lab for analysis. In some instances, the autonomous toilet 300 may include identifying information (e.g., in the form of a barcode) on the sample holder.

While the travel path 600 is described as being generated by the autonomous toilet 300, other configurations are possible. For example, the travel path 600 may be physically identified within the environment (e.g., as a line on a floor or ceiling) such that the autonomous toilet 300 can use one or more sensors to follow the travel path 600.

Figure 8:
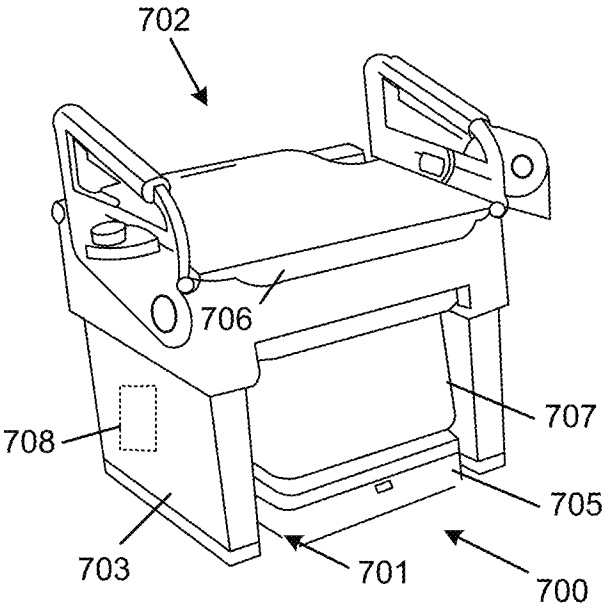
FIG. 8 shows an example of the autonomous waste receptacle of FIG. 7 engaging the free standing seat of FIG. 7, consistent with embodiments of the present disclosure.
Figure 7:
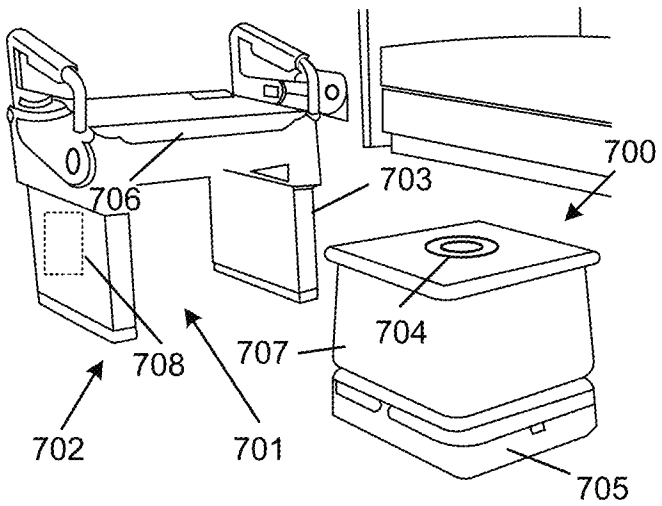
FIG. 7 shows an example of an autonomous waste receptacle configured to engage a freestanding seat, consistent with embodiments of the present disclosure.

FIG. 7 shows an example of an autonomous waste receptacle 700 configured to engage a freestanding seat 702. FIG. 8 shows an example of the autonomous waste receptacle 700 engaging the freestanding seat 702. The autonomous waste receptacle 700 may be an example of the autonomous waste receptacle 100 of FIG. 1.

The autonomous waste receptacle 700 includes a driving portion 705 and a waste receptacle portion 707 coupled (e.g., removably coupled) to the driving portion 705. The waste receptacle portion 707 may be reusable and/or disposable. The waste receptacle portion 707 is configured to receive waste and the driving portion 705 is configured to autonomously navigate the surrounding environment (e.g., with or without the waste receptacle portion 707 coupled thereto). The waste receptacle portion 707 and the seat 702 cooperate to form a freestanding toilet at a predetermined location. In some instances, the driving portion 705 may be configured to transport multiple receptacle portions 707 such that a single driving portion 705 can service multiple seats 702.

As shown, the autonomous waste receptacle 700 is configured to be received within a receiving space 701 defined between two opposing legs 703 of the seat 702. The waste receptacle portion 707 may include a flange 704 configured to interface with the seat 702 when the autonomous waste receptacle 700 is received within the receiving space 701.

The seat 702 may include a lid 706 configured to transition between an open position and a closed position, wherein, when in the open position, waste may pass through an opening in the seat 702 and into the waste receptacle portion 707. In some instances, the flange 704 may include a valve (e.g., an iris valve) that is transitioned to an open position in response to transitioning the lid 706 to the open position and that is transitioned to a closed position in response to transitioning the lid 706 to the closed position. Such a configuration may mitigate a risk of waste escaping from the waste receptacle portion 707 (e.g., during transit to a docking station for disposal). Such a configuration may also mitigate the spread of odors within the surrounding environment, allowing the waste receptacle portion 707 to be used for an extended period of time before emptying (e.g., days or weeks).

In some instances, the autonomous waste receptacle 700 and/or the seat 702 may include a sanitization or disinfection device configured to at least partially sanitize or disinfect one or more of the autonomous waste receptacle 700 and/or seat 702. For example, at least one of the autonomous waste receptacle 700 and/or the seat 702 may include a light source configured to generate ultraviolet-c light. In this example, the ultraviolet-c light may be used to at least sanitize or disinfect the portion of the seat 702 on which the user sits and/or the portions of the autonomous waste receptacle 700 that come in contact with the waste (e.g., the flange 704).

The seat 702 is able to be moved by a user to a desired location. For example, the user may move the seat to a location proximate to a bed at night and a chair during the day. As such, the seat 702 may include a homing beacon 708. The homing beacon 708 may generate one or more signals (e.g., radio frequency signals, optical signals, magnetic signals, and/or any other type of signal) for guiding the driving portion 705 of the autonomous waste receptacle 700 to the seat 702. Additionally, or alternatively, the driving portion 705 of the autonomous waste receptacle 700 may include one or more sensors capable of identifying the seat 702. For example, the driving portion 705 may include one or more cameras to capture one or more images of the surrounding environment and use object recognition to identify the seat 702 within the captured one or more images. In some instances, the seat 702 may be configured to charge one or more batteries of the autonomous waste receptacle 700.

Figure 9:
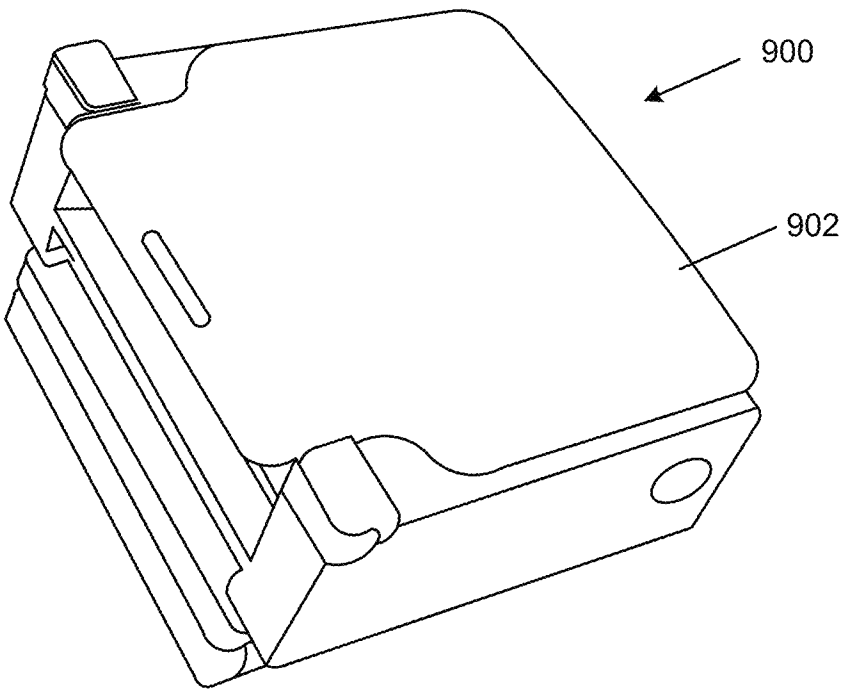
FIG. 9 shows another example of a seat configured to cooperate with the autonomous waste receptacle of FIG. 7, consistent with embodiments of the present disclosure.

FIG. 9 shows another example of a seat 900 configured to cooperate with the autonomous waste receptacle 700 to form a toilet. The seat 900 is configured to be coupled to a wall of a room or to a piece of furniture (e.g., a bed). For example, the seat 900 can be pivotally coupled to a bed (e.g., a bed rail) such that the user can pivot the seat 900 to a use position when needed and can use the seat 900 without having to move a substantial distance from the bed. In this example, the seat 900 may include one or more retractable handles, wherein at least one retractable handle may extend to a use position in response to a user sitting on the seat 900 and/or in response to pivoting the seat 900 to the use position. In some instances, pivoting of the seat 900 to a use position may cause at least a portion of an adjacent bed rail to retract such that user can more easily position themselves on the seat 900.

The seat 900 may include a lid 902 configured to transition between an open and closed position, wherein when in the open position, the lid 902 may function as a back rest for the user. In some instances, pivoting of the lid 902 may cause one or more retractable handles to extend and/or at least a portion of one or more bed rails to retract.

Figure 10:
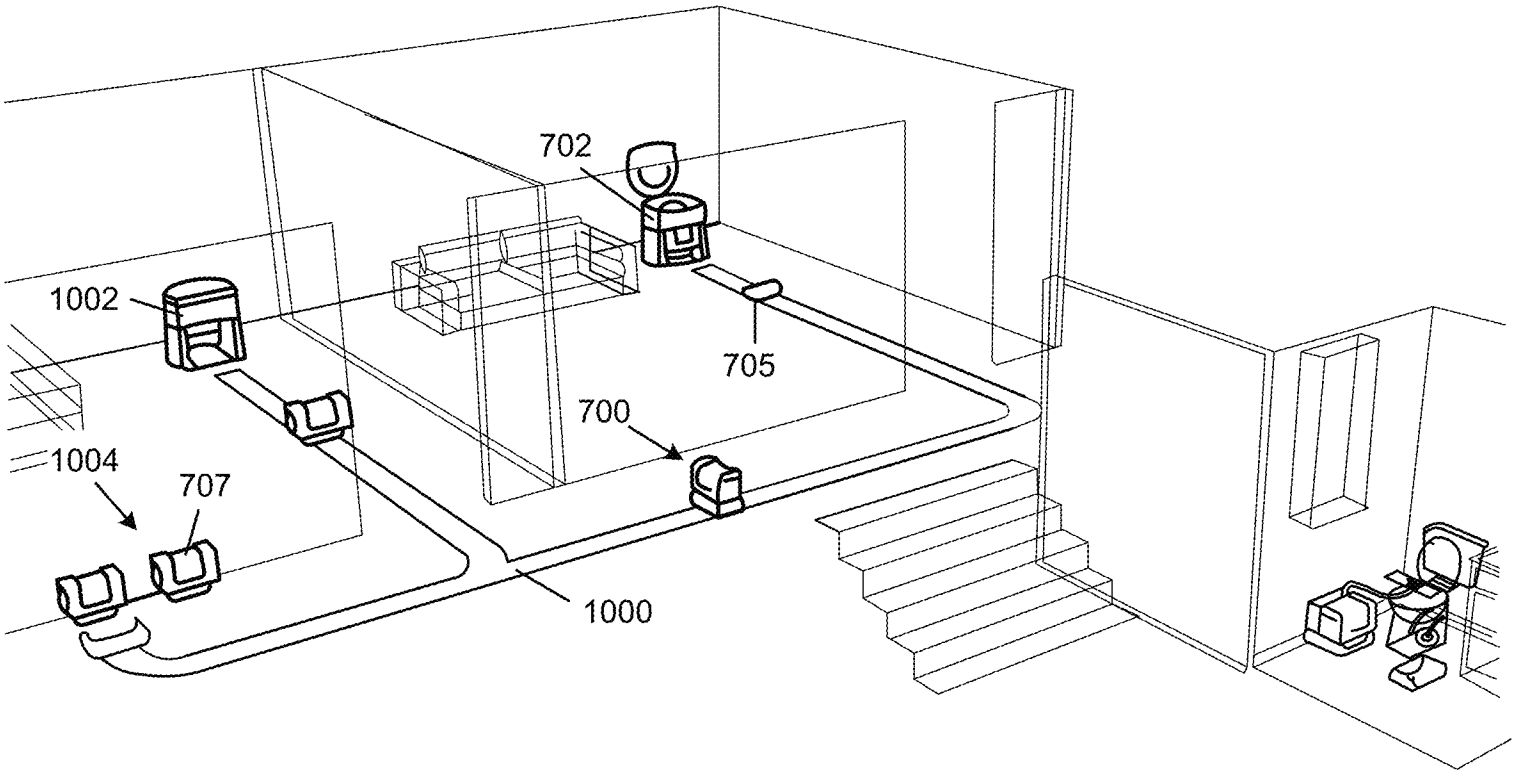
FIG. 10 shows a schematic example of the autonomous waste receptacle of FIG. 7 traversing a surrounding environment, consistent with embodiments of the present disclosure.

FIG. 10 shows an example of the driving portion 705 of the autonomous waste receptacle 700 traversing the surrounding environment. The driving portion 705 is shown in multiple locations (with and without the waste receptacle portion 707) for purposes of clarity.

Figure 49:
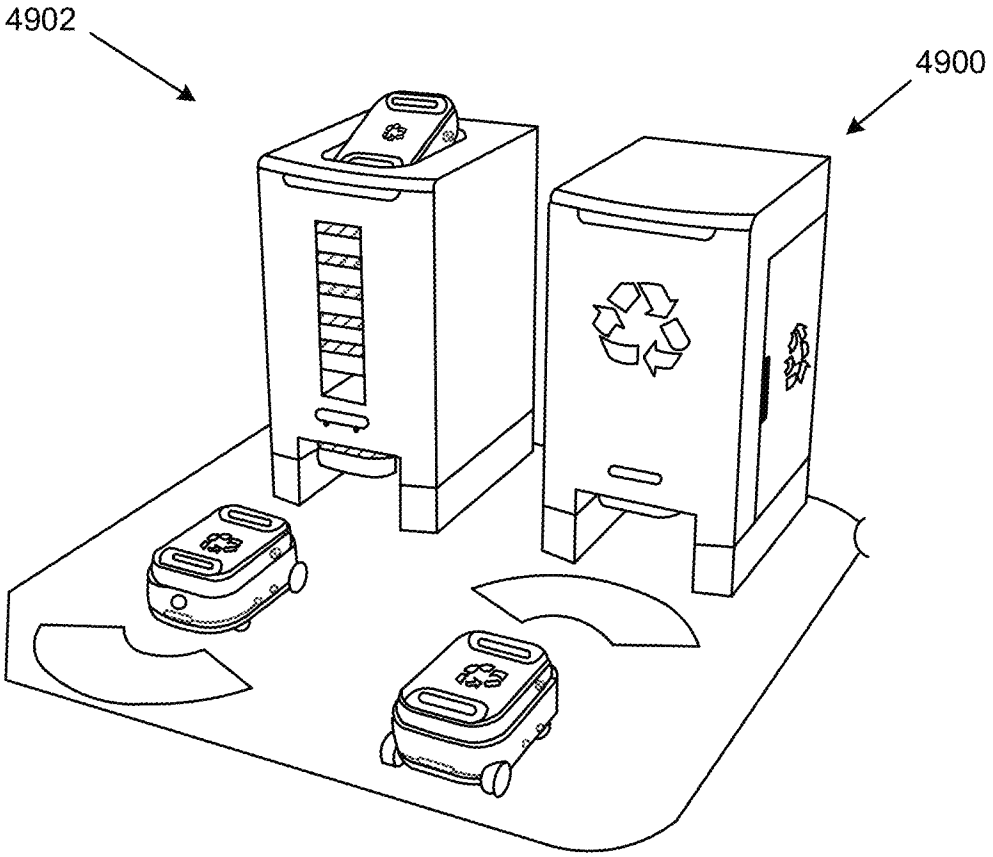
FIG. 49 shows an example of a waste receptacle collector for receiving used waste receptacle portions and a waste receptacle storage device for storing unused waste receptacle portions, consistent with embodiments of the present disclosure.

As shown, the driving portion 705 can be caused to travel along a travel path 1000 that extends at least from a docking station 1002 to the seat 702. In some instances, the travel path 1000 may also extend to a waste receptacle portion storage location 1004. The waste receptacle portion storage location 1004 may include unused waste receptacle portions 707. For example, as shown in FIG. 49, a waste receptacle collector 4900 for receiving used waste receptacle portions 707 and a waste receptacle storage device 4902 for storing unused waste receptacle portions 707 may be disposed at the waste receptacle portion storage location 1004. In some instances, the waste receptacle portion 707 may include an identifying feature (e.g., a bar code) that associates the waste within the waste receptacle storage portion 707 with a specific user. In these instances, the waste receptacle storage device 4902 may be configured to detect the identifying feature, analyze the waste within the waste receptacle portion 707, and associate the resulting data with a specific user based, at least in part, on the identifying feature. The associated data may be added to a medical record corresponding to the specific user.

In operation, the driving portion 705 can travel from the docking station 1002, to the waste receptacle portion storage location 1004, couple to a waste receptacle portion 707, and transport the waste receptacle portion 707 to the seat 702. The waste receptacle portion 707 can be removably coupled to the seat 702 such that the driving portion 705 can decouple from the waste receptacle portion 707, allowing the driving portion 705 to service another seat 702 (e.g., by collecting a full waste receptacle portion 707 from another seat 702 or transporting another empty waste receptacle portion 707 to another seat 702). In some instances, the seat 702 may be configured to store a quantity of waste equivalent to a single use. The seat 702 may be configured to issue a summon request to the driving portion 705, wherein the driving portion 705 brings a waste receptacle portion 707 to the seat 702 for purposes of collecting the waste. After the waste is collected, the driving portion 705 may remove the waste receptacle portion 707 from the seat 702 for emptying.

The docking station 1002 can be configured to recharge the driving portion 705 and to removably couple to a used waste receptacle portion 707. In some instances, the docking station 1002 may be configured to empty the used waste receptacle portion 707. In other instances, the docking station 1002 may be configured to store a used waste receptacle portion 707 such that the waste receptacle portion 707 can be manually emptied.

Figure 11:
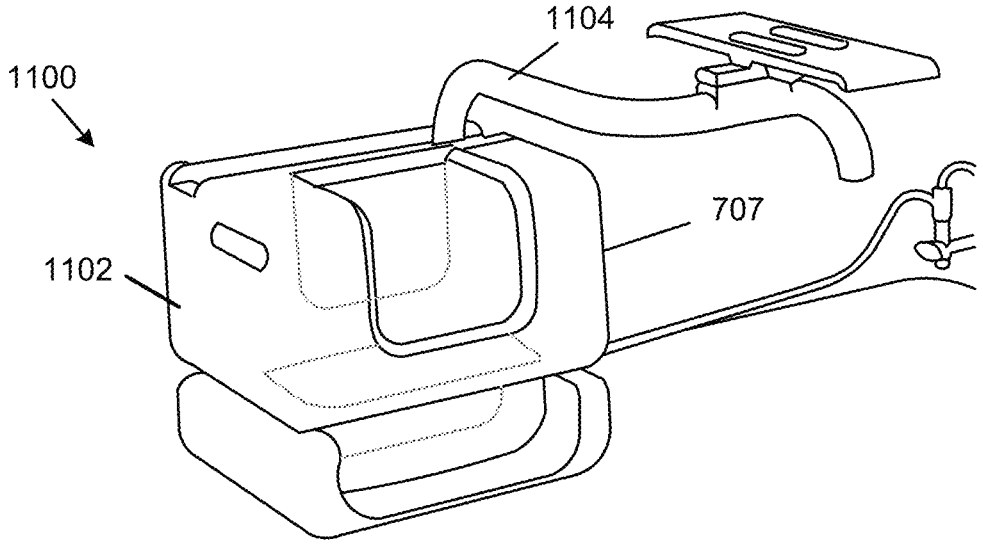
FIG. 11 shows a schematic example of a docking station for emptying a receptacle portion of the autonomous waste receptacle of FIG. 7, consistent with embodiments of the present disclosure.

FIG. 11 shows an example of a docking station 1100 configured to empty the waste receptacle portion 707, which may be an example of the docking station 1002. As shown, the docking station 1100 may include a waste transfer reservoir 1102 configured to fluidly couple to the waste receptacle portion 707. The waste transfer reservoir 1102 is configured to receive waste from the waste receptacle portion 707. In some instances, the waste transfer reservoir 1102 may be configured to temporarily store waste received from the waste receptacle portion 707. For example, the waste transfer reservoir 1102 may be configured to carry out one or more operations on the waste therein. The operations may include a grinding operation that is configured to grind the waste into a slurry capable of being carried through a pump. In some instances, a fluid (e.g., water) may be added during the grinding operation to decrease the viscosity of the slurry.

The waste within the waste transfer reservoir 1102 may be transferred to a fixed toilet using a waste transfer tube 1104. A position of the waste transfer tube 1104 may be adjustable by the docking station 1100. For example, the waste transfer tube 1104 may be configured to transition between a retracted position and an extended position. When in the extended position, the waste transfer tube 1104 may be positioned over a toilet bowl of a fixed toilet. In some instances, when in the extended position, a rotational orientation of the waste transfer tube 1104 may need to be adjusted such that the waste transfer tube 1104 is positioned over the toilet bowl.

When the waste transfer tube 1104 is in the extend position, waste can be urged through the waste transfer tube 1104. For example, the docking station 1100 may include a pump configured to urge waste through the waste transfer tube 1104. By way of further example, the waste transfer tube 1104 may be coupled to an outlet located proximate the bottom of the waste transfer reservoir 1102 and the docking station 1100 may be configured to be raised above the toilet such that gravity urges the waste through the waste transfer tube 1104. In some instances, the entire docking station 1100 may be positioned over the toilet, such that an outlet at the bottom of the waste transfer reservoir 1102 is positioned over the toilet (in these instances, the waste transfer tube 1104 may be omitted).

In some instances, the docking station 1100 can be fluidly coupled to a water source such that water can be delivered to the waste transfer reservoir 1102. The water may be used to clean the waste transfer reservoir 1102 and/or to assist in urging waste to pass through the waste transfer tube.

In some instances, the docking station 1100 may be configured to open a lid of the toilet such that waste can be transferred to the toilet. For example, the docking station 1100 may include an arm configured to urge the lid of the toilet from a closed position to an open position. In this example, the arm may further be configured to transition the lid of the toilet from the open position to the closed position after the waste has transferred to the toilet. In some instances, the docking station 1100 may be further configured to flush the toilet. For example, the toilet may be communicatively coupled to the docking station 1100 (e.g., via a wireless connection such as Bluetooth), wherein the docking station 1100 may be configured to transmit a signal to the toilet causing the toilet to flush. By way of further example, the docking station 1100 may manually flush the toilet (e.g., using the arm).

The waste transfer reservoir 1102 may include a secondary waste inlet configured to allow waste within the waste receptacle portion 707 (or other waste receptacle) to be manually emptied into the waste transfer reservoir 1102.

Figure 12:
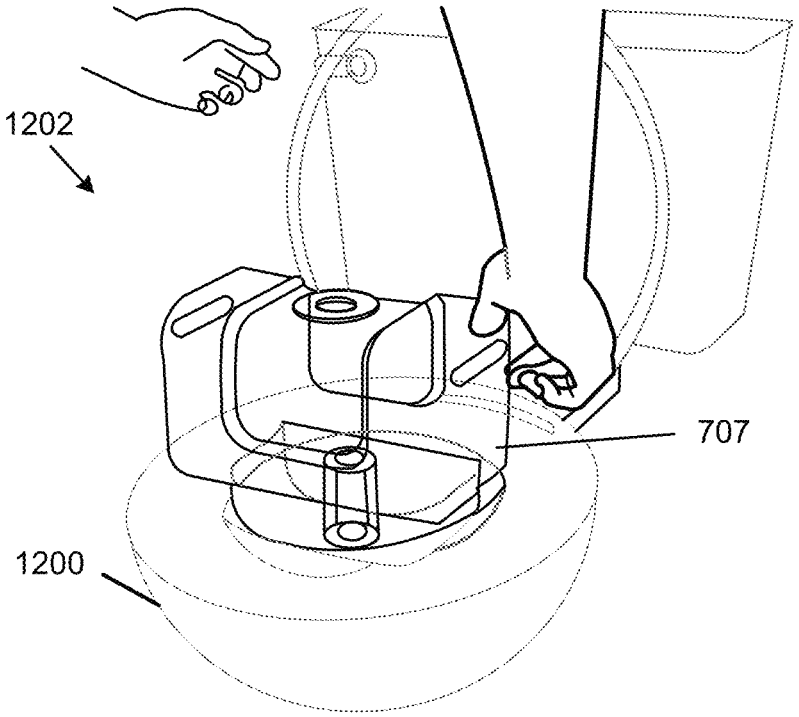
FIG. 12 shows a schematic example of a receptacle portion of the autonomous waste receptacle of FIG. 7 being manually emptied into a fixed toilet, consistent with embodiments of the present disclosure.

FIG. 12 shows an example of the waste receptacle portion 707 being manually emptied into a toiled bowl 1200 of a fixed toilet 1202.

Figure 47:
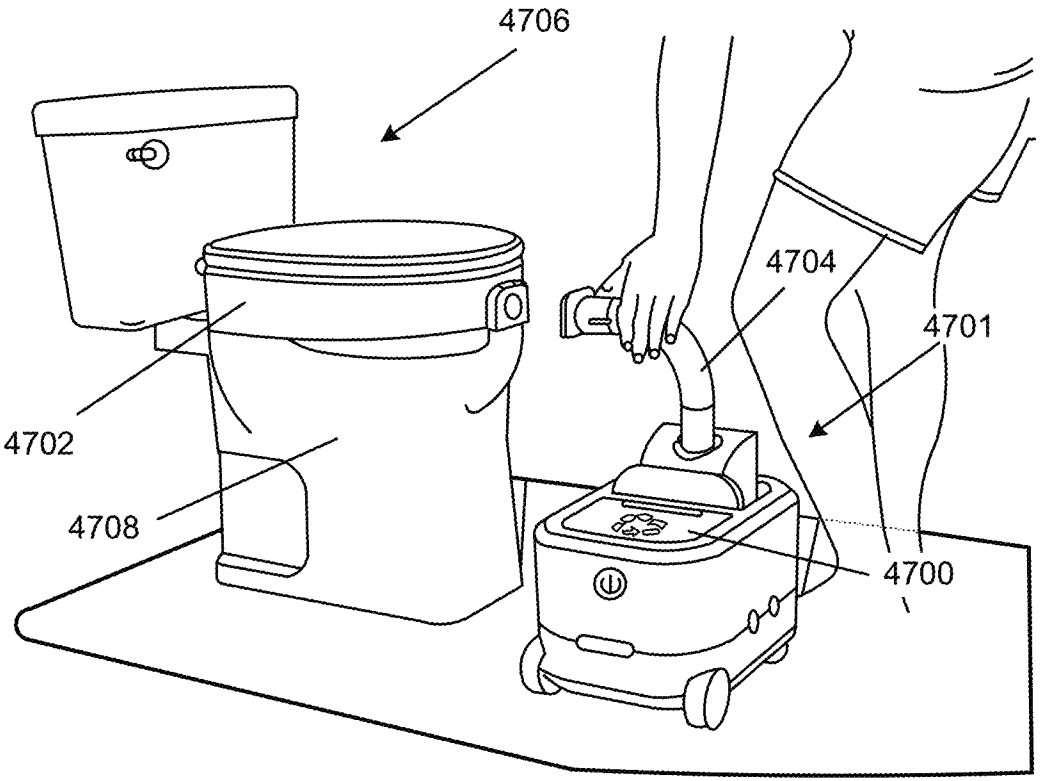
FIG. 47 shows an example of a waste receptacle portion of an autonomous waste receptacle being emptied, consistent with embodiments of the present disclosure.

FIG. 47 shows an example of a waste receptacle portion 4700 of an autonomous waste receptacle 4701, which may be an example of the waste receptacle portion 707, being emptied. As shown, the waste receptacle portion 4700 is configured to fluidly couple to an adapter 4702 via a hose 4704. The adapter 4702 is fluidly coupled to a fixed toilet 4706. For example, and as shown, the adapter 4702 may couple to a bowl 4708 of the fixed toilet 4706. In some instances, the adapter 4702 may form a seat of the fixed toilet 4706.

Figure 48:
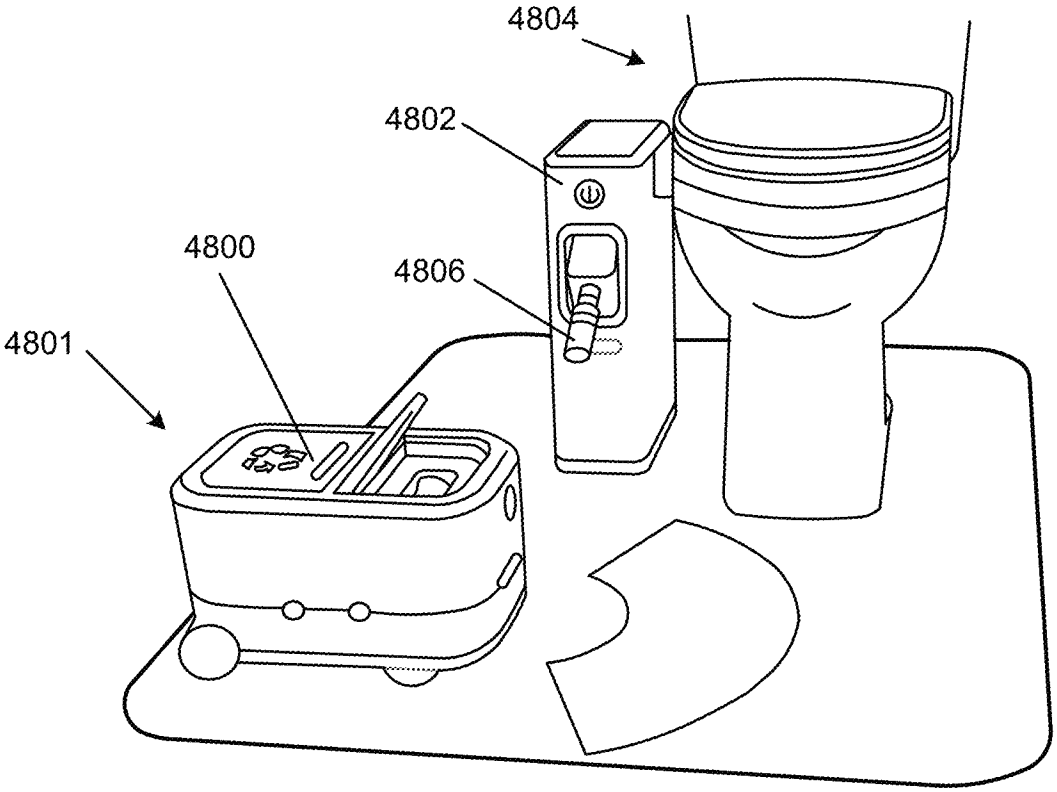
FIG. 48 shows an example of a waste receptacle portion of an autonomous waste receptacle preparing to be emptied, consistent with embodiments of the present disclosure.

FIG. 48 shows an example of a waste receptacle portion 4800 of an autonomous waste receptacle 4801, which may be an example of the waste receptacle portion 707, preparing to be emptied. As shown, the waste receptacle portion 4800 is configured to cooperate with an intermediate system 4802 that is fluidly coupled to a fixed toilet 4804. The waste receptacle portion 4800 may be configured to be emptied manually by a user and/or automatically in response to the waste receptacle portion 4800 fluidly coupling with the intermediate system 4802. In some instances, for example, the intermediate system 4802 may include an extendable tube 4806 configured to fluidly couple to the waste receptacle portion 4800. The extendable tube 4806 may be configured to be automatically and/or manually fluidly coupled to the waste receptacle portion 4800.

Figure 13:
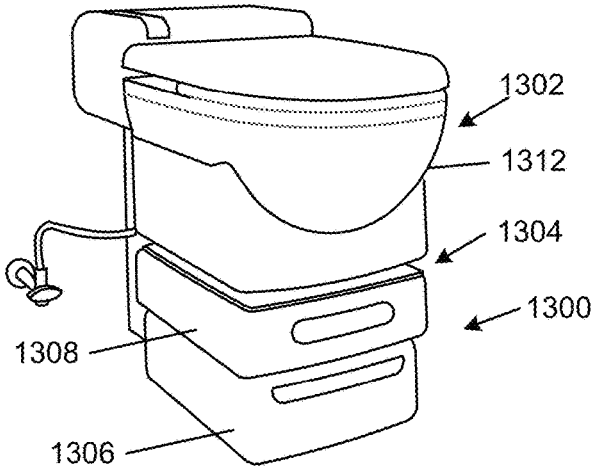
FIG. 13 shows a schematic example of an autonomous waste receptacle engaging a fixed toilet, consistent with embodiments of the present disclosure.
Figure 14:
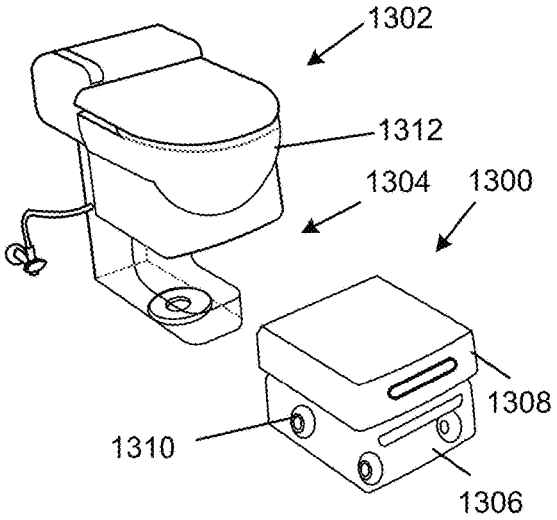
FIG. 14 shows a schematic example the autonomous waste receptacle of FIG. 13 separated from the fixed toilet of FIG. 13, consistent with embodiments of the present disclosure.

FIGS. 13 and 14 show an example of an autonomous waste receptacle 1300 and a fixed toilet 1302. The autonomous waste receptacle 700 may be an example of the autonomous waste receptacle 100 of FIG. 1. The fixed toilet 1302 may include a docking region 1304. As such, the fixed toilet 1302 may generally be described as a docking station for the autonomous waste receptacle 1300.

The autonomous waste receptacle 1300 includes a driving portion 1306 and a receptacle portion 1308 coupled (e.g., removably coupled) to the driving portion 1306. The receptacle portion 1308 is configured to receive waste and the driving portion 1306 is configured to autonomously navigate the surrounding environment (e.g., with or without the receptacle portion 1308 coupled thereto). The driving portion 1306 includes a plurality of driven wheels 1310 and is configured to navigate about the surrounding environment.

When the autonomous waste receptacle 1300 is received within the docking region 1304 of the fixed toilet 1302, the receptacle portion 1308 may fluidly couple to the fixed toilet 1302 such that the receptacle portion 1308 may be emptied. For example, when the fixed toilet 1302 is flushed, water from a bowl 1312 of the fixed toilet 1302 may pass through the receptacle portion 1308, emptying the waste from the receptacle portion 1308. In this example, the receptacle portion 1308 may be in the form of a bedpan and may be emptied after each use.

Figure 15:
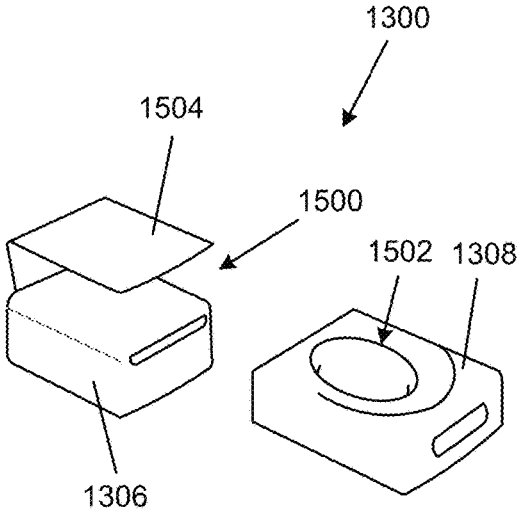
FIG. 15 shows a schematic example of the autonomous waste receptacle of FIG. 13 having a receptacle portion removed therefrom, consistent with embodiments of the present disclosure.

As shown in FIG. 15 the driving portion 1306 includes a receptacle holder 1500 configured to receive and retain the receptacle portion 1308. The receptacle portion 1308 defines a receptacle opening 1502 for receiving waste. When the receptacle portion 1308 is received within the receptacle holder 1500, the receptacle opening 1502 may be enclosed by a top plate 1504 of the receptacle holder 1500.

Figure 16:
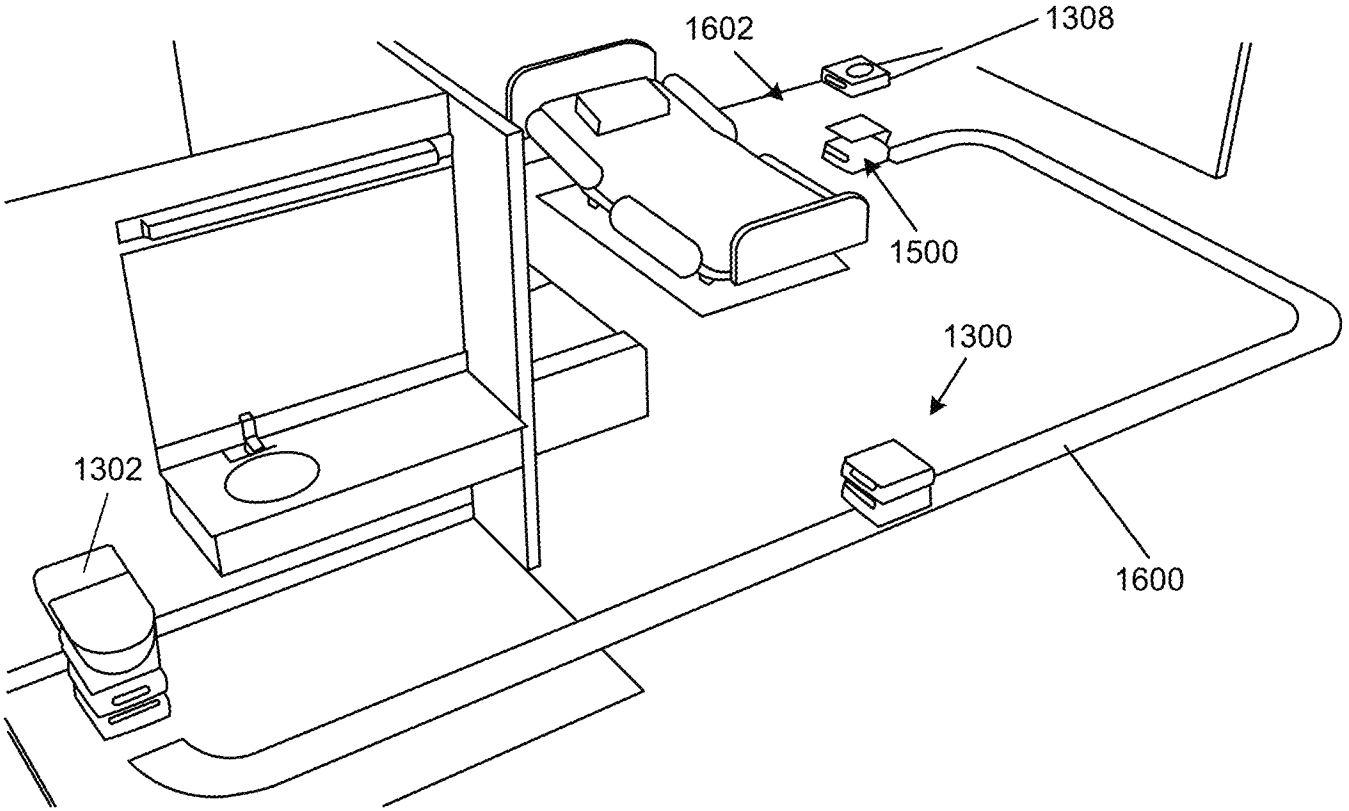
FIG. 16 shows a schematic example of the autonomous waste receptacle of FIG. 13 traversing a surrounding environment, consistent with embodiments of the present disclosure.

FIG. 16 shows an example of the autonomous waste receptacle 1300 traversing the surrounding environment. The autonomous waste receptacle 1300 is shown in multiple locations for purposes of clarity.

As shown, the autonomous waste receptacle 1300 can be caused to travel along a travel path 1600 that extends from the fixed toilet 1302 to a user location 1602. When summoned by a user, the autonomous waste receptacle 1300 may travel along the travel path 1600 from the fixed toilet 1302 to the user location 1602. Once at the user location 1602, a user may extract the receptacle portion 1308 from the receptacle holder 1500 for use. Upon replacement of the receptacle portion 1308 in the receptacle holder 1500, the autonomous waste receptacle 1300 may be caused to travel along the travel path 1600 from the user location 1602 to the fixed toilet 1302. When the autonomous waste receptacle 1300 reaches the fixed toilet 1302, the receptacle portion 1308 may be caused to be emptied.

Figure 18:
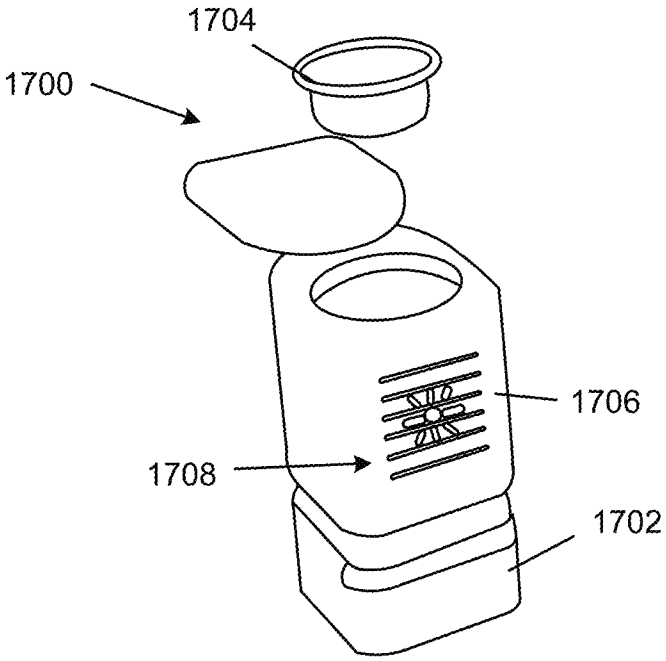
FIG. 18 shows another schematic example of the autonomous waste receptacle of FIG. 17, consistent with embodiments of the present disclosure.
Figure 17:
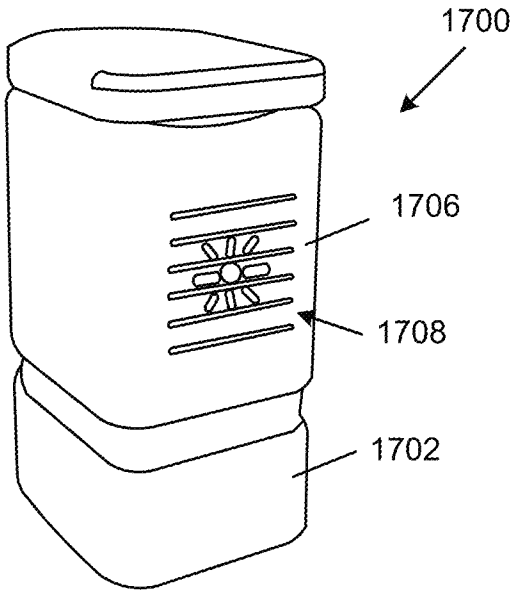
FIG. 17 shows a schematic example of an autonomous waste receptacle, consistent with embodiments of the present disclosure.

FIGS. 17 and 18 show an example of an autonomous waste receptacle 1700, which may be an example of the autonomous waste receptacle 100 of FIG. 1. The autonomous waste receptacle 1700 can include a driving portion 1702, a supply portion 1704, and a receptacle portion 1706. In some instances, the autonomous waste receptacle 1700 may include a filtered exhaust 1708 configured to filter the air in the surrounding area in order mitigate the presence of odors resulting from use of the autonomous waste receptacle 1700. The supply portion 1704 is configured to include supplies (e.g., personal hygiene products, medication, or any other type of supply) and can be at least partially received within the receptacle portion 1706. Additionally, or alternatively, the supply portion 1704 may be stored at any other location on the autonomous waste receptacle 1700. For example, the supply portion 1704 may be coupled to an outer surface of a sidewall of the autonomous waste receptacle 1700. The receptacle portion 1706 is configured to receive waste from a user (e.g., medical waste, bodily waste, or any other type of waste). In one example, the supply portion 1704 may include supplies useful to a user recovering from a chemotherapy treatment and the receptacle portion 1706 may be configured to accept waste relating to recovery from a chemotherapy treatment. In this example, the supply portion 1704 may include potable water to allow the user to rinse their mouth. The receptacle portion 1706 may include a disposable lining and/or a deodorizer.

Figure 20:
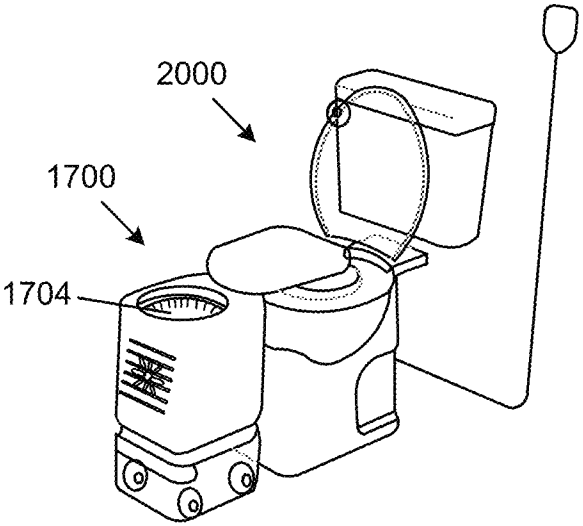
FIG. 20 shows a schematic example of the autonomous waste receptacle of FIG. 17 cooperating with a fixed toilet in order to empty a receptacle portion of the autonomous waste receptacle, consistent with embodiments of the present disclosure.
Figure 19:
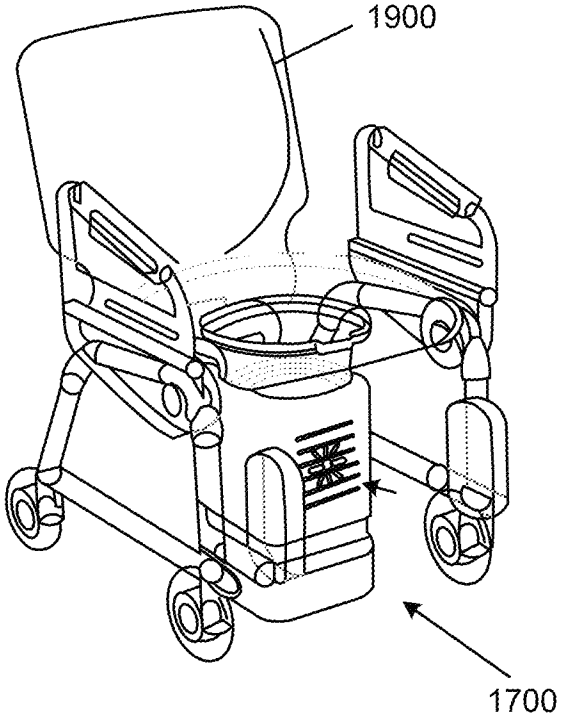
FIG. 19 shows a schematic example of the autonomous waste receptacle of FIG. 17 cooperating with a toilet chair, consistent with embodiments of the present disclosure.

FIG. 19 shows an example of the autonomous waste receptacle 1700 cooperating with a toilet chair 1900 capable of being used in a bathing setting. In this example, the autonomous waste receptacle 1700 may include water ingress protection. FIG. 20 shows an example of the autonomous waste receptacle 1700 cooperating with a fixed toilet 2000 in order to empty the receptacle portion 1706.

Figure 21:
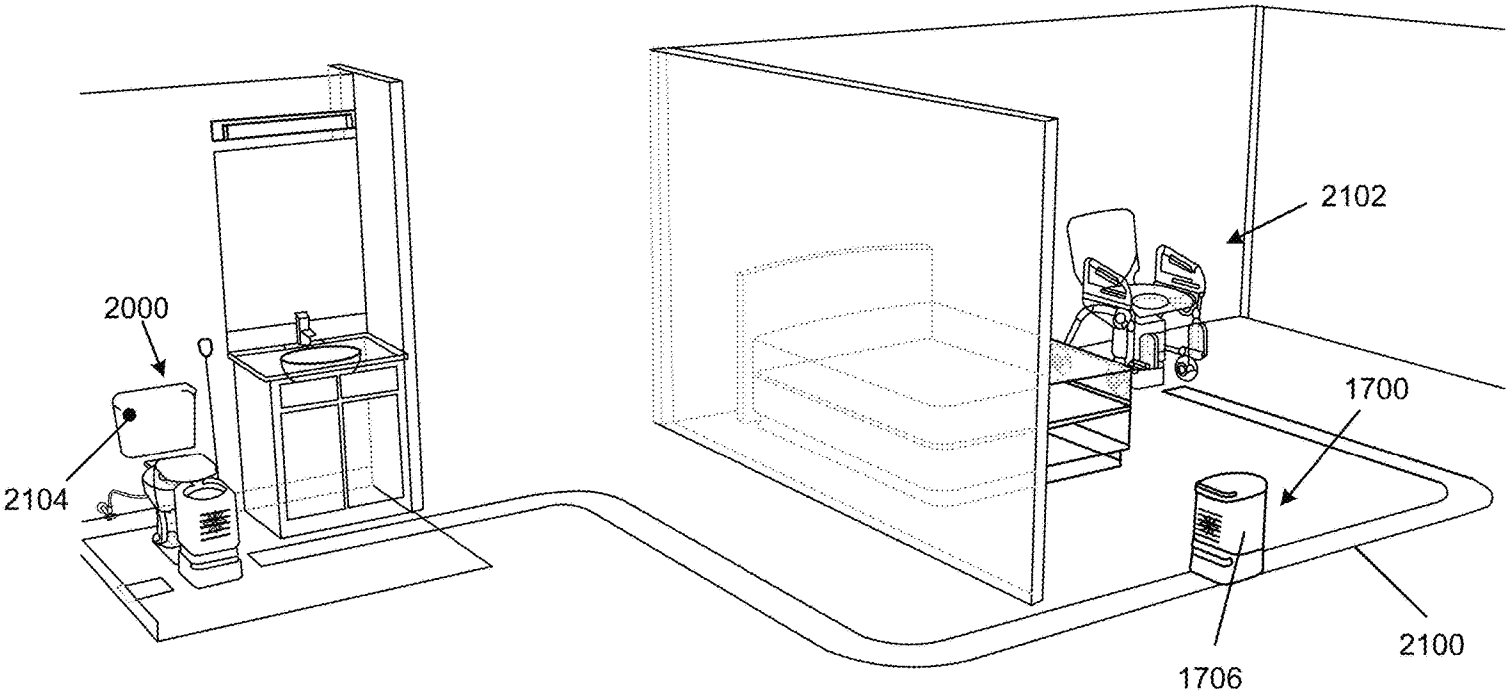
FIG. 21 shows a schematic example of the autonomous waste receptacle of FIG. 17 traversing a surrounding environment, consistent with embodiments of the present disclosure.

FIG. 21 shows an example of the autonomous waste receptacle 1700 traversing the surrounding environment. The autonomous waste receptacle 1700 is shown in multiple locations for purposes of clarity.

As shown, the autonomous waste receptacle 1700 can be caused to travel along a travel path 2100 that extends from the fixed toilet 2000 to a user location 2102. When summoned by a user, the autonomous waste receptacle 1700 may travel along the travel path 2100 from the fixed toilet 2000 to the user location 2102. Once at the user location 2102, a user may extract the supply portion 1704 from the receptacle portion 1706 for use. When the user has completed depositing waste in the receptacle portion 1706, the autonomous waste receptacle 1700 may be caused to travel along the travel path 2100 from the user location 2102 to the fixed toilet 2000. When the autonomous waste receptacle 1700 reaches the fixed toilet 2000, the receptacle portion 1706 may be caused to be emptied into the fixed toilet 2000.

Figure 22:
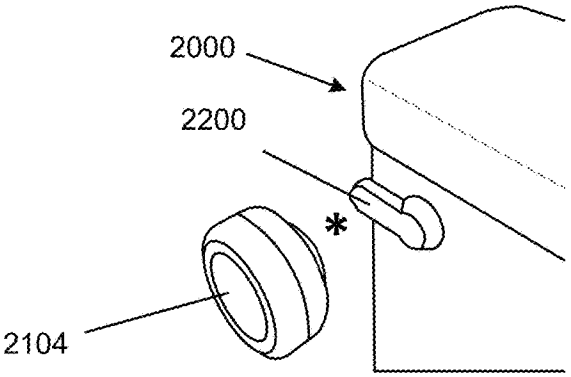
FIG. 22 shows a schematic example of a flusher configured to actuate a flush handle of a fixed toilet, consistent with embodiments of the present disclosure.

After the receptacle portion 1706 has been emptied into the fixed toilet 2000, the autonomous waste receptacle 1700 may be configured to cause the fixed toilet 2000 to flush the waste. For example, the autonomous waste receptacle 1700 may be communicatively coupled to a flusher 2104 (see, also, FIG. 22, showing a magnified example of the flusher 2104). The flusher 2104 is configured to actuate a flush handle 2200 (see, FIG. 22) of the fixed toilet 2000.

Figure 23:
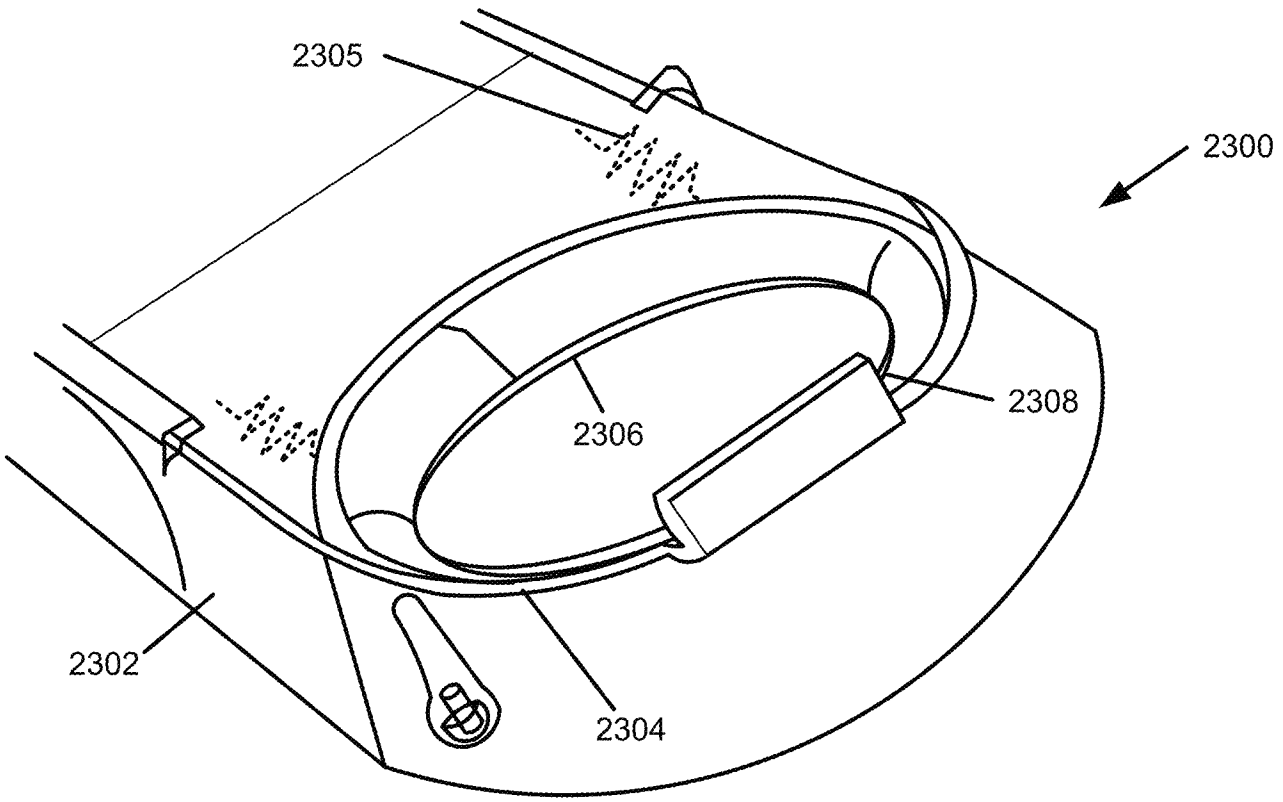
FIG. 23 shows a schematic example of a drain adapter, consistent with embodiments of the present disclosure.

FIG. 23 shows a schematic example of drain adapter 2300 configured to couple to a toilet drain 2306. The drain adapter 2300 may be an example of the waste coupling 314 of FIG. 3. The drain adapter 2300 may be configured to interface with an autonomous toilet (e.g., the autonomous toilet 300 of FIG. 3). For example, the drain adapter 2300 may be included in a docking station (e.g., the docking station 302 of FIG. 3).

As shown, the drain adapter 2300 may include an adapter body 2302 and cover 2304 moveably coupled to the adapter body 2302. The cover 2304 may be configured to transition between an open position in which the toilet drain 2306 is open (e.g., the toilet drain 2306 is capable of receiving waste) and a closed position in which the toilet drain 2306 is closed (e.g., the toilet drain 2306 is incapable of receiving waste). The toilet drain 2306 is fluidly coupled to a septic or sewer line. The cover 2304 may be biased towards the closed position using one or more biasing mechanisms 2305 (e.g., one or more springs). The cover 2304 may be configured to be urged towards the open position by the autonomous toilet. For example, the cover 2304 may include a protrusion 2308 configured to engage with a portion of the autonomous toilet when the autonomous toilet moves over the drain adapter 2300 such that the cover 2304 is moved towards the open position. The drain adapter 2300 may be configured to sealing engage with at least a portion of the autonomous toilet to mitigate the risk of waste being spilled. When the autonomous toilet moves away from the drain adapter 2300, the cover 2304 is urged to the closed position by the one or more biasing mechanisms 2305 (e.g., one or more springs).

Figure 41:
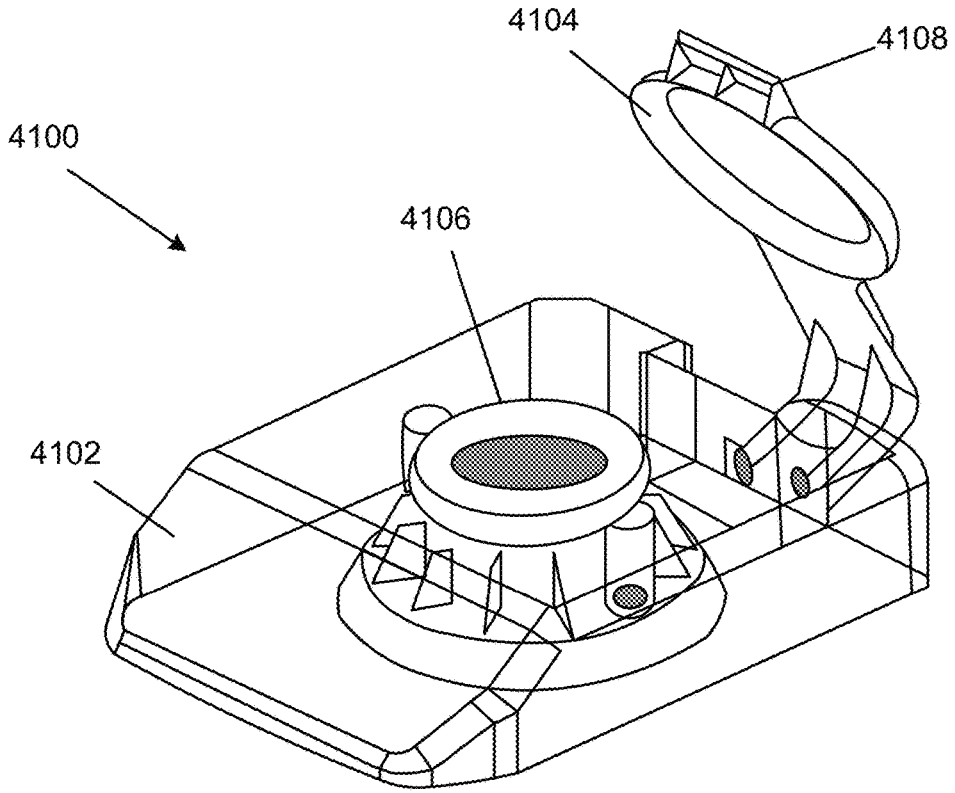
FIG. 41 shows a perspective view of an example of a drain adapter in an open position, consistent with embodiments of the present disclosure.
Figure 42:
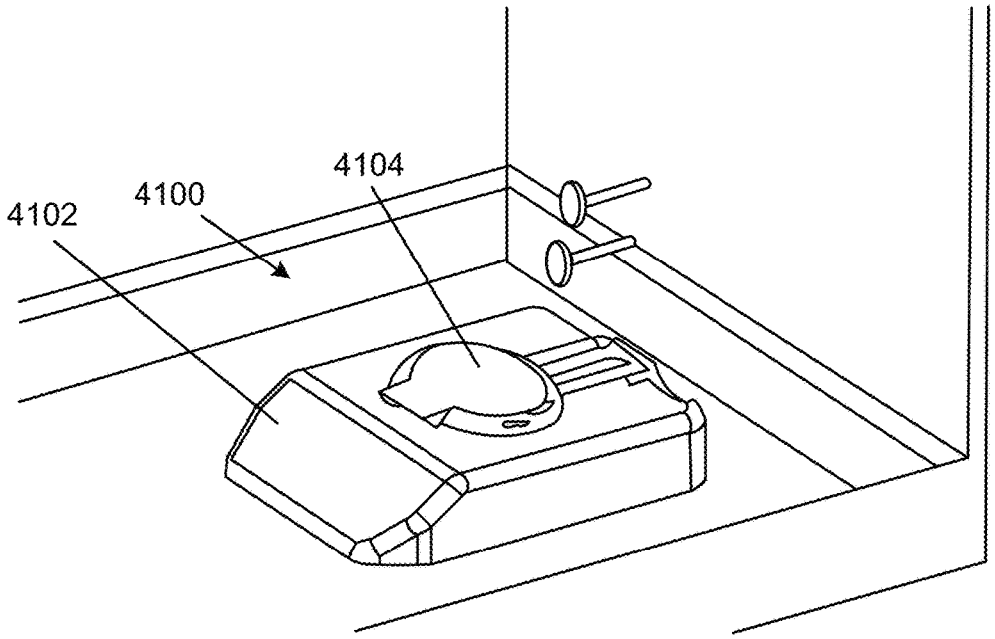
FIG. 42 shows a perspective view of an example of the drain adapter of FIG. 41 in a closed position, consistent with embodiments of the present disclosure.

FIG. 41 shows an example of a drain adapter 4100 having an adapter body 4102 and a cover 4104 in an open position and FIG. 42 shows the drain adapter 4100 having the cover 4104 in the closed position. The cover 4104 is pivotally coupled to the adapter body 4102 and extends over an adapter body opening 4106 when in the closed position. The drain adapter 4100 may be configured to interface with an autonomous toilet (e.g., the autonomous toilet 300 of FIG. 3). For example, the drain adapter 4100 may be included in a docking station (e.g., the docking station 302 of FIG. 3). As such, the autonomous toilet can be configured to urge the cover 4104 from the closed position to the open position. For example, when moving over the drain adapter 4100, the autonomous toilet can be configured to engage an opening lip 4108 of the cover 4104, wherein the engagement pivots the cover 4104 towards the open position. In some instances, the cover 4104 can be biased towards the closed position using a biasing mechanism (e.g., a spring).

Figure 43:
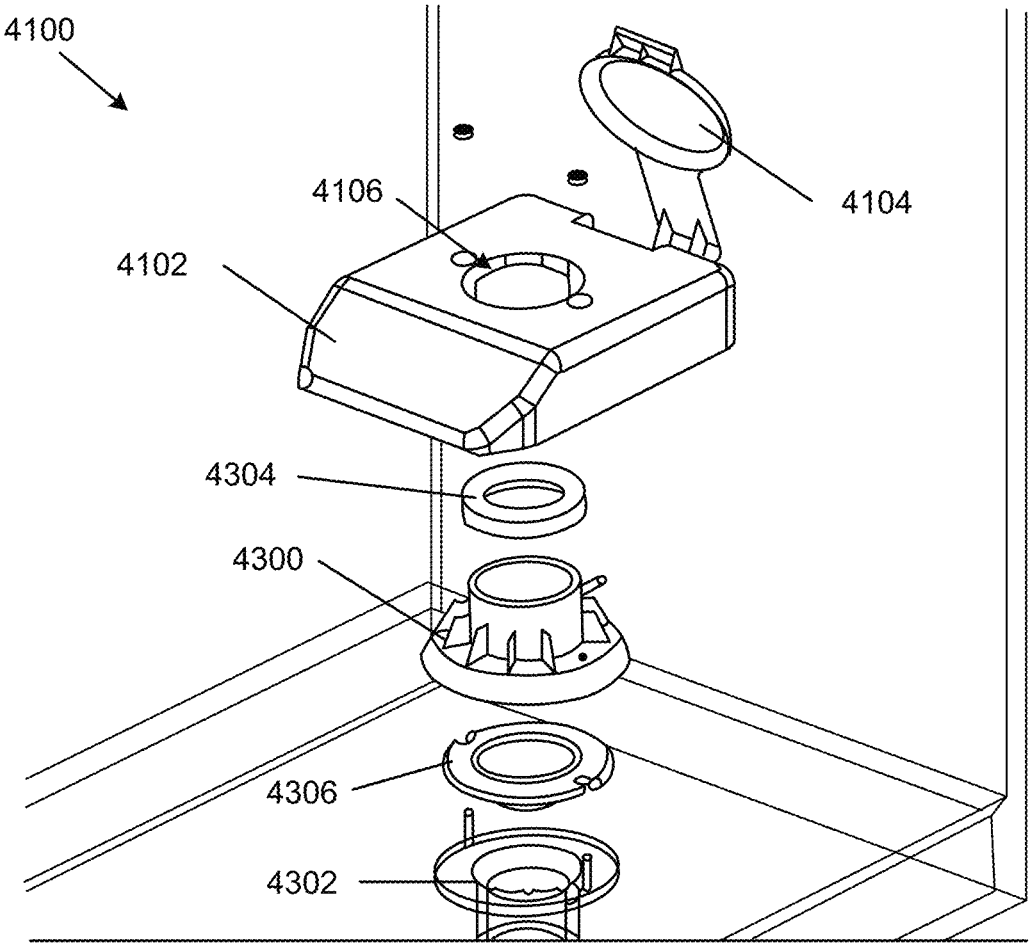
FIG. 43 shows a perspective exploded view of an example of the drain adapter of FIG. 41, consistent with embodiments of the present disclosure.

FIG. 43 shows an exploded view of the drain adapter 4100. As shown, a flange 4300 extends within the adapter body 4102 and fluidly couples the adapter body opening 4106 to a drain 4302. A first seal 4304 may be disposed between the flange 4300 and the cover 4104, when the cover 4104 is in the closed position. As such, the first seal 4304 may sealing engage with the cover 4104 when the cover 4104 is in the closed position. At least a portion of the first seal 4304 may extend through the adapter body opening 4106 such that the first seal 4304 may come into sealing engagement with the cover 4104. The first seal 4304 may be an elastically deformable seal (e.g., a natural or synthetic rubber seal). A second seal 4306 may be disposed between the flange 4300 and the drain 4302. The second seal 4306 may be a wax seal.

Figure 44:
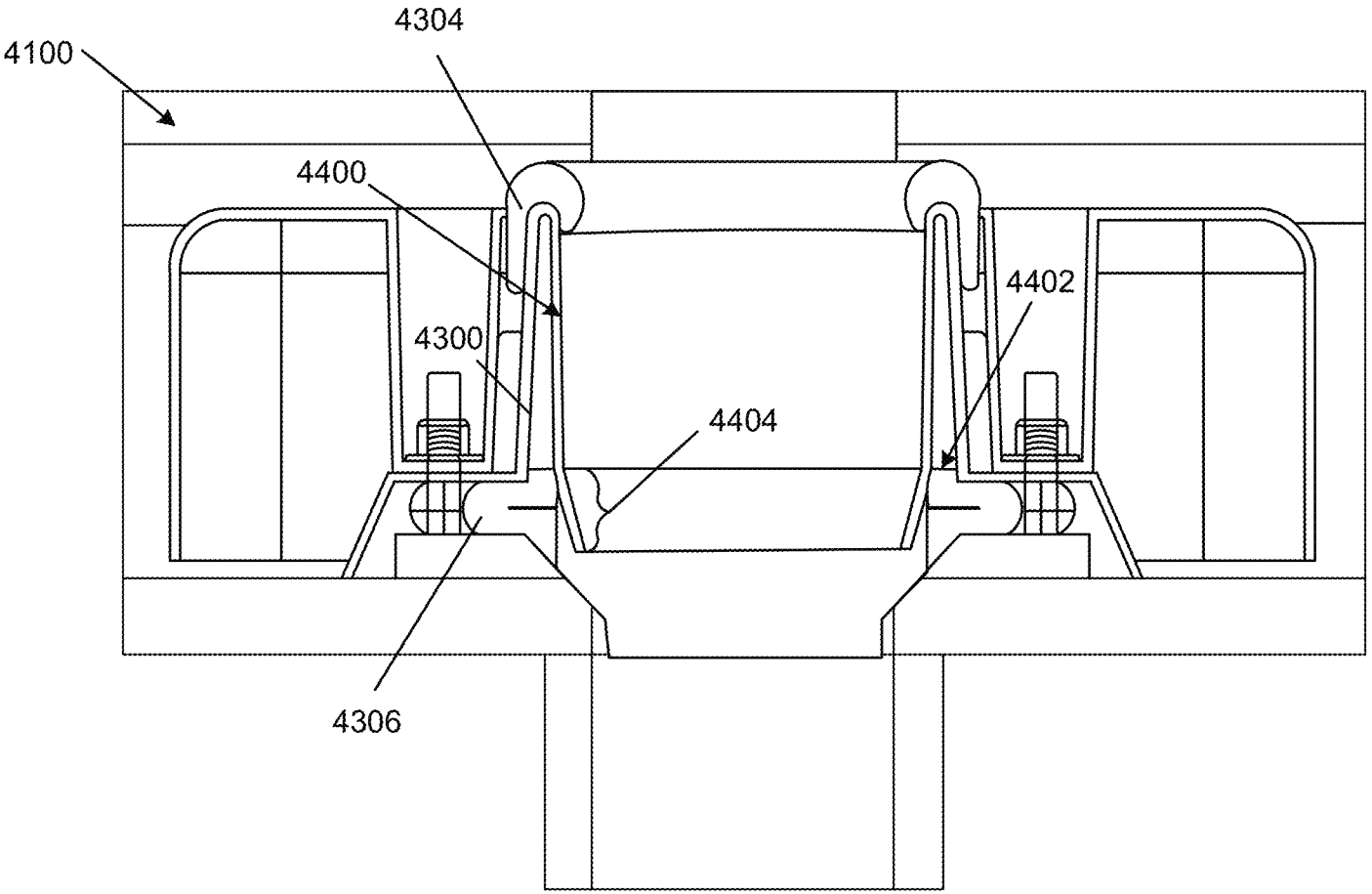
FIG. 44 shows a cross-sectional view of the drain adapter of FIG. 41, consistent with embodiments of the present disclosure.

FIG. 44 shows a cross-sectional view of the drain adapter 4100. As shown, the flange 4300 is configured to form a seal with the first and/or second seals 4304 and 4306. As also shown, the flange 4300 defines a waste channel 4400. A drain insertion end 4402 of the waste channel 4400 may include a tapered region 4404. The tapered region 4404 may, for example, encourage an alignment of the flange 4300 with the drain 4302.

Figure 25:
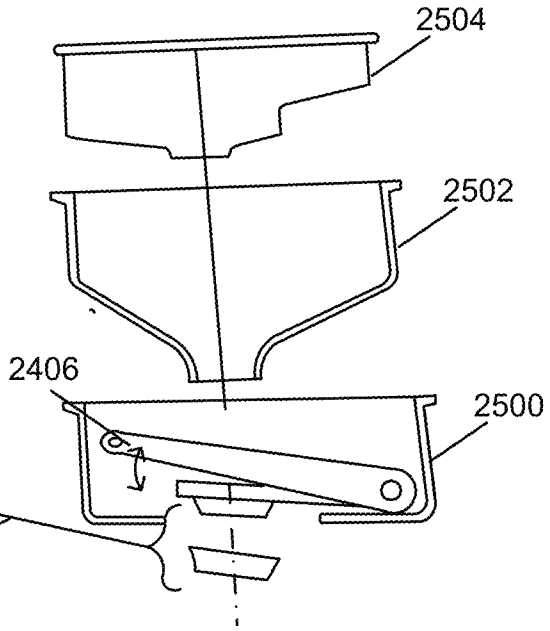
FIG. 25 shows an exploded cross-sectional schematic view of a waste receptacle of the autonomous toilet of FIG. 24, consistent with embodiments of the present disclosure.
Figure 24:
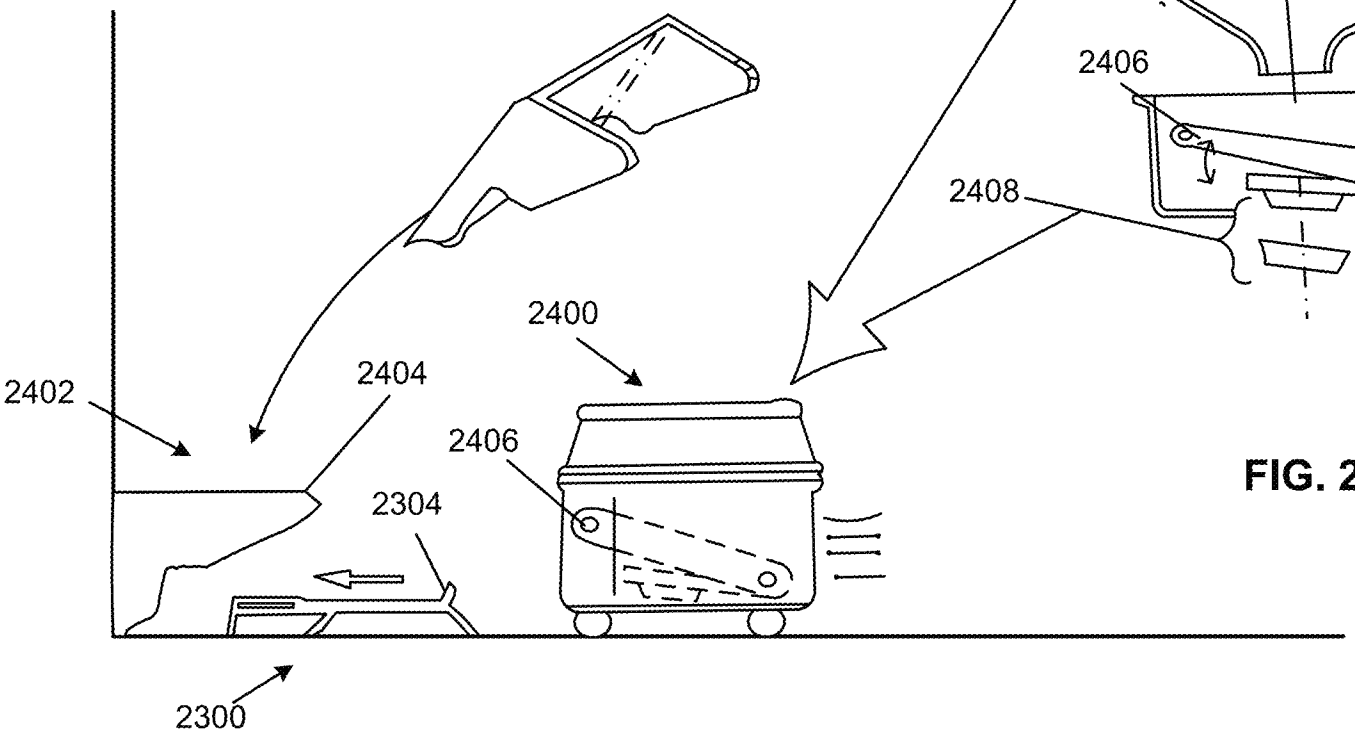
FIG. 24 shows a schematic example of an autonomous toilet that is configured to cooperate with a docking station that includes the drain adapter of FIG. 23, consistent with embodiments of the present disclosure.

FIG. 24 shows a schematic example an autonomous toilet 2400, which may be an example of the autonomous toilet 300 of FIG. 3, configured to cooperate with a docking station 2402 that includes the drain adapter 2300. FIG. 25 shows an exploded cross-sectional schematic view of a waste receptacle 2500 of the autonomous toilet 2400. As shown in FIG. 25, the waste receptacle 2500 can include a first liner 2502 (e.g., formed of latex) and a second liner 2504 disposed within the first liner 2502.

As the autonomous toilet 2400 moves over the drain adapter 2300, the autonomous toilet 2400 moves the cover 2304 to the open position and one or more arms 2404 (e.g., ramps or cammed members) of the docking station 2402 engage an actuator 2406 of the autonomous toilet 2400. The actuator 2406 is configured to transition between an empty position and a storage position. The actuator 2406 may be biased (e.g., using one or more springs and/or gravity) towards the storage position.

The inter-engagement between the actuator 2406 and the one or more arms 2404 causes the actuator 2406 to transition to the empty position. Movement of the actuator 2406 to the empty position causes a drain cap 2408 to extend from the autonomous toilet 2400 and fluidly couple the waste receptacle 2500 with the drain adapter 2300 such that waste can be transferred from the waste receptacle 2500. The drain cap 2408 may be made of a compliant material and/or may be configured to sealingly engage with the drain adapter 2300 (e.g., at least a portion of the drain cap 2408 may be received within the drain adapter 2300 such that an outer surface of the drain cap 2408 forms a seal with the drain adapter 2300). In some instances, the autonomous toilet 2400 may remain fluidly coupled to the drain adapter 2300 until the user summons the autonomous toilet 2400. In this instance, the autonomous toilet 2400 may be used as a toilet while positioned over the drain adapter 2300.

In some instances, the one or more arms 2404 may be configured to move relative to the autonomous toilet 2400 once the autonomous toilet 2400 is positioned over the drain adapter 2300. Movement of the one or more arms 2404 may actuate the actuator 2406. The one or more arms 2404 may maintain the actuator 2406 in an actuated position until the user summons the autonomous toilet 2400, allowing the toilet to be used while positioned over the drain adapter 2300. In this instance, the arms 2404 may not be ramped or cammed.

Figure 45:
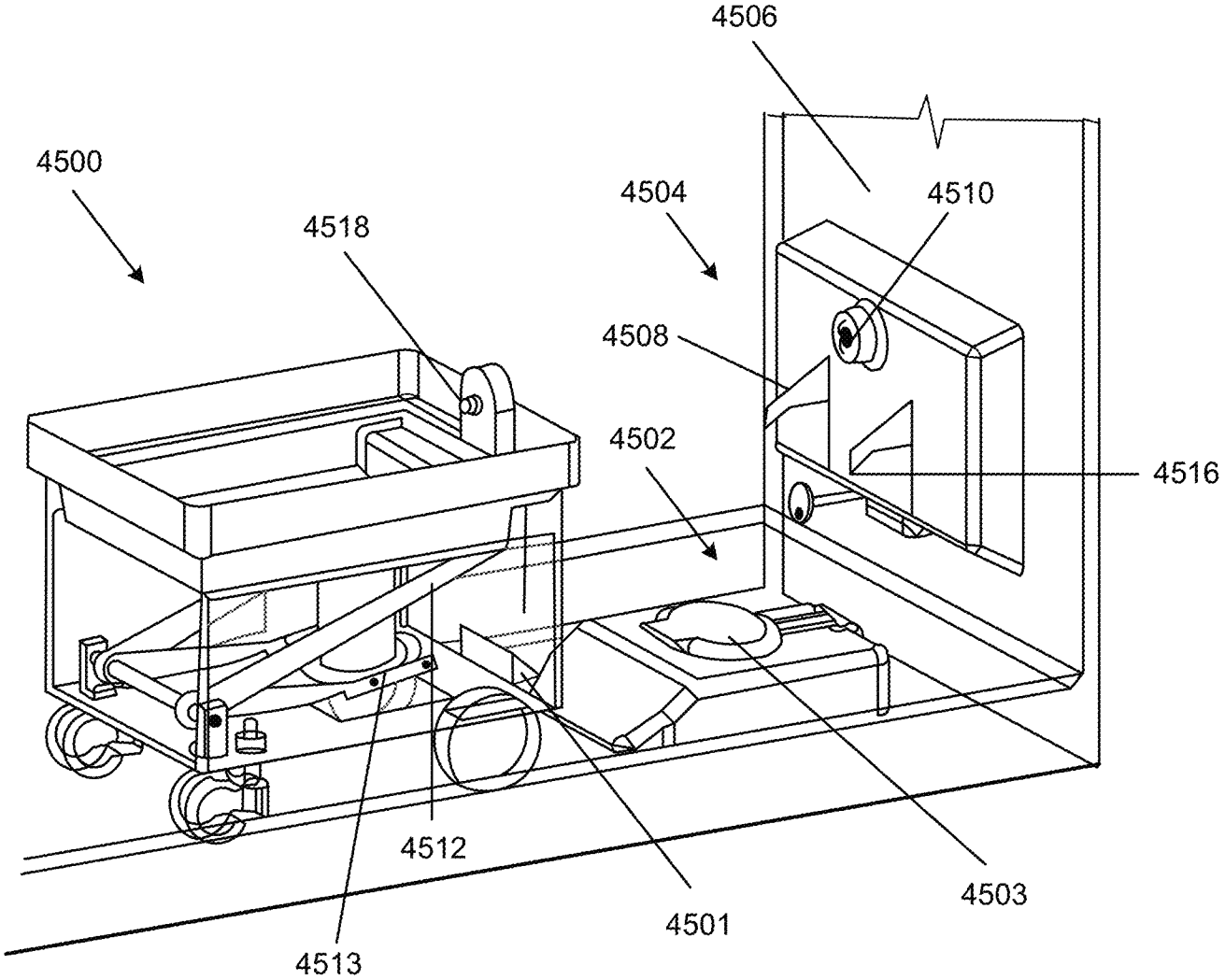
FIG. 45 shows a schematic example of an autonomous waste receptacle configured to cooperate with a drain adapter to empty waste from the autonomous waste receptacle, consistent with embodiments of the present disclosure.

FIG. 45 shows a schematic example of an autonomous waste receptacle 4500 configured to cooperate with a drain adapter 4502 to empty waste from the autonomous waste receptacle 4500. For example, the autonomous waste receptacle 4500 may include a cover engaging feature 4501 configured to engage with a cover 4503 of the drain adapter 4502, wherein engagement urges the cover 4503 towards an open position.

As shown, the autonomous waste receptacle 4500 is configured to cooperate with a wall mounted unit 4504. As shown, the wall mounted unit 4504 is coupled to a wall 4506 of a structure (e.g., a home) and includes a one or more arms 4508 and a water connection 4510. The one or more arms 4508 are configured to cooperate with an actuator 4512 of the autonomous waste receptacle 4500, wherein movement of the actuator 4512 causes at least a portion of a fluid coupling 4513 to extend from the autonomous waste receptacle 4500. The fluid coupling 4513 is configured to fluidly couple the autonomous waste receptacle 4500 with a drain 4514 (see, e.g., FIG. 46). For example, the fluid coupling 4513 may be fluidly coupled to the drain 4514 via the drain adapter 4502. In some instances, the one or more arms 4508 may include retaining features 4516 for releasably coupling to the autonomous waste receptacle 4500. The water connection 4510 is configured to fluidly couple with a water line 4518 of the autonomous waste receptacle 4500. The water line 4518 may be configured to provide water to, for example, clean the autonomous waste receptacle 4500 and/or to encourage an emptying of the autonomous waste receptacle 4500.

Figure 46:
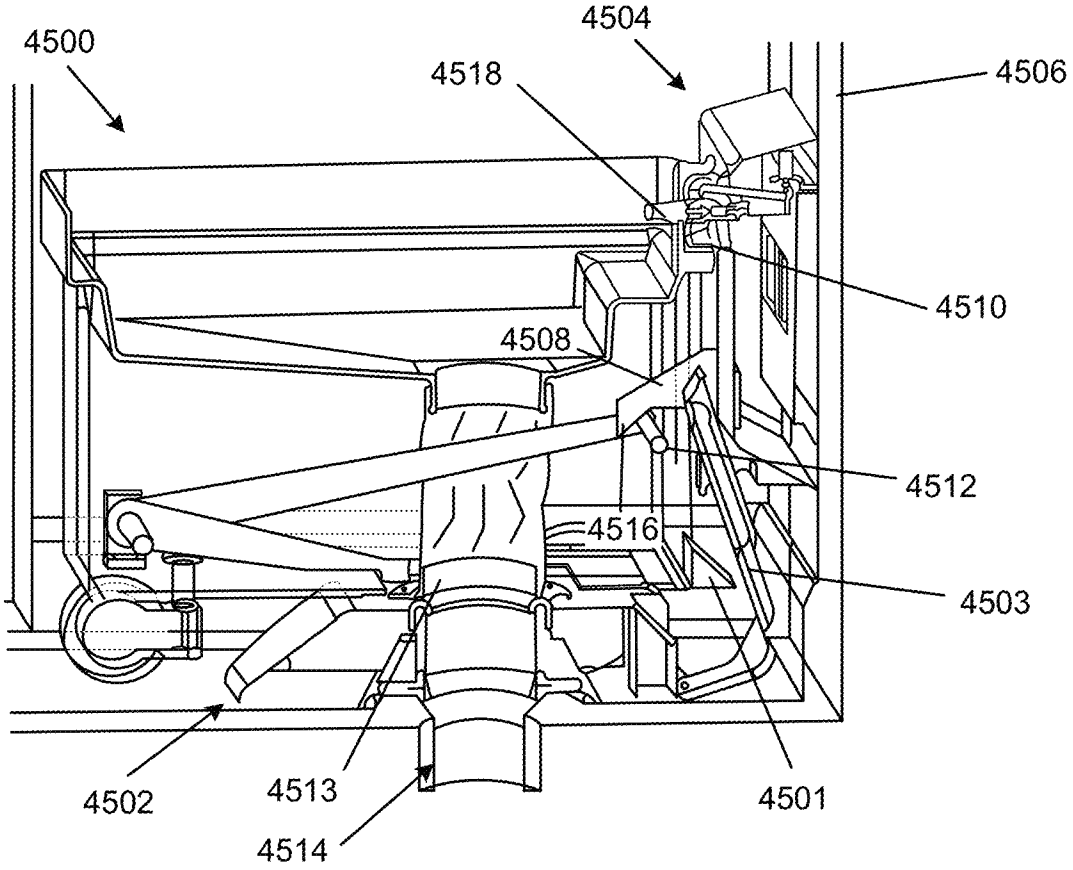
FIG. 46 shows a cross-sectional view of the autonomous waste receptacle and drain adapter of FIG. 45, consistent with embodiments of the present disclosure.

As shown in FIG. 46, the arms 4508 engage the actuator 4512 such that the actuator 4512 urges the fluid coupling 4513 in a direction of the drain 4514. In other words, the arms 4508 may generally be described as being configured to urge the fluid coupling 4513 towards an extended position from a retracted position. The actuator 4512 may be biased towards the retracted position using one or more biasing mechanisms (e.g., springs).

Figure 27:
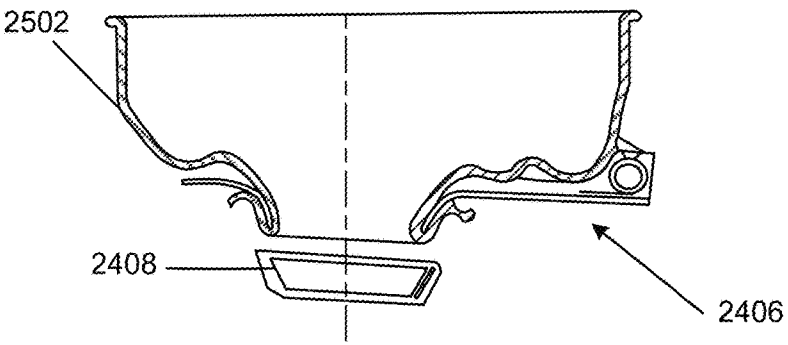
FIG. 27 shows a schematic example of the actuator of FIG. 26 interacting with a liner of the waste receptacle of FIG. 25, consistent with embodiments of the present disclosure.
Figure 26:
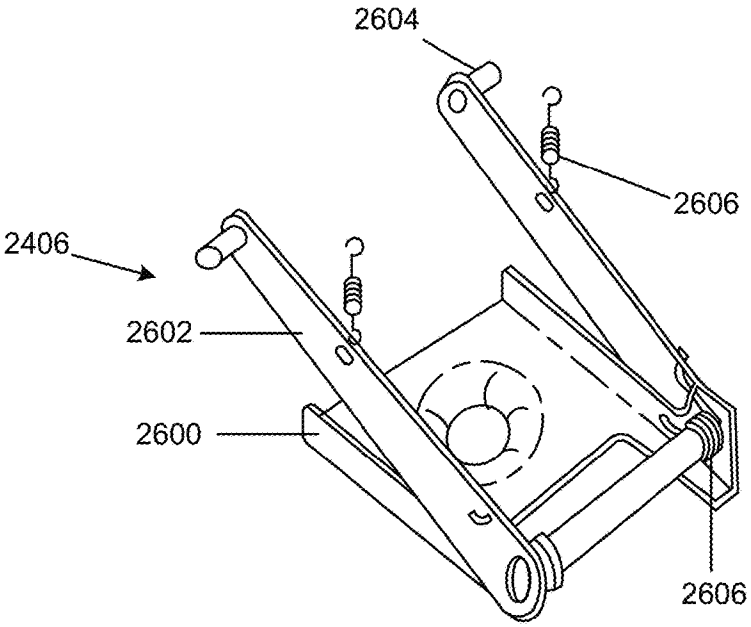
FIG. 26 shows a schematic example of an actuator of the autonomous toilet of FIG. 24, consistent with embodiments of the present disclosure.

FIG. 26 shows a schematic example of the actuator 2406. FIG. 27 shows a schematic example of the actuator 2406 interacting with the first liner 2502. As shown, the actuator 2406 includes a base portion 2600 and an engaging portion 2602 pivotally coupled to the base portion 2600. The base portion 2600 is coupled to the first liner 2502 and configured to exert a force on the first liner 2502 that causes the first liner 2502 to elastically deform until the drain cap 2408 sealingly engages with the drain adapter 2300. In some instances, the drain cap 2408 may couple a portion of the first liner 2502 to the waste receptacle 2500 (e.g., by exerting a clamping force on the first liner 2502). The engaging portion 2602 includes engagement protrusions 2604 configured to engage with one or more of the one or more arms 2404. One or more biasing mechanisms 2606 (e.g., springs) may urge the actuator 2406 to the storage position.

Figures 28, 29:
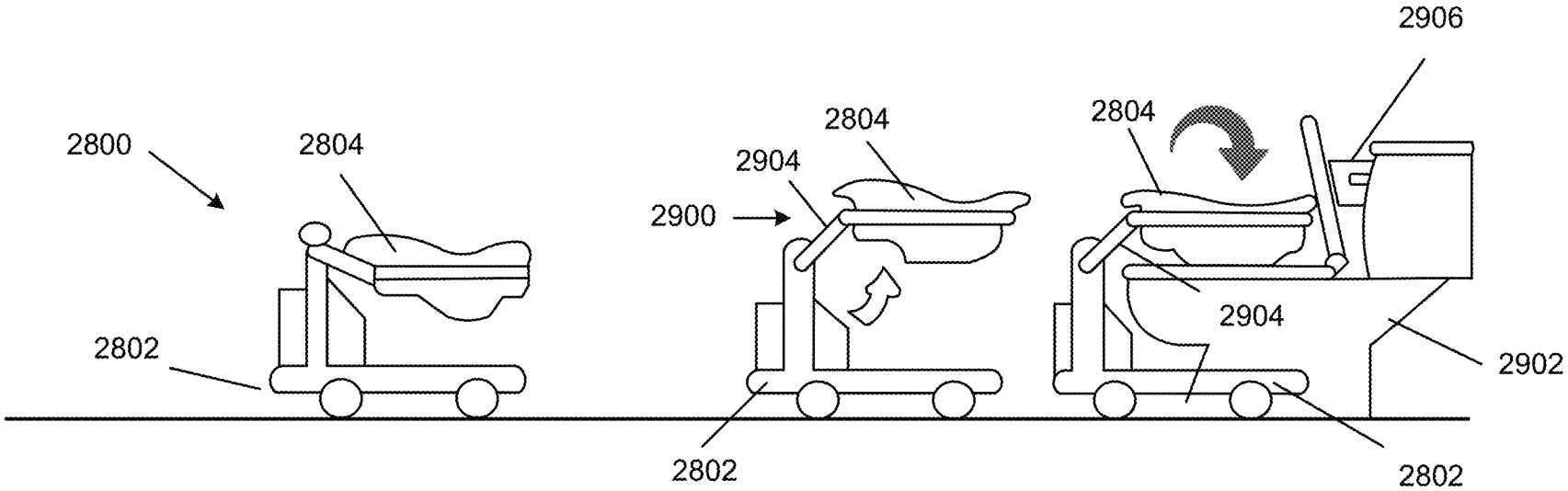
FIG. 28 shows a schematic view of an autonomous waste receptacle in a use position, consistent with embodiments of the present disclosure.
FIG. 29 shows a schematic view of the autonomous waste receptacle of FIG. 28 transitioning to and in an emptying position, consistent with embodiments of the present disclosure.

FIG. 28 shows a schematic example of an autonomous waste receptacle 2800 in a use position and FIG. 29 shows a schematic example of the autonomous waste receptacle 2800 transitioning to and in an empty position. The autonomous waste receptacle 2800 may be an example of the autonomous waste receptacle 100 of FIG. 1. As shown in FIG. 28, the autonomous waste receptacle 2800 includes a driving portion 2802 and a receptacle portion 2804. As shown in FIG. 29, the driving portion 2802 includes a lift 2900 configured to position the receptacle portion 2804 over a fixed toilet 2902 for emptying. In some instances, the lift 2900 may rest the receptacle portion 2804 on the fixed toilet 2902 before emptying. The lift 2900 includes one or more arms 2904 configured to support the receptacle portion 2804. The one or more arms 2904 and/or a portion of the receptacle portion 2804 may be configured to open and/or close a lid on the fixed toilet 2902. In some instances, the autonomous waste receptacle 2800 may be configured to cause the fixed toilet 2902 to flush any waste received from the receptacle portion 2804. For example, the autonomous waste receptacle 2800 may be communicatively coupled (e.g., using a wireless connection such as Bluetooth) to a flusher 2906 configured to flush the fixed toilet 2902. The flusher 2906 may be coupled to the fixed toilet 2902, may be coupled to a wall adjacent the fixed toilet 2902, may be a freestanding device, and/or the like.

Figure 30:
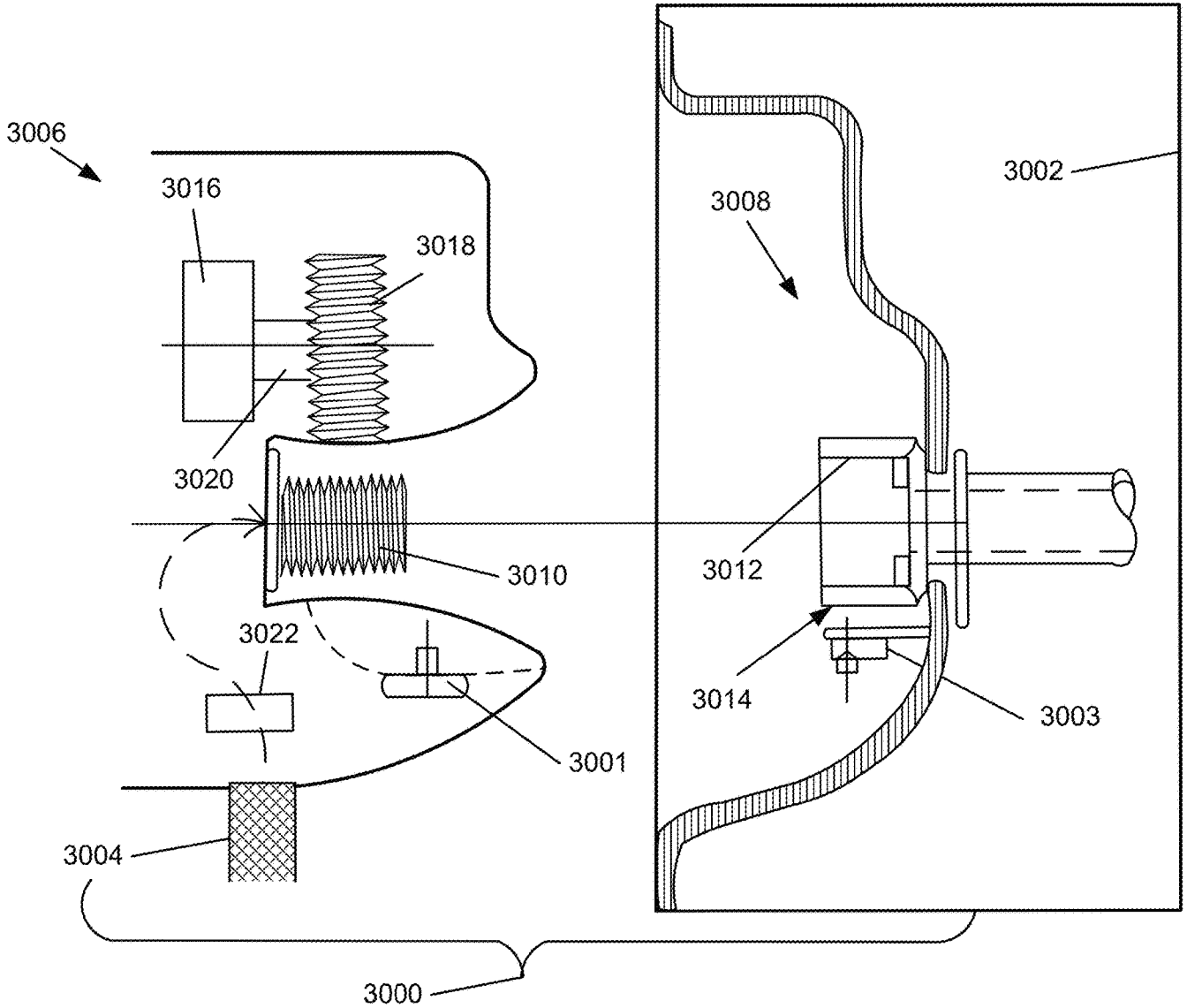
FIG. 30 shows a schematic example of a coupling system for fluidly coupling an autonomous toilet to a water supply, consistent with embodiments of the present disclosure.

FIG. 30 shows a schematic example of a coupling system 3000 for fluidly coupling an autonomous toilet 3002 (e.g., the autonomous toilet 300 of FIG. 3) to a water supply 3004 (e.g., via a toilet shutoff valve). In some instances, the autonomous toilet 3002 may include at least a portion of the coupling system 3000. For example, the coupling system 3000 can include a supply side 3006 (which may be included in a docking station for the autonomous toilet 3002 such as the docking station 302 of FIG. 3) and a toilet side 3008, wherein the autonomous toilet 3002 may include the toilet side 3008 of the coupling system 3000. In some instances, coupling system 3000 may have a sensory system that includes a supply side portion 3001 and a toilet side portion 3003. The supply side portion 3001 can be configured to detect a proximity of the toilet side portion 3003. For example, upon the supply side portion 3001 detecting the proximity of the toilet side portion 3003, the coupling system 3000 may be configured to commence a coupling operation that fluidly couples the supply side 3006 to the toilet side 3008. The supply side portion 3001 and the toilet side portion 3003 may collectively form an inductive sensory system.

As shown, the supply side 3006 includes a first (e.g., male) threaded coupling 3010 that defines a fluid passageway that is fluidly coupled to the water supply 3004. The toilet side 3008 includes a second (e.g., female) threaded coupling 3012 configured to threadably couple to the first threaded coupling 3010. The second threaded coupling 3012 may be rotatable and include a geared outer surface 3014. The supply side 3006 may further include a motor 3016 with a drive gear 3018 coupled to a drive shaft 3020 of the motor 3016, wherein the drive gear 3018 is configured to engage (or mate with) the geared outer surface 3014 of the second threaded coupling 3012 to cause the second threaded coupling 3012 to rotate. As such, when the second threaded coupling 3012 is brought into engagement with the first threaded coupling 3010, the motor 3016 may cause the drive gear 3018 to rotate such that the second threaded coupling 3012 is threaded onto the first threaded coupling 3010. When the first and second threaded couplings 3010 and 3012 are coupled together, the motor 3016 may be configured to cause the drive gear 3018 to rotate such that the second threaded coupling 3012 is unthreaded from the first threaded coupling 3010. In some instances, the autonomous toilet 3002 may be configured to move at a speed and direction consistent with a linear movement of the second threaded coupling 3012 along the first threaded coupling 3010. Additionally, or alternatively, the toilet side 3008 of the coupling system 3000 may be slidably coupled to the autonomous toilet 3002 such that the toilet side 3008 moves in response to the linear movement of the second threaded coupling 3012 along the first threaded coupling 3010.

The supply side 3006 may further include a supply valve 3022 (e.g., a ball valve or solenoid valve) configured to fluidly couple to the supply side 3006 to the water supply 3004 in response to the first and second threaded couplings 3010 and 3012 being coupled (e.g., sealingly coupled) together. When the first and second threaded couplings 3010 and 3012 are not coupled (e.g., sealingly coupled) together, the supply valve 3022 is configured to fluidly decouple the supply side 3006 from the water supply 3004.

In some instances, instead of using the first and second threaded couplings 3010 and 3012 to establish a fluid coupling, the supply side 3006 and toilet side 3008 may include one or more quick connect couplings. In this instance, one or more of the supply side 3006 and/or the toilet side 3008 may include an actuator to actuate the quick connect coupling (e.g., to allow the supply side 3006 to decouple from the toilet side 3008).

Figure 31A:
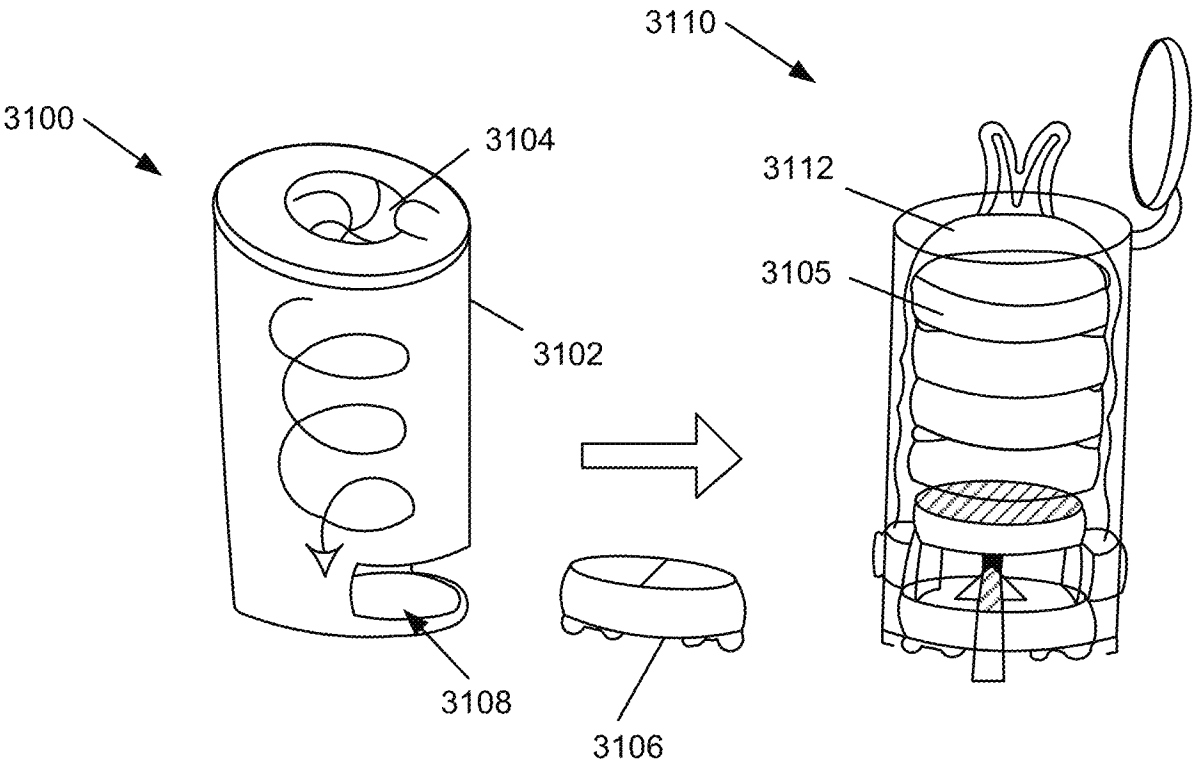
FIG. 31A shows a schematic example of a portable toilet configured to receive waste from a user, a docking station, and a mobile robot for transferring waste from the portable toilet to the docking station, consistent with embodiments of the present disclosure.

FIG. 31A shows a schematic example of a portable toilet 3100 configured to receive waste from a user. In some instances, the portable toilet 3100 may be configured as an autonomous toilet. The portable toilet 3100 includes a waste receptacle 3102 having an internal liner 3104 (e.g., a disposable internal liner). The internal liner 3104 is configured to receive waste from the user. After each use, the portable toilet 3100 may be configured to manipulate the internal liner 3104 such that the internal liner 3104 forms a waste pocket 3105 that encloses the waste. For example, after the waste is received within the internal liner 3104, the portable toilet 3100 may be configured to seal the internal liner 3104 together at a location above the waste (e.g., using heat sealing, twisting, or any other method of forming a seal). Once the seal is formed, additional waste may be added to the internal liner 3104, wherein the additional waste may be sealed into a separate waste pocket 3105. In other words, after each use of the portable toilet 3100, an additional waste pocket 3105 may be formed. In some instances, the waste pockets 3105 may be compressed by a compactor within the portable toilet. Compressing the waste pockets 3105 may increase a volume of waste capable of being received by the waste receptacle 3102 before being emptied. In some instances, the portable toilet 3100 may include a storage compartment for storing one or more waste pockets 3105 (e.g., for removal by a user or by an autonomous robot).

As shown, in some instances, each waste pocket 3105 may be severed from the internal liner 3104 such that a mobile robot 3106 may collect the severed waste pocket 3105. For example, the portable toilet 3100 may include a mobile robot bay 3108, wherein the mobile robot 3106 collects one or more waste pockets 3105 from the portable toilet 3100 while in the mobile robot bay 3108. After a waste pocket 3105 is collected the mobile robot 3106 may take the waste pocket 3105 to a docking station 3110 for disposal. As shown, each waste pocket 3105 is lifted into the docking station 3110 (e.g., using a lift mechanism of the mobile robot 3106 and/or the docking station 3110). When the docking station 3110 is emptied, a tubular bag liner 3112 may be sealed proximate the last received waste pocket 3105 such that a bag is formed. By forming a bag, it may be easier for a user to remove the collected waste pockets 3105. Additionally, or alternatively, the collected waste pockets 3105 may be configured to adhere to each other when received within the docking station 3110.

The portable toilet 3100 may be used without the mobile robot 3106 or docking station 3110. In this instance, the waste pockets 3105 may not be severed from each other when emptying the portable toilet 3100. For example, when emptying is desired, the most recent waste pocket 3105 may be severed from the internal liner 3104 such that the waste pockets 3105 may be removed as a group.

Whenever a waste pocket 3105 is severed from the internal liner 3104, a seal is formed (or remains) at the sever location such that waste does not escape the internal liner 3104. In some instances, before a waste pocket 3105 is formed, a composting enzyme may be introduced into the portion of the internal liner 3104 that will form the waste pocket 3105. The presence of the composting enzymes may allow for easier disposal (e.g., the enzymes may break the waste down into a substance capable of being safely disposed of in the trash). Additionally, or alternatively, the internal liner may include an absorbent material (e.g., a clay material). The absorbent material may be a material that is safely disposable down a fixed toilet.

Figure 31C:
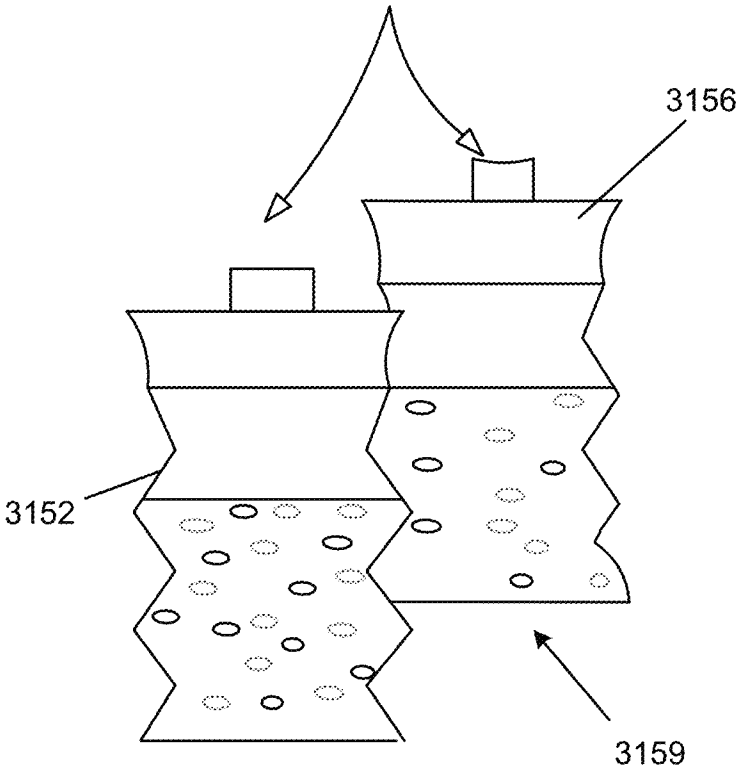
FIG. 31C shows a plurality of the disposable liners of FIG. 31B decoupled from the portable seat, consistent with embodiments of the present disclosure.
Figure 31B:
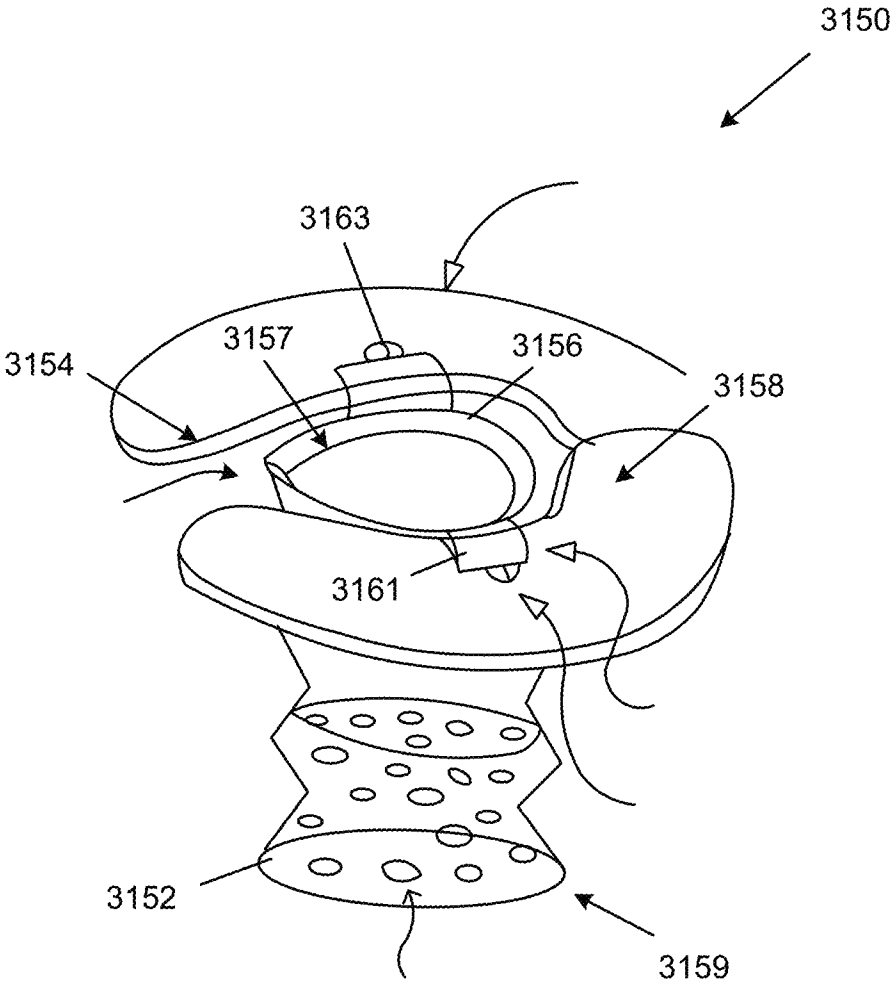
FIG. 31B shows a schematic example of a portable seat configured to cooperate with a disposable liner for receiving waste, consistent with embodiments of the present disclosure.

FIG. 31B shows a schematic example of a portable seat 3150 configured to cooperate with a disposable liner 3152 and FIG. 31C shows a plurality of disposable liners 3152 decoupled from the portable seat 3150. The portable seat 3150 may be configured to be removably coupled to a bed, a stand, a wall, and/or any other surface capable of supporting the weight of a user.

As shown, the portable seat 3150 defines an open area 3154 through which waste may pass. The disposable liner 3152 includes a liner coupling 3156 at a liner open end 3157 of the disposable liner 3152, the liner open end 3157 being opposite a liner closed end 3159.

The liner coupling 3156 is configured to support the disposable liner 3152 in a suspended position relative to the portable seat 3150. For example, the liner coupling 3156 can be configured to extend through the open area 3154 of the portable seat 3150 and to releasably engage with the portable seat 3150. In this example, the liner coupling 3156 may include coupling tabs 3161 configured to engage with an inner portion 3158 of the portable seat 3150. The coupling tabs 3161 may include touch points 3163 configured to encourage disengagement of the coupling tabs 3161 with the inner portion 3158 when a user applies a force to the touch points 3163.

Opposing sides of the liner coupling 3156 may be configured to couple together when brought into contact with each other (e.g., adhesively couple to each other). When opposing sides of the liner coupling 3156 are coupled together, the disposable liner 3152 may be sealed such that waste is substantially prevented from escaping from the disposable liner 3152. Once sealed, the disposable liner 3152 may be disposed of manually and/or using a mobile robot (e.g., the mobile robot 3106 of FIG. 31A).

The disposable liner 3152 may include a composting enzyme. The presence of the composting enzymes may allow for easier disposal (e.g., the enzymes may break the waste down into a substance capable of being safely disposed of in the trash). Additionally, or alternatively, the disposable liner 3152 may include an absorbent material (e.g., a clay material and/or absorbent gel beads).

Figure 32:
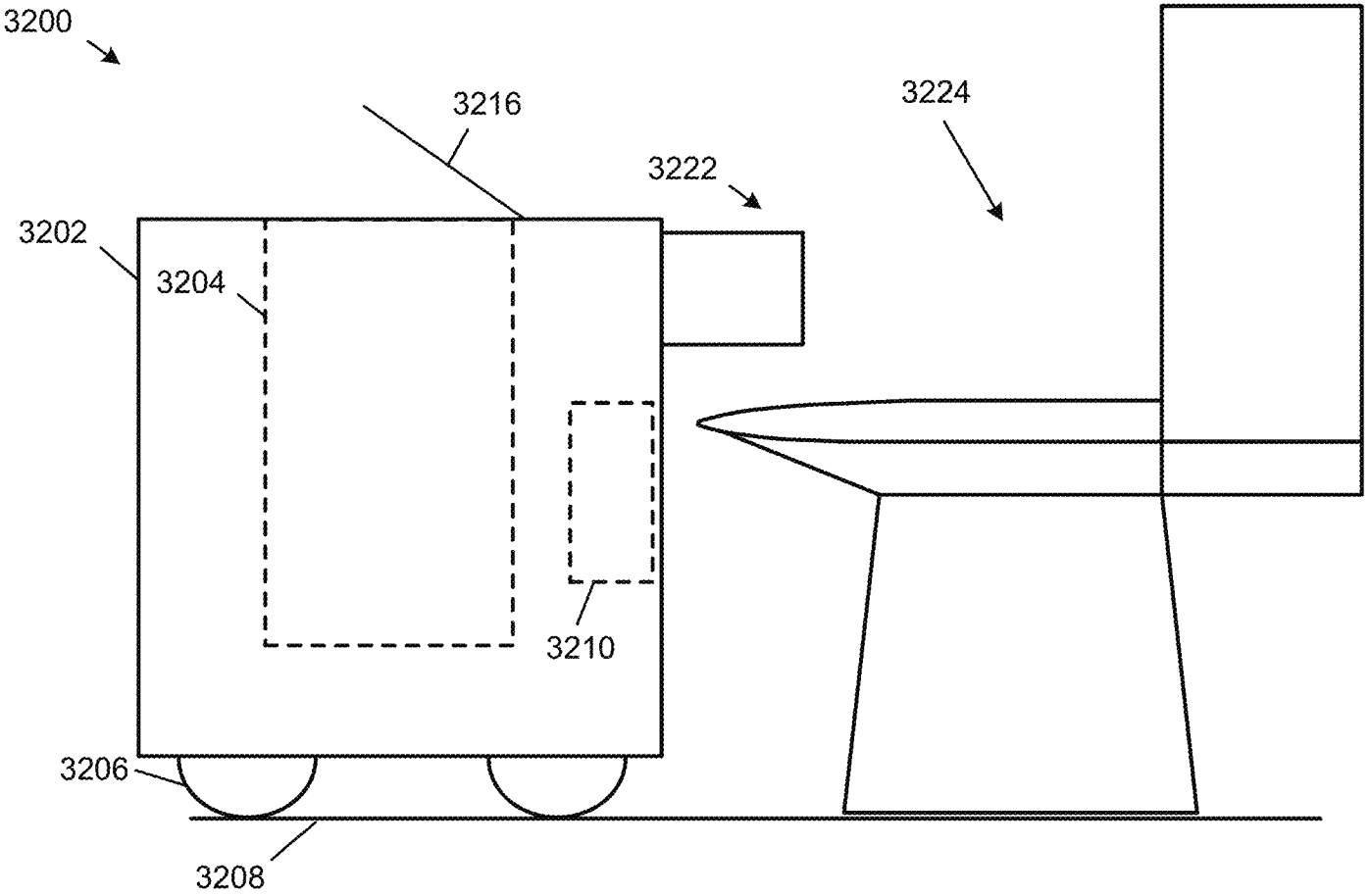
FIG. 32 shows a schematic example of an autonomous toilet configured to cooperate with a fixed toilet, consistent with embodiments of the present disclosure.

FIG. 32 shows a schematic example of an autonomous toilet 3200 configured to engage (e.g., couple to) a fixed toilet. The autonomous toilet 3200 may be an example of the autonomous waste receptacle 100 of FIG. 1. As shown, the autonomous toilet 3200 may include a main body 3202, a waste receptacle 3204 disposed at least partially within the main body 3202, a lid 3216 configured to selectively enclose an open end of the waste receptacle 3204, and a drain stem 3222 configured to fluidly couple to a fixed toilet 3224 to transfer waste stored in the waste receptacle 3204 to the fixed toilet 3224. A plurality of driven wheels 3206 are coupled to the main body 3202, the driven wheels 3206 being configured to urge the autonomous toilet 3200 across a surface 3208, and a controller 3210 communicatively coupled to the plurality of driven wheels 3206.

Figure 33:
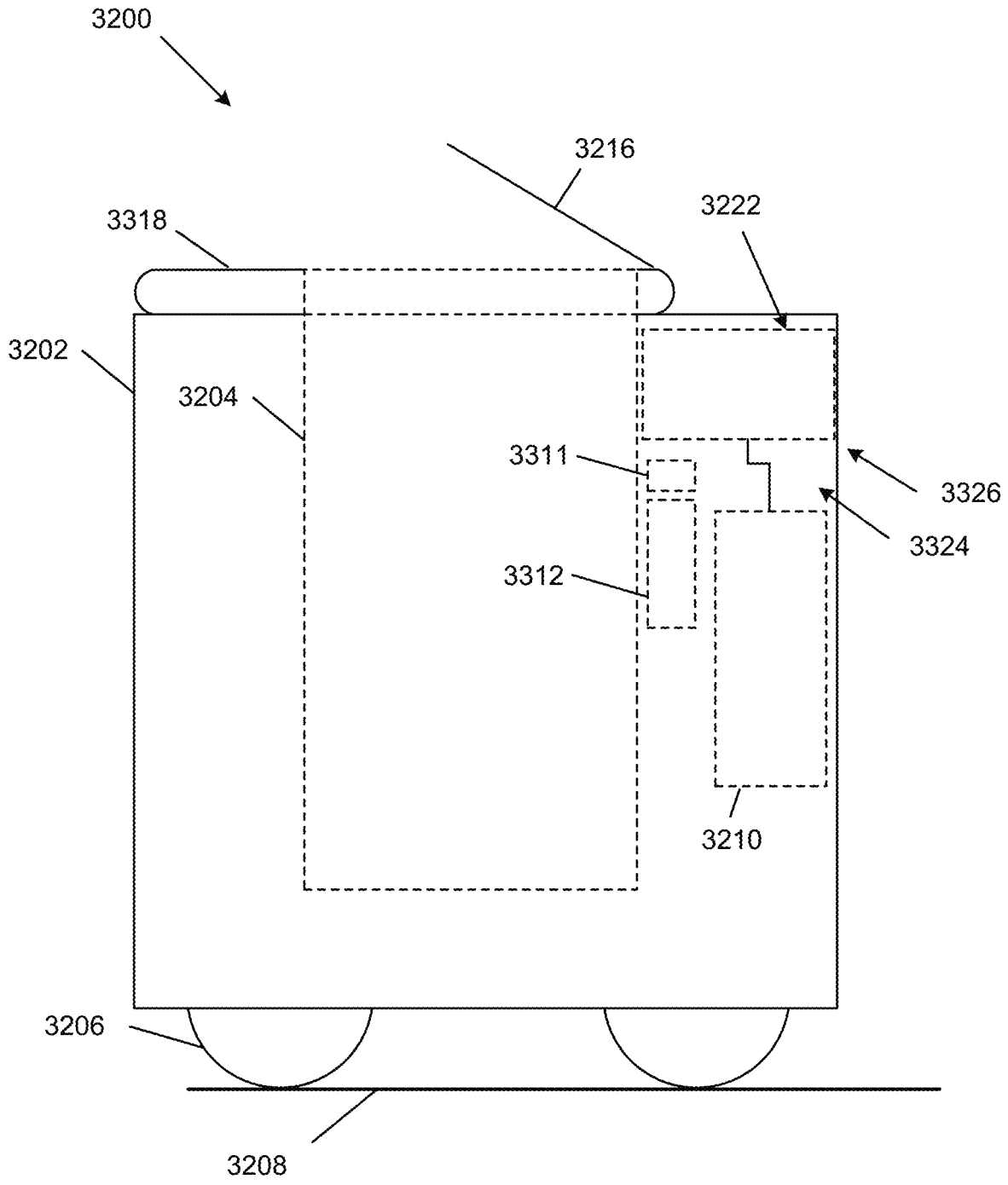
FIG. 33 shows a schematic example of the autonomous toilet of FIG. 32, consistent with embodiments of the present disclosure.

In some instances, as shown in FIG. 33, the drain stem 3222 is a retractable drain stem. The retractable drain stem 3222 is configured to transition between an extended position and a storage position. For example, the drain stem 3222 may be configured such that the drain stem 3222 extends from a vertically extending (e.g., a vertical) sidewall of the autonomous toilet 3200.

In some instances, the retractable drain stem 3222 may be configured to automatically extend in response to the autonomous toilet 3200 reaching a location proximate the fixed toilet 3224 (e.g., a location within 1 meter (m) or 2 m of the fixed toilet 3224), which may be generally referred to as a fixed toilet location. Additionally, or alternatively, the drain stem 3222 may be configured to extend in response to receiving a user input. When the drain stem 3222 is in the extended position, waste stored within the waste receptacle 3204 may be caused to flow through drain stem 3222 and into the fixed toilet 3224. In response to completing the transfer of waste into the fixed toilet 3224, the retractable drain stem 3222 may be configured to retract to the storage position. In some instances, prior to retracting into the storage position, the drain stem 3222 may undergo a self-cleaning operation in which an outlet of the drain stem 3222 is cleaned (e.g., using a fluid such as water, soap, and/or a liquid sanitizer) and/or dried (e.g., using a flow of air) such that waste does not inadvertently drip on the fixed toilet 3224 and/or a floor (e.g., when the autonomous toilet 3200 returns to a location of the user and/or a docking station).

As shown, when the retractable drain stem 3222 is in the storage position, the drain stem 3222 may be configured to be received within a receiving space 3324 at least partially defined within the main body 3202. For example, and as shown, the receiving space 3324 is positioned such that at least a position of the receiving space 3324 is between a seat 3318 and/or the waste receptacle 3204 of the autonomous toilet 3200 and a rear wall 3326 of the autonomous toilet 3200. The retractable drain stem 3222 may have a geared outer surface and the autonomous toilet 3200 may further include a motor 3312 having a drive gear 3311 coupled thereto, the drive gear 3311 being configured to engage the geared outer surface of the retractable drain stem 3222 to cause the retractable drain stem 3222 to extend or retract. For example, the retractable drain stem 3222 may include a threaded coupling that is configured to engage the drive gear 3311. The drive gear 3311 may be caused to rotate in a first direction to cause the drain stem 3222 to extend and to rotate in a second, opposite direction, to cause the drain stem 3222 to retract.

Figure 34A:
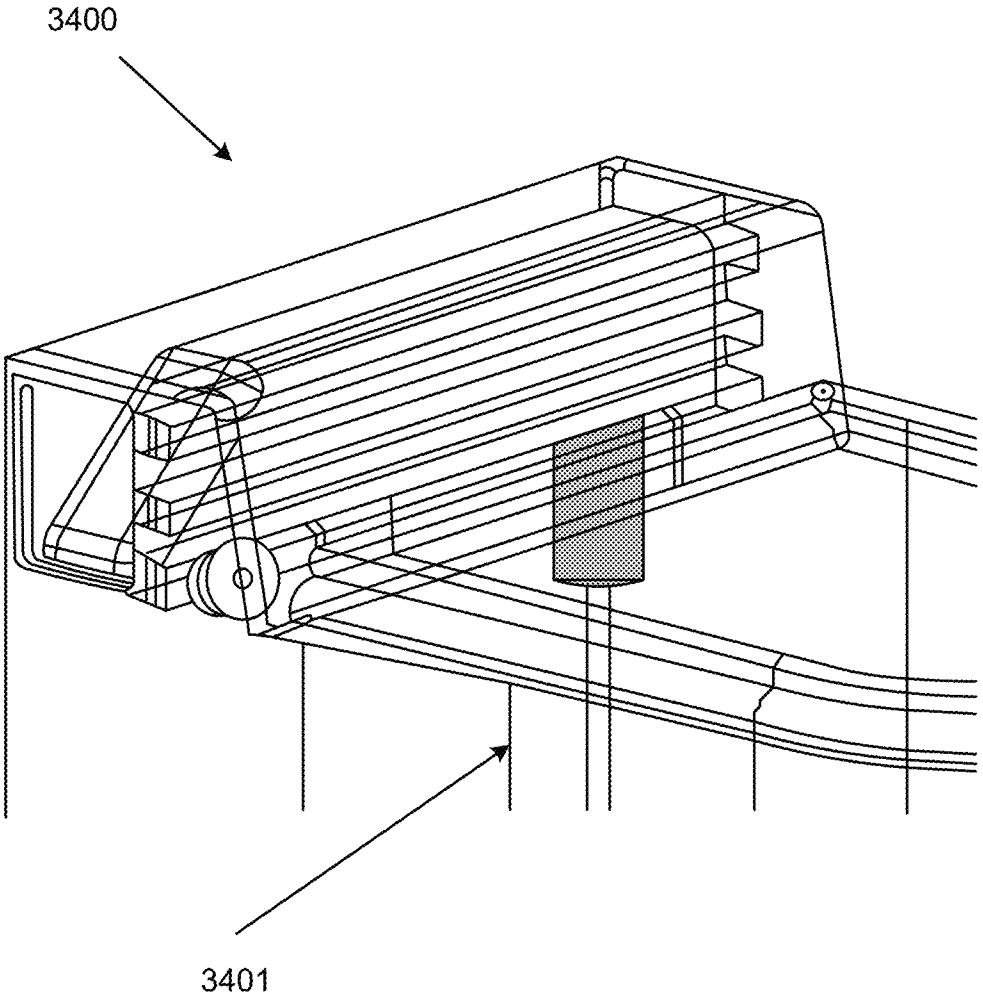
FIG. 34A shows a schematic example of an autonomous toilet having a retractable drain stem in a storage position, consistent with embodiments of the present disclosure.
Figure 34B:
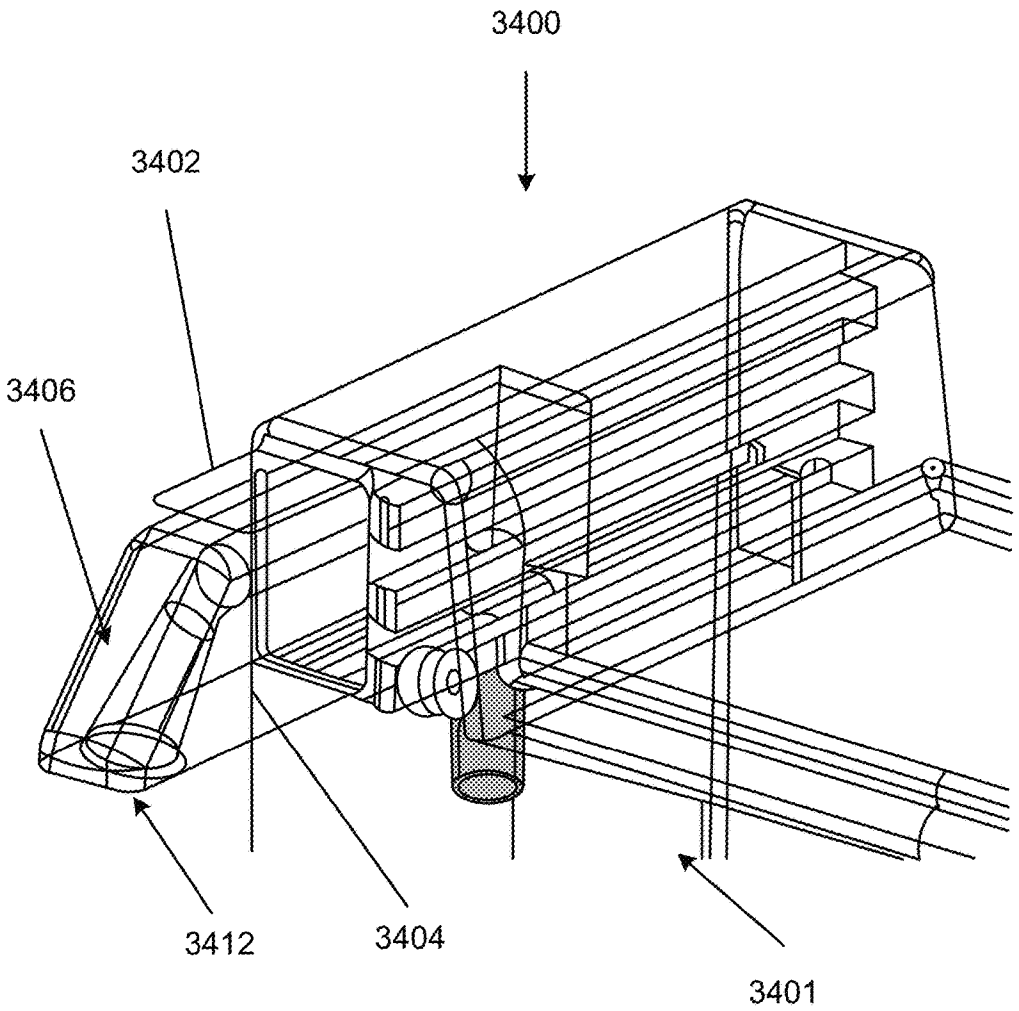
FIG. 34B shows a schematic example of the autonomous toilet of FIG. 34A having the retractable drain stem in an extended position, consistent with embodiments of the present disclosure.

FIG. 34A and FIG. 34B show an example of an autonomous toilet 3400, which may be an example of the autonomous toilet 3200. As shown the autonomous toilet 3400 includes a retractable drain stem 3404. In some instances, the autonomous toilet 3400 may further include a door 3402 hingedly coupled to a main body 3202 of the autonomous toilet 3400. The door 3402 is configured to transition between the open and closed positions in response to the drain stem 3404 transitioning between extended (e.g., as shown in FIG. 34B) and storage (e.g., as shown in FIG. 34A) positions. The door 3402 is configured to be opened when the retractable drain stem 3404 extends out of the main body 3202 and closed when the drain stem 3404 is retracted within the main body 3202. In some instances, the door 3402 is configured to automatically open and close simultaneously with the extending and retracting of the retractable drain stem 3404.

Figure 35:
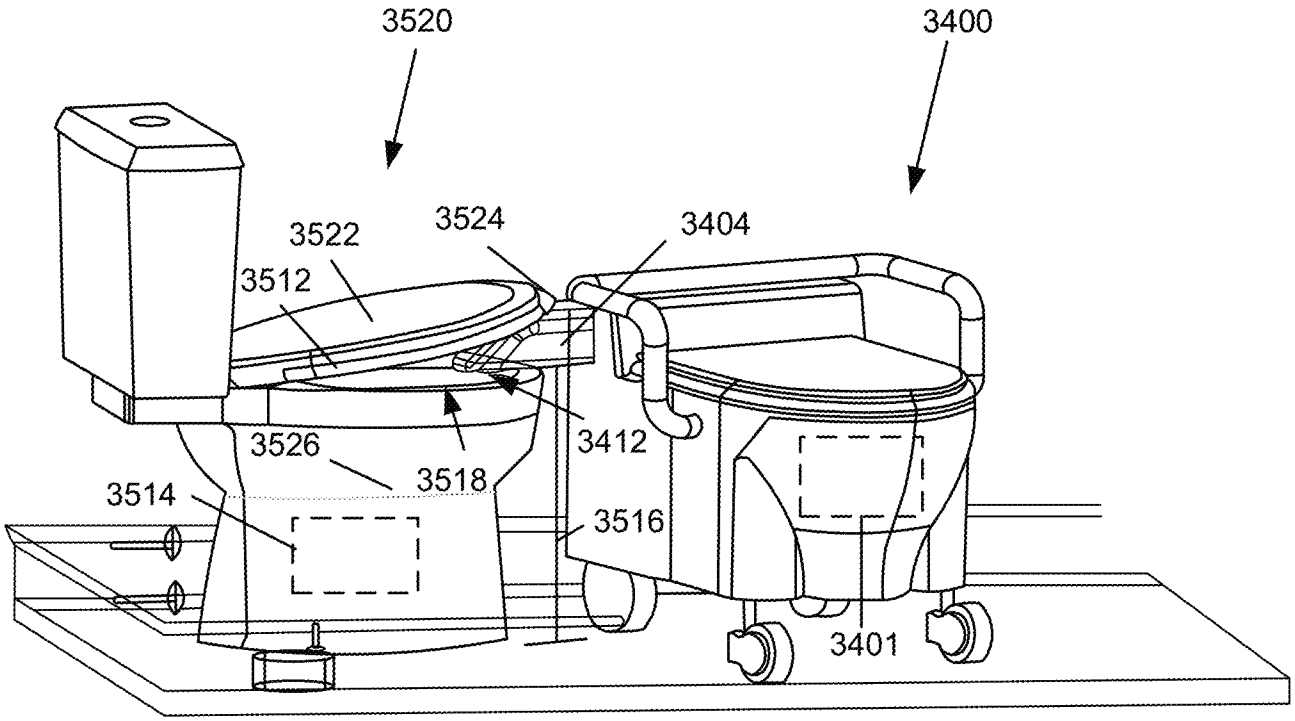
FIG. 35 shows an example of an autonomous toilet cooperating with a fixed toilet, consistent with embodiments of the present disclosure.

FIG. 35 shows an example of the autonomous toilet 3400 fluidly coupled to a fixed toilet 3520. The fixed toilet 3520 includes a lid 3522 configured to transition between an open position and a closed position. When in the closed position, the lid 3522 covers an opening 3518 of the fixed toilet 3520, wherein the opening 3518 is configured to receive waste.

The fixed toilet 3520 may be coupled to a central waste depository (e.g., a sewer or septic line) such that waste received within the fixed toilet can be transferred to the central waste depository. As such, when the autonomous toilet 3400 fluidly couples to the fixed toilet 3520, waste stored within the autonomous toilet 3400 can be transferred to the central waste depository via the fixed toilet 3520. For example, the retractable drain stem 3404 may be caused to extend from the autonomous toilet 3400 such that at least a portion of the retractable drain stem 3404 extends over at least a portion of the opening 3518 of the fixed toilet 3520, fluidly coupling the autonomous toilet 3400 with the fixed toilet 3520.

Figure 50:
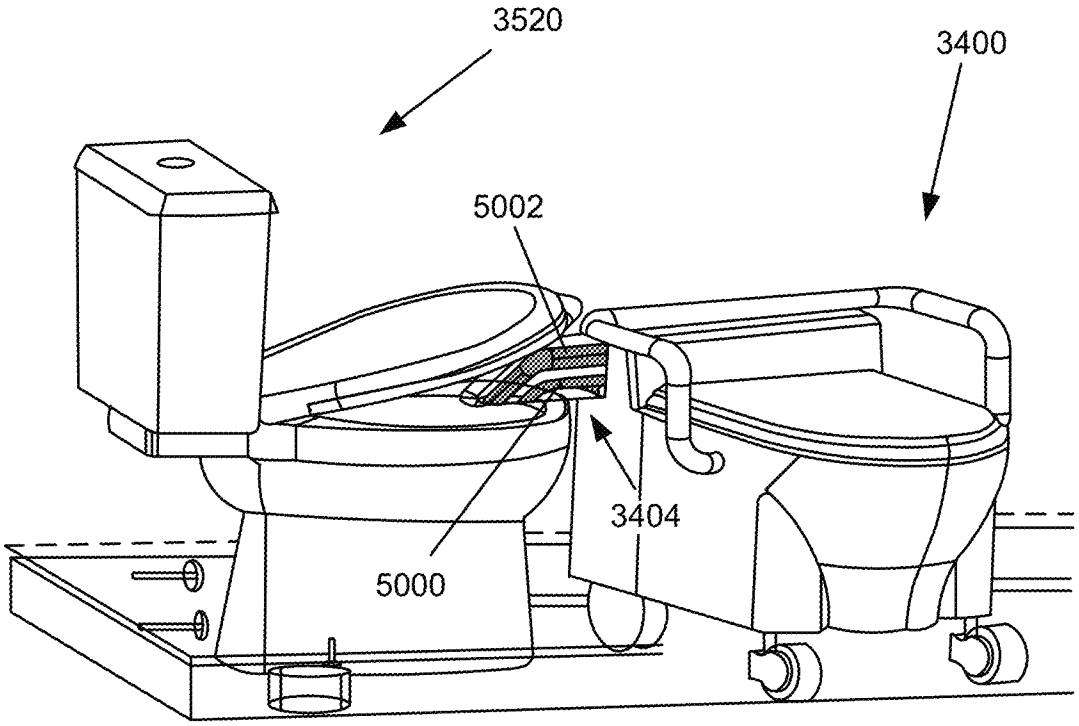
FIG. 50 shows an example of the retractable drain stem of FIGS. 34A and 34B, consistent with embodiments of the present disclosure.

In some instances, the retractable drain stem 3404 may include a supply line 5000 (see, e.g., FIG. 50) configured to fluidly couple with a bowl 3526 of the fixed toilet 3520. As shown in FIG. 50, the supply line 5000 is separate from a drain line 5002. The supply line 5000 may be configured to transition between an extended state in which at least a portion of the supply line 5000 is received within the bowl 3526 and a retracted state in which the supply line 5000 is removed from the bowl 3526 (e.g., fully retracted into the drain stem 3404). For example, the bowl 3526 of the fixed toilet 3520 may include a liquid (e.g., water) that can be transferred from the bowl 3526 to the autonomous toilet 3400 via the supply line 5000. The transferred liquid can be used in the transfer of waste from the autonomous toilet 3400 to the fixed toilet 3520, for cleaning one or more portions of the autonomous toilet 3400 that come in contact with waste, for storage in the autonomous toilet 3400 for later use, and/or the like. In some instances, the autonomous toilet 3400 may be configured to flush the fixed toilet 3520 prior to extending the supply line 5000 into the bowl 3526 and/or prior to transferring liquid from the bowl 3526 (which may prevent dirty liquid from being transferred to the autonomous toilet 3400). Transferring liquid from the bowl 3526 to the autonomous toilet 3400 may reduce splashing when waste is transferred to the bowl 3526 from the autonomous toilet 3400 through the drain line 5002.

In some instances, the autonomous toilet 3400 may include a height adjustment mechanism for adjusting a height 3516 of the drain stem 3404. Adjusting the height 3516 of the drain stem 3404 may allow the autonomous toilet 3400 to fluidly couple to fixed toilets 3520 having different heights. The height 3516 of the drain stem 3404 may be adjusted automatically (e.g., based on sensor data generated by one or more sensors of the autonomous toilet 3400) and/or manually (e.g., by a user).

In some instances, the lid 3522 of the fixed toilet 3520 may be configured to automatically transition towards the open position in response to the autonomous toilet 3400 reaching the fixed toilet location and may be configured to transition towards the closed position when the retractable drain stem 3404 is retracted. In some instances, the lid 3522 may be configured to automatically transition to a partially open position (e.g., a position between the open and closed positions). The partially open position may be configured such that there is a sufficient spacing between the bowl 3526 of the fixed toilet 3520 and the lid 3522 to enable the drain stem 3404 to extend over the opening 3518 and fluidly couple with the fixed toilet 3520.

In some instances, a predetermined draining position can be generated prior to the autonomous toilet 3400 engaging the fixed toilet 3520. The predetermined draining position may be proximate to (e.g., within 30 centimeters (cm), 20 cm, or 10 cm of) the fixed toilet 3520 such that an at least a portion of the retractable drain stem 3404 extends over the opening 3518 when the drain stem 3404 is in the extended position, fluidly coupling the autonomous toilet 3400 to the fixed toilet 3520. Alternatively, in some instances, there may not be a predetermined draining position. In these instances, the autonomous toilet 3400 may be configured to estimate a location of the fixed toilet 3520 using one or more sensors of the autonomous toilet 3400 and/or of the fixed toilet 3520. For example, the fixed toilet 3520 may include a beacon 3514 configured to generate a signal detectable by one or more sensors of the autonomous toilet 3400. Based, at least in part, on the detected signal(s), the autonomous toilet 3400 may estimate a location of the fixed toilet 3520. In some instances, the autonomous toilet 3400 may be configured to measure a strength of the detected signal(s) when estimating a location of the fixed toilet 3520. The beacon 3514 of the fixed toilet 3520 may generate one or more of radio frequency signal(s), optical signal(s), magnetic signal(s), and/or any other type of signal. Additionally, or alternatively, the autonomous toilet 3400 may include one or more sensors capable of identifying the fixed toilet 3520. For example, the autonomous toilet 3400 may include one or more cameras to capture one or more images of the surrounding environment and use object recognition to identify the fixed toilet 3520 within the captured one or more images.

After reaching the fixed toilet 3520, the autonomous toilet 3400 may determine its position and orientation relative to the fixed toilet 3520. Once the position and orientation of the autonomous toilet 3400 is determined, the autonomous toilet 3400 may make adjustments to its position, orientation, and/or height to enable the retractable drain stem 3404 to fluidly couple with the fixed toilet 3520. Additionally, or alternatively, the user may manually adjust the location and height of the autonomous toilet 3400 using, for example, a remote device such as a smartphone or remote control. When finished adjusting, the autonomous toilet 3400 may store the adjustment information for future use.

In some instances, the retractable drain stem 3404 may be configured to urge the lid 3522 towards the open position (e.g., urge the lid 3522 to the partially open position) such that waste can be transferred to the fixed toilet 3520. For example, when transitioning to the extended position, an end of the retractable drain stem 3404 can be configured to engage the lid 3522, wherein engagement with the lid 3522 causes the lid 3522 to move towards the open position. In this example, the end of the retractable drain stem 3404 can have a sloped surface 3406 such that a distal end region 3412 of the drain stem 3404 has a wedge shape (e.g., chamfered front) as shown in FIG. 34. In operation, when the drain stem 3404 is transitioning to the extended position, the distal end region 3412 of the drain stem 3404 is inserted between the bowl 3526 and the lid 3522 such that the sloped surface 3406 slides along the lid 3522, urging the lid 3522 in a direction away from the bowl 3526 (or in a direction towards the open position). For example, the retractable drain stem 3404 may move the lid to the partially open position when in the extended position. When extending the retractable drain stem 3404, the lid 3522 is lifted at least to the partially open position such that waste can be transferred to the bowl 3526 of the fixed toilet 3520 in response to the drain stem 3404 transitioning to the extended position. In some instances, the retractable drain stem 3404 may include an arm configured to urge the lid 3522 of the fixed toilet 3520 from a closed position toward (e.g., to) an open position. In this example, the arm may further be configured to transition the lid 3522 of the fixed toilet 3520 from the open position to the closed position after the waste has transferred to the fixed toilet 3520.

Figure 36B:
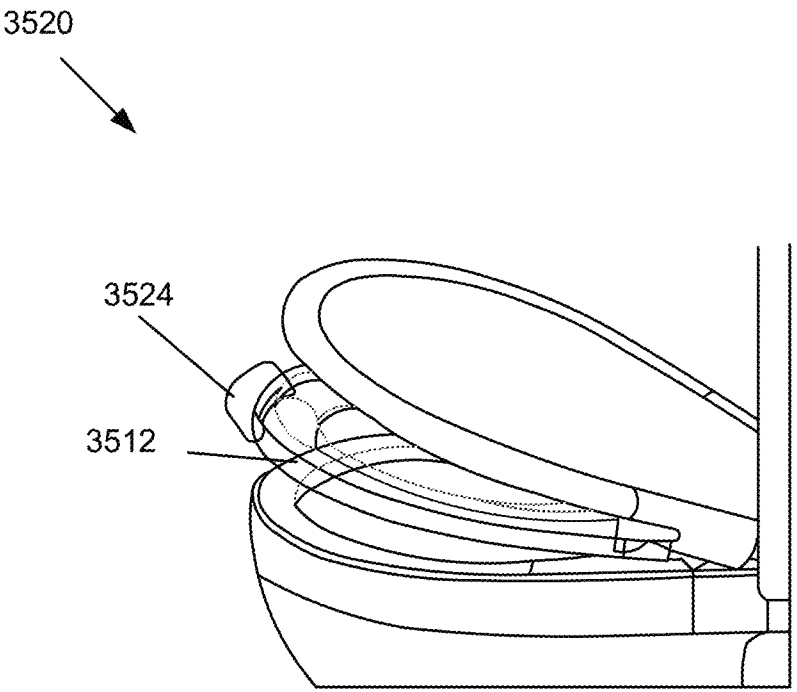
FIG. 36B shows the leading component of FIG. 36A coupled to a seat of a fixed toilet, consistent with embodiments of the present disclosure.
Figure 36A:
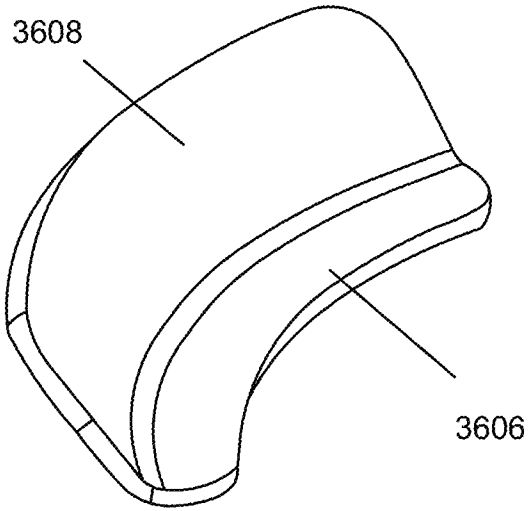
FIG. 36A shows an example of a leading component, consistent with embodiments of the present disclosure.

In some instances, the opening of the lid 3522 of the fixed toilet 3520 is assisted by a leading component 3524 that is coupled to the lid 3522 or to a seat 3512 that is positioned between lid 3522 and the bowl 3526. When the lid 3522 is in the closed position, movement of the seat 3512 towards the open position results in a corresponding movement of the lid 3522 towards the open position. The leading component 3524 is configured to cooperate with the drain stem 3404 to urge the lid 3522 of the fixed toilet 3520 and/or the seat 3512 of the fixed toilet 3520 in a direction of the open position. For example, as shown in FIG. 36B, the leading component 3524 may be coupled (or integrally formed from) to the seat 3512 of the fixed toilet 3520. In some instances, the leading component 3524 may be adhesively coupled to the seat 3512. For example, with reference to FIG. 36A, the leading component 3524 may include a coupling end 3606 configured to couple (e.g., removably or permanently couple) to the seat 3512 and a sloped end 3608 configured to cooperate with the sloped surface 3406 of the retractable drain stem 3404. In operation, the distal end region 3412 of the retractable drain stem 3404 may engage the leading component 3524 such that the lid 3522 is lifted with the extending of the retractable drain stem 3404. In some instances, the lid 3522 may define the leading component 3524.

In some instances, the door 3402 may be configured to cooperate with the lid 3522 and/or seat 3512 such that opening of the door 3402 urges the lid 3522 and/or the seat 3512 towards the open position. For example, a leading component, such as the leading component 3524 may be coupled to the door 3402. The leading component 3524 coupled to the door 3402 may be inserted between the lid 3522 and/or seat 3512 and the bowl 3526 of the fixed toilet 3520 such that, when the door 3402 is transitioned to the open position, the lid 3522 and/or seat 3512 is urged towards the open position. The door 3402 may be urged (e.g., rotated) towards the open position in response to extending the drain stem 3404. The door 3402 may be biased towards the closed position using one or more biasing mechanisms (e.g., one or more springs). The door 3402 may also be urged towards the open position by a motor. For example, the autonomous toilet 3400 may include a drive gear coupled to a drive shaft of a motor, wherein the drive gear is configured to engage a geared surface of the door 3402 to cause the door 3402 to transition between the open and closed positions. In response to transitioning the lid 3522 and/or seat 3512 to the open position, the drain stem 3404 may be inserted between the lid 3522 and the bowl 3526 of the fixed toilet 3520 to transfer the waste stored in the waste receptacle 3401.

When the autonomous toilet 3400 is engaging the fixed toilet 3520, a waste receptacle 3401 of the autonomous toilet 3400 may fluidly couple to the fixed toilet 3520 via the drain stem 3404 such that the waste receptacle 3401 may be emptied into the fixed toilet 3520. In some instances, the autonomous toilet 3400 may include a pump configured to urge waste through the retractable drain stem 3404. In some instances, the waste receptacle 3401 may be positioned at a location that is above the opening 3518 of the fixed toilet 3520 such that waste may be transferred to the fixed toilet 3520 via gravity.

In some instance, the autonomous toilet 3400 can be fluidly coupled to a water source and/or include a water reservoir (e.g., to clean the waste receptacle 3401 and/or to assist in urging waste to pass through the drain stem 3404).

In some instances, the autonomous toilet 3400 may be further configured to flush the fixed toilet 3520. For example, the fixed toilet 3520 may be communicatively coupled to the autonomous toilet 3400 (e.g., via a wireless connection such as Bluetooth), wherein the autonomous toilet 3400 may be configured to transmit a signal to the fixed toilet 3520 causing the fixed toilet 3520 to flush. By way of further example, the autonomous toilet 3400 may manually flush the fixed toilet 3520 (e.g., using an arm). After the waste receptacle 3401 has been emptied into the fixed toilet 3520, the waste receptacle 3401 may be configured to cause the fixed toilet 3520 to flush the waste. For example, the autonomous toilet 3400 may be communicatively coupled to a flusher (see, e.g., the flusher 2104 shown in FIG. 22, which is configured to actuate a flush handle 2200 of a fixed toilet).

In some instances, one or more of the autonomous toilet 3400 and/or the fixed toilet 3520 may be configured to analyze received waste (e.g., urine and/or feces). In some instances, the autonomous toilet 3400 may be configured to measure a quantity of waste within the waste receptacle 3401. If the measured quantity of waste exceeds a predetermined threshold (e.g., a volume corresponding to a maximum receivable volume of the fixed toilet 3520), the quantity of waste transferred to the fixed toilet 3520 may measure less than or equal to the predetermined threshold. In this instance, the fixed toilet 3520 may be flushed in response to the autonomous toilet 3400 discontinuing transfer of waste and, upon flushing the waste, the autonomous toilet 3400 may be caused to transfer, to the fixed toilet 3520, the remaining waste in the waste receptacle 3401 or an amount of waste measuring less than or equal to the predetermined threshold (this process may be repeated until the waste receptacle 3401 has been emptied).

Figure 37B:
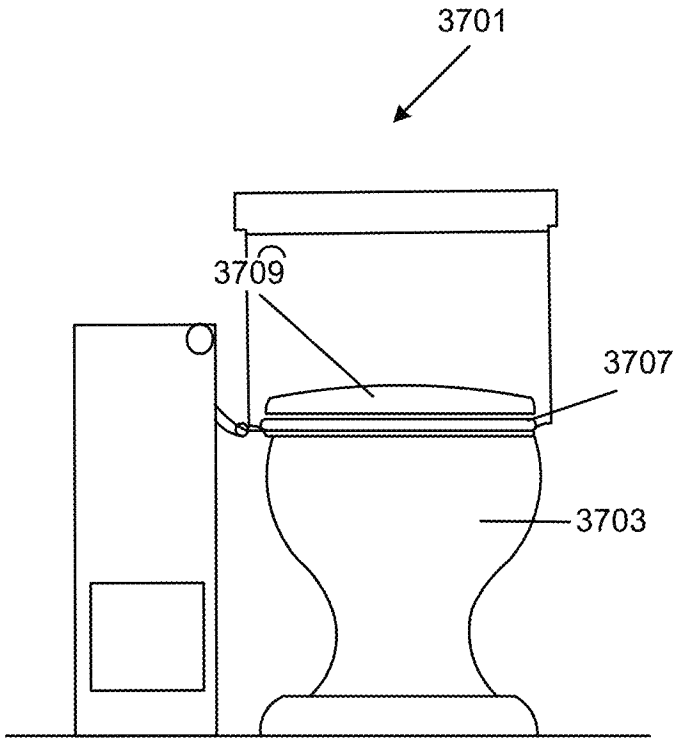
FIG. 37B shows a schematic example of the intermediate system of FIG. 37A fluidly coupled to a fixed toilet, consistent with embodiments of the present disclosure.
Figure 37A:
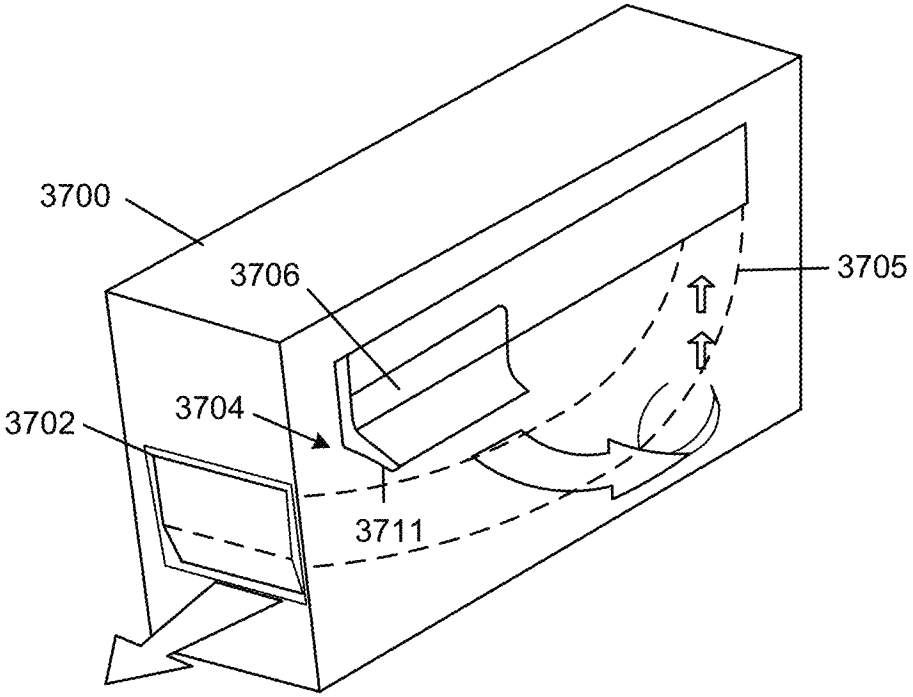
FIG. 37A shows a schematic example of an intermediate system configured to fluidly couple to a fixed toilet or a septic or sewer line, consistent with embodiments of the present disclosure.

FIG. 37A shows a schematic example of an intermediate system 3700 configured to couple to a fixed toilet and/or a septic or sewer line. The intermediate system 3700 may be configured to be moveable by user. For example, the user may move the intermediate system to a location proximate to a fixed toilet 3701 as shown in FIG. 37B.

In some instances, the intermediate system 3700 may be configured to empty the waste receptacle of an autonomous toilet by fluidly coupling the autonomous toilet to the fixed toilet 3701 or a septic or sewer line. In some instances, the intermediate system 3700 may include a waste transfer reservoir configured to receive waste from an autonomous toilet and temporarily store it for later disposal. In this instance, the intermediate system 3700 may not be fluidly coupled to the fixed toilet 3701 or a septic or sewer line.

The intermediate system 3700 may further comprise an input hole 3702, an output hole 3704 and a discharge line 3705 fluidly coupling the input hole 3702 to the output hole 3704. The input and output holes 3702 and 3704 may be on the same or different sides of the intermediate system 3700. The input hole 3702 is configured to fluidly couple to an autonomous toilet to receive the waste from the autonomous toilet. The output hole 3704 may be configured to fluidly coupled to the fixed toilet 3701 (such that waste can be transferred from the output hole 3704 and into the fixed toilet 3701).

In some instances, the intermediate system 3700 further comprises a cover 3706 configured to cover the output hole 3704 and/or define at least a portion of the output hole 3704. Before discharging, the cover 3706 opens such that the discharge line 3705 of the intermediate system 3700 fluidly couples to the fixed toilet 3701. For example, the discharge line 3705 may be coupled to and/or at least partially defined by the cover 3706 such that the opening of the cover 3706 (e.g., through pivotal movement) positions the output hole 3704 of the discharge line 3705 over a bowl 3703 of the fixed toilet 3701, fluidly coupling the discharge line 3705 to the fixed toilet 3701. In some instances, the cover 3706 may be configured to rotate between an open and closed position, wherein, when the cover 3706 transitions to the open position, the cover 3706 urges a seat 3707 and/or a lid 3709 towards an open position.

Figure 38:
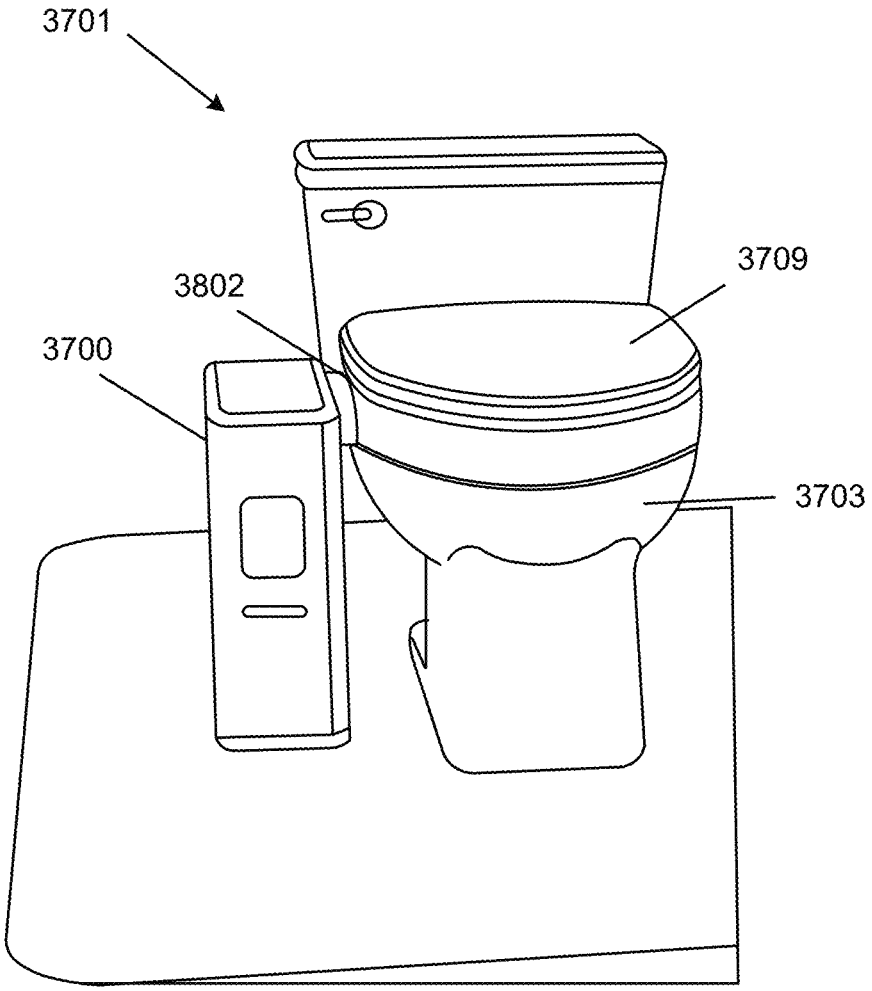
FIG. 38 shows a schematic example of the intermediate system of FIG. 37A fluidly coupled to a fixed toilet using an adapter, consistent with embodiments of the present disclosure.

The cover 3706 may include a lip 3711. The lip 3711 may have a wedge shape. The lip 3711 may be positioned between the lid 3709 and bowl 3703 of the fixed toilet 3701 such that rotation of the cover 3706 urges the lid 3709 and/or seat 3707 of the fixed toilet 3701 towards an open position. As the lid 3709 and/or seat 3707 opens, a portion of the discharge line 3705 may be positioned between the lid 3709 and/or seat 3707 and the bowl 3703 of the fixed toilet 3701. Alternatively, and with reference to FIG. 38, the output hole 3704 can be fluidly coupled to an adapter 3802 that attaches to or is formed from the intermediate system 3700. In this example, the intermediate system 3700 may not open the lid 3709 prior to depositing waste into the fixed toilet 3701. In some instances, the adapter 3802 may extend around the bowl 3703 of the fixed toilet 3701, forming the seat 3707 of the fixed toilet 3701.

In some instances, the intermediate system 3700 is configured to be lifted to an elevated position. Lifting the intermediate system 3700 may lift the lid 3709 and/or seat 3707 of the fixed toilet 3701 (e.g., the lip 3711 may be positioned between the lid 3709 and/or seat 3707 and the bowl 3703 of the fixed toilet 3701). Lifting the intermediate system 3700 to the elevated position may also encourage waste transfer (e.g., as a result of gravitational forces acting on the waste).

In some instances, the intermediate system 3700 may include a waste transfer reservoir to receive waste from an autonomous toilet and temporarily store it for later disposal. For example, the waste transfer reservoir may be configured to carry out one or more operations on the waste therein. The operations may include a grinding operation that is configured to grind the waste into a slurry capable of being carried through a pump. In some instances, a fluid (e.g., water) may be added during the grinding operation to decrease the viscosity of the slurry. The waste within the waste transfer reservoir may be transferred to a fixed toilet using the discharge line 3705. A position of the discharge line 3705 (e.g., a position of an output end of the discharge line 3705) may be adjustable by the intermediate system. For example, a portion of the discharge line 3705 may be configured to transition between a retracted position and an extended position. When in the extended position, at least a portion of the discharge line 3705 may be positioned over the bowl 3703 of the fixed toilet 3701, fluidly coupling the discharge line 3705 to the fixed toilet 3701. In some instances, when in the extended position, a rotational orientation of the discharge line 3705 may be adjusted such that the discharge line 3705 is positioned over the bowl 3703. When the discharge line 3705 is in the extended position, waste can be urged through the discharge line 3705. For example, the intermediate system 3700 may include a pump configured to urge waste through the discharge line 3705.

In some instances, the intermediate system 3700 may have a compartment for loading a waste container such that the intermediate system 3700 empties the waste container. As such, the waste container may fluidly couple to the discharge line 3705 when the waste container is received within the intermediate system 3700.

In some instances, the intermediate system 3700 may also function as a docking station. As such the intermediate system 3700 can be configured to recharge the autonomous toilet.

In some instances, the intermediate system 3700 can be fluidly coupled to a water source such that water can be delivered to the waste transfer reservoir. The water may be used to clean the waste transfer reservoir and/or to assist in urging waste to pass through the discharge line 3705.

Figure 39:
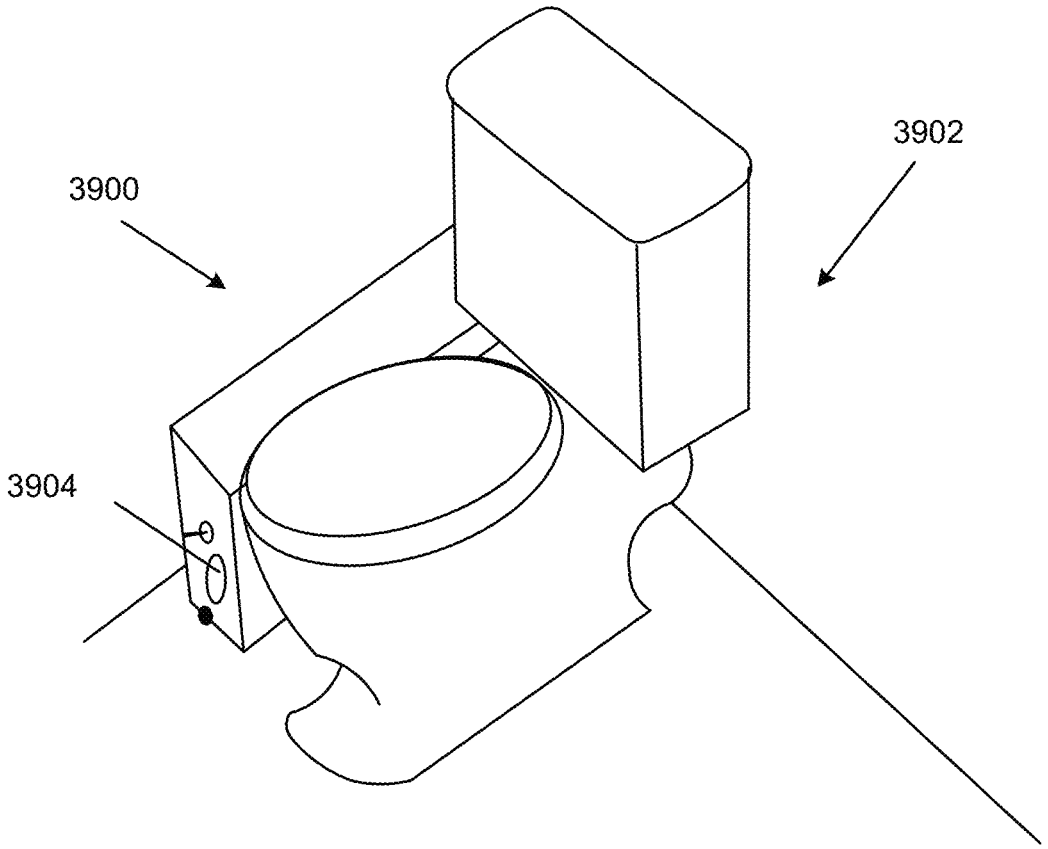
FIG. 39 shows a schematic example of an intermediate system cooperating with a fixed toilet, consistent with embodiments of the present disclosure.

FIG. 39 shows a schematic example of an intermediate system 3900 configured to cooperate with a fixed toilet 3902. The intermediate system 3900 may include one or more connections 3904 configured to cooperate with an autonomous toilet and/or a cleaning system. For example, a cleaning system may be configured to fluidly couple to the one or more connections for cleaning the intermediate system 3900 (e.g., the cleaning system may urge a sanitizing fluid, an enzyme cleaner, and/or any other type of cleaning solution through the intermediate system 3900).

Figure 40A:
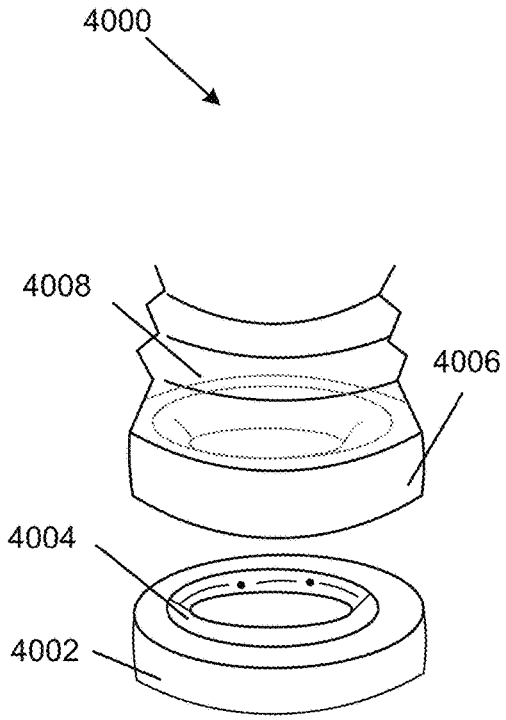
FIG. 40A shows a schematic example of a drain connector system in a disconnected configuration, consistent with embodiments of the present disclosure.
Figure 40B:
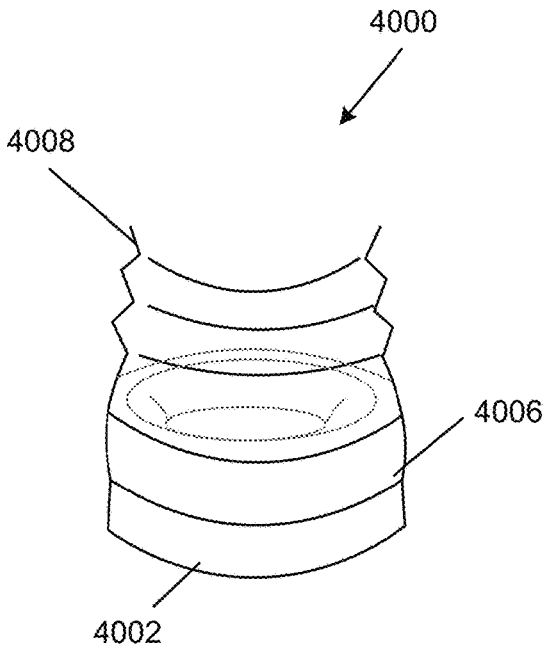
FIG. 40B shows a schematic example of the drain connector system of FIG. 40A in a connected configuration, consistent with embodiments of the present disclosure.

FIG. 40A shows a schematic example of a drain connector system 4000 in a disconnected configuration and FIG. 40B shows a schematic example of the drain connector system 4000 in a connected configuration. As shown, the drain connector system 4000 includes a flange 4006 coupled to a tube 4008 (e.g., a discharge line) and a drain 4002 (e.g., a fixed drain of a septic or sewer line or a drain interface of an intermediate system). The flange 4006 is configured to removably couple to the drain 4002. The drain 4002 and/or the flange 4006 may include a seal 4004 configured that is configured to cause a seal to be formed between the drain 4002 and the flange 4006 when the drain 4002 and flange 4006 are coupled together. When the flange 4006 is coupled to the drain 4002, the tube 4008 is fluidly coupled to the drain. The seal 4004 may be made of one or more elastic materials (e.g., a natural or synthetic rubber). In some instances, the seal 4004 may be a metal feature.

The flange 4006 may be configured to couple (e.g., magnetically) to the drain 4002 and/or the seal 4004. Magnetic coupling may encourage an alignment of the flange 4006 with the drain 4002 when coupling the flange 4006 to the drain 4002. One or more of the flange 4006, the drain 4002, and/or the seal 4004 may include magnetic elements configured to cooperate to form the magnetic coupling.

In some instances, the seal 4004 may include one or more magnetic features (e.g., that attract magnets and/or generate a magnetic force). Including magnetic features with the seal 4004 may encourage the seal 4004 engage an inner side of the flange 4006, providing a sealing connection at the interface between the flange 4006 and the seal 4004. The flange 4006 may be magnetic (e.g., electromagnetic) such that the seal 4004 is attracted to the flange 4006. When the flange 4006 includes an electromagnetic feature, uncoupling the seal 4004 from the flange 4006 may be easier than if the flange 4006 includes a permanent magnet.

In some instances, an autonomous toilet may include the tube 4008 and the flange 4006 coupled to the tube 4008. The tube 4008 may be configured to be extendable from and retractable into the autonomous toilet (e.g., the autonomous toilet 300 of FIG. 3). The flange 4006 may be configured to selectively generate a magnetic field (e.g., using an electromagnet). As such the autonomous toilet may further include an actuator configured to activate the magnetic field of the flange 4006 upon arriving at a preset position (e.g., when the autonomous toilet is at a docking position). As such, the magnetic field of the flange 4006 may assist in aligning the flange 4006 and may the couple the flange 4006 to the drain 4002. To decouple the flange 4006, the magnetic field may be deactivated and/or the polarity switched. If the polarity is switched, the flange 4006 may be urged away from the drain 4002.

An example of an autonomous toilet, consistent with the present disclosure, may include a waste receptacle having a receptacle opening, a seat extending at least partially around the receptacle opening, the seat being configured to support a user of the autonomous toilet, a plurality of driven wheels configured to urge the autonomous toilet across a surface, one or more sensors configured to sense one or more conditions of a surrounding environment, and a controller communicatively coupled to the one or more sensors and the plurality of driven wheels.

In some instances, the autonomous toilet may include one or more communication devices configured to be communicatively coupled to a remote device, wherein the one or more communication devices may be configured to receive a summon request from the remote device and, in response to receiving the summon request, the controller causes the plurality of driven wheels to navigate the autonomous toilet to a user location. In some instances, the autonomous toilet may include a secondary storage receptacle selectively fluidly coupled to the waste receptacle. In some instances, the autonomous toilet may include at least a portion of a coupling system configured to fluidly couple the autonomous toilet to a water supply. In some instances, the autonomous toilet may include one or more retractable handles. In some instances, the autonomous toilet may include one or more stabilizers. In some instances, the autonomous toilet may include a fluid reservoir configured to provide fluid to the waste receptacle. In some instances, the autonomous toilet may further include a disposable liner disposed within the waste receptacle. In some instance, the autonomous toilet may further include a drain stem configured to fluidly couple to a fixed toilet to transfer waste stored in the waste receptacle.

An example of an autonomous toilet system, consistent with the present disclosure, may include a docking station and an autonomous toilet configured to engage the docking station. The autonomous toilet may include a waste receptacle having a receptacle opening, a seat extending at least partially around the receptacle opening, the seat being configured to support a user of the autonomous toilet, a plurality of driven wheels configured to urge the autonomous toilet across a surface, one or more sensors configured to sense one or more conditions of a surrounding environment, and a controller communicatively coupled to the one or more sensors and the plurality of driven wheels.

In some instances, the docking station may be configured to charge one or more batteries of the autonomous toilet. In some instances, the docking station may include a drain adapter, the drain adapter being configured to be fluidly coupled to a drain. In some instances, the drain adapter may include a movable cover. In some instances, the autonomous toilet may be configured to cause the movable cover to transition to an open position. In some instances, the autonomous toilet may further include one or more communication devices configured to be communicatively coupled to a remote device and, wherein, the one or more communication devices may be configured to receive a summon request from the remote device and, in response to receiving the summon request, the controller causes the plurality of driven wheels to navigate the autonomous toilet to a user location. In some instances, the autonomous toilet may include a secondary storage receptacle selectively fluidly coupled to the waste receptacle. In some instances, the autonomous toilet system may include a coupling system configured to fluidly couple the autonomous toilet to a water supply. In some instances, the docking station may include a supply side of the coupling system, the supply side having a first threaded coupling fluidly coupled to the water supply and the autonomous toilet may include a toilet side of the coupling system, the toilet side having a second threaded coupling configured to threadably couple to the first threaded coupling. In some instances, the second threaded coupling may include a geared outer surface. In some instances, the supply side may include a drive gear coupled to a motor, the drive gear being configured to mate with the geared outer surface of the second threaded coupling. In some instances, the autonomous toilet may include one or more retractable handles. In some instances, the autonomous toilet may include one or more stabilizers. In some instances, the autonomous toilet may include a fluid reservoir configured to provide fluid to the waste receptacle.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems. The terms "connected" or "coupled" as used herein is a relative term and does not require a direct physical connection, unless otherwise stated.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising," "including," and "having" are intended to be inclusive and mean that there may be additional elements other than the listed elements.

Although the methods and systems have been described relative to a specific embodiment thereof, they are not so limited. Obviously, many modifications and variations may become apparent in light of the above teachings. Many additional changes in the details, materials, and arrangement of parts, herein described and illustrated, may be made by those skilled in the art.

What is claimed is:

1. An autonomous toilet comprising:
- a waste receptacle having a receptacle opening;
- a lid movable between an open position and a closed position to selectively close the receptacle opening;
- a seat extending at least partially around the receptacle opening, the seat being configured to support a user of the autonomous toilet;
- a plurality of driven wheels configured to urge the autonomous toilet across a surface within an environment;
- one or more sensors configured to sense one or more conditions of the environment; and
- a controller communicatively coupled to the one or more sensors and the plurality of driven wheels, the controller being configured to cause the driven wheels to rotate to navigate the autonomous toilet within the environment to a user location, wherein:
  - the lid is caused to automatically transition from the closed position to the open position in response to the autonomous toilet reaching the user location; and
  - the lid is caused to automatically transition from the open position to the closed position before leaving the user location.

2. The autonomous toilet of claim 1, further comprising one or more communication devices configured to be communicatively coupled to a remote device, wherein the one or more communication devices are configured to receive a summon request from the remote device and, in response to receiving the summon request, the controller causes the plurality of driven wheels to navigate the autonomous toilet to the user location.

3. The autonomous toilet of claim 1 further comprising a secondary storage receptacle selectively fluidly coupled to the waste receptacle.

4. The autonomous toilet of claim 1 further comprising at least a portion of a coupling system configured to fluidly couple the autonomous toilet to a water supply.

5. The autonomous toilet of claim 1 further comprising one or more retractable handles configured to transition between an extended position and a retracted position, the retractable handles being configured to automatically transition from the retracted position to the extended position in response to the autonomous toilet reaching the user location.

6. The autonomous toilet of claim 1 further comprising one or more stabilizers configured to transition between a deployed position and a storage position, the stabilizers being configured to automatically transition from the storage position to the deployed position in response to the autonomous toilet reaching the user location.

7. The autonomous toilet of claim 1 further comprising a fluid reservoir configured to provide fluid to the waste receptacle.

8. The autonomous toilet of claim 1 further comprising a disposable liner disposed within the waste receptacle.

9. The autonomous toilet of claim 1 further comprising a drain stem configured to fluidly couple to a fixed toilet to transfer waste stored in the waste receptacle.

10. An autonomous toilet system comprising:
- a docking station; and
- an autonomous toilet configured to engage the docking station, the autonomous toilet including:
  - a waste receptacle having a receptacle opening;
  - a lid movable between an open position and a closed position to selectively close the receptacle opening;
  - a seat extending at least partially around the receptacle opening, the seat being configured to support a user of the autonomous toilet;
  - a plurality of driven wheels configured to urge the autonomous toilet across a surface within an environment;
  - one or more sensors configured to sense one or more conditions of the environment; and
  - a controller communicatively coupled to the one or more sensors and the plurality of driven wheels, the controller being configured to cause the driven wheels to rotate to navigate the autonomous toilet within the environment to a user location, wherein:
    - the lid is caused to automatically transition from the closed position to the open position in response to the autonomous toilet reaching the user location; and
    - the lid is caused to automatically transition from the open position to the closed position before leaving the user location.

11. The autonomous toilet system of claim 10, wherein the docking station is configured to charge one or more batteries of the autonomous toilet.

12. The autonomous toilet system of claim 10, wherein the docking station includes a drain adapter, the drain adapter being configured to be fluidly coupled to a drain.

13. The autonomous toilet system of claim 12, wherein the drain adapter includes a movable cover.

14. The autonomous toilet system of claim 13, wherein the autonomous toilet is configured to cause the movable cover to transition to an open position.

15. The autonomous toilet system of claim 10, wherein the autonomous toilet further comprises one or more communication devices configured to be communicatively coupled to a remote device and, wherein, the one or more communication devices are configured to receive a summon request from the remote device and, in response to receiving the summon request, the controller causes the plurality of driven wheels to navigate the autonomous toilet to the user location.

16. The autonomous toilet system of claim 10, wherein the autonomous toilet includes a secondary storage receptacle selectively fluidly coupled to the waste receptacle.

17. The autonomous toilet system of claim 10 further comprising a coupling system configured to fluidly couple the autonomous toilet to a water supply.

18. The autonomous toilet system of claim 17, wherein the docking station includes a supply side of the coupling system, the supply side having a first threaded coupling fluidly coupled to the water supply and the autonomous toilet includes a toilet side of the coupling system, the toilet side having a second threaded coupling configured to threadably couple to the first threaded coupling.

19. The autonomous toilet system of claim 18, wherein the second threaded coupling includes a geared outer surface.

20. The autonomous toilet system of claim 19, wherein the supply side includes a drive gear coupled to a motor, the drive gear being configured to mate with the geared outer surface of the second threaded coupling.

21. The autonomous toilet system of claim 10, wherein the autonomous toilet includes one or more retractable handles configured to transition between an extended position and a retracted position, the retractable handles being configured to automatically transition from the retracted position to the extended position in response to the autonomous toilet reaching the user location.

22. The autonomous toilet system of claim 10, wherein the autonomous toilet includes one or more stabilizers configured to transition between a deployed position and a storage position, the stabilizers being configured to automatically transition from the storage position to the deployed position in response to the autonomous toilet reaching the user location.

23. The autonomous toilet system of claim 10, wherein the autonomous toilet includes a fluid reservoir configured to provide fluid to the waste receptacle.

* * * * *